United States Patent [19]

Grady et al.

[11] 4,245,346

[45] Jan. 13, 1981

[54] COMMUNICATION SYSTEM

[75] Inventors: Robert J. Grady, Garden Grove; Harry G. Posthumus, Los Angeles, both of Calif.

[73] Assignee: Magnavox Government and Industrial Electronics Co., Fort Wayne, Ind.

[21] Appl. No.: 172,061

[22] Filed: Feb. 7, 1962

[51] Int. Cl.[3] ..... H04K 1/00

[52] U.S. Cl. ..... 455/28; 343/100 CL

[58] Field of Search ..... 325/32, 33, 34, 35; 331/78; 178/22; 343/100.7, 6.8, 7.5, 6.8 R, 100 CL; 179/1.5; 455/26, 27, 28, 30

[56] References Cited

U.S. PATENT DOCUMENTS

| | | | |
|---|---|---|---|
| 2,123,716 | 7/1938 | Crosby | 325/417 |
| 2,401,405 | 6/1946 | Bedford | 178/69.5 |
| 2,401,454 | 6/1946 | Bemis | 178/22 |
| 2,423,546 | 7/1947 | Bedford | 343/100 CL |
| 2,530,140 | 11/1950 | Atkins | 179/1.5 |
| 2,568,926 | 9/1951 | Moran | 343/7.5 |
| 2,768,372 | 10/1956 | Green | 343/17.1 |
| 2,847,572 | 8/1958 | Favin | 325/419 |

*Primary Examiner*—Richard A. Farley

*Attorney, Agent, or Firm*—William J. Iseman; William J. Streeter; Thomas A. Briody

EXEMPLARY CLAIM

1. In combination: a signal source for producing a signal having characteristic variations representative of intelligence, a first code source for producing a first code signal having apparently random characteristic variations but actually having characteristic variations conforming to a first particular code sequence which repeats after a relatively short time interval, a second code source for producing a second code signal likewise having apparently random characteristic variations but actually having characteristic variations conforming to a second particular code sequence which may repeat after a relatively long time interval, modifying circuit means responsive to the intelligence signal from the signal source and to a coded signal for modifying the characteristics of the coded signal in accordance with the characteristics of the intelligence signal, and means responsive to the signals from the first code source and to the signals from the second code source for initially introducing the first code signal to the modifying means for modification of such signal in accordance with the characteristics of the intelligence signal and of the first code signal and for subsequently introducing the second code signal to the modifying means for modification of the second code signal in accordance with the characteristics of the intelligence signal.

45 Claims, 25 Drawing Figures

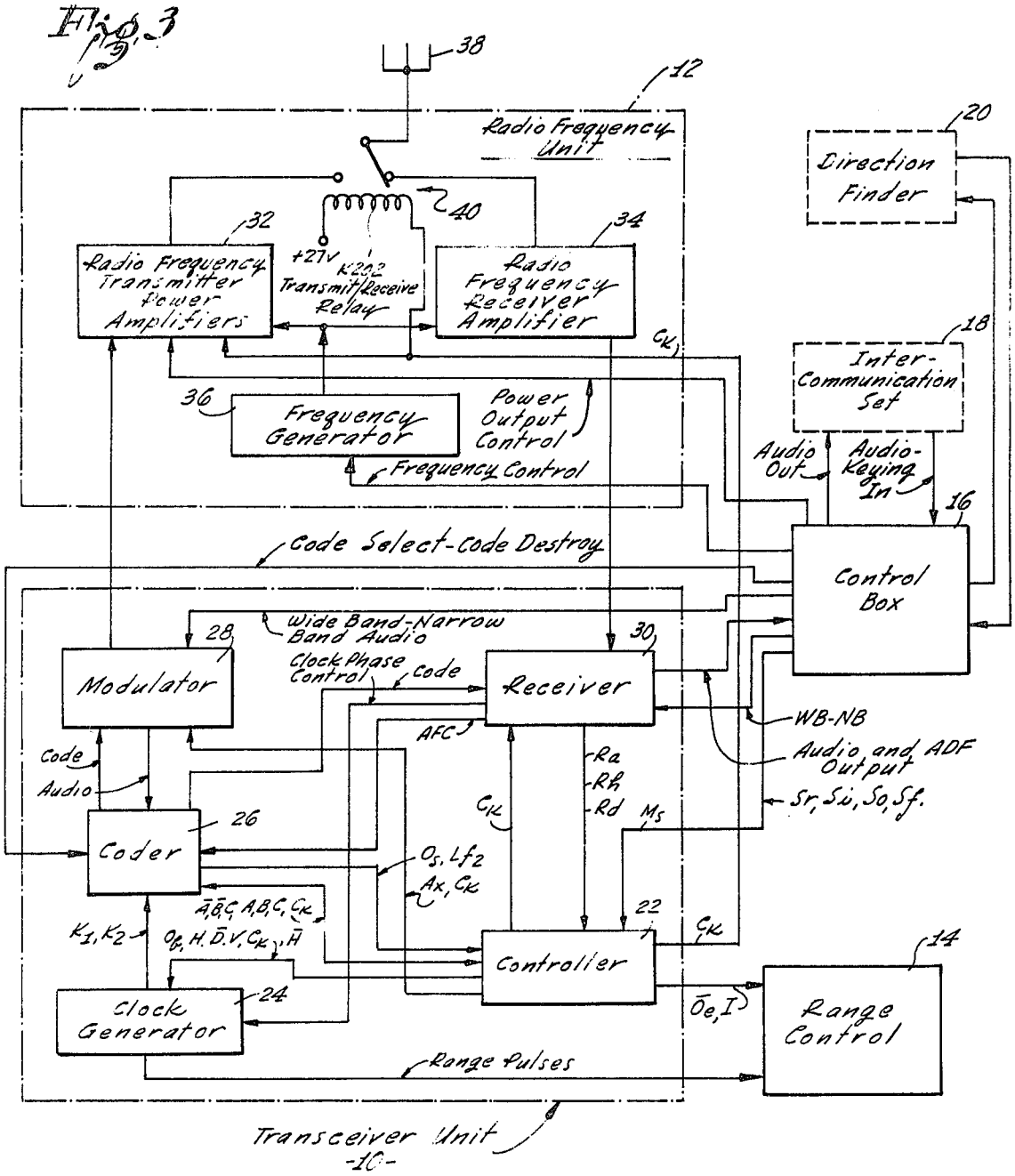
Fig. 3
38
12
Radio Frequency Unit
20
Direction Finder
40
32
34
Radio Frequency Transmitter Power Amplifiers
+27V
K202 Transmit/Receive Relay
Radio Frequency Receiver Amplifier
18
Inter-Communication Set
36
Frequency Generator
Power Output Control
Frequency Control
Audio Out
Audio-Keying In
16
Code Select-Code Destroy
Control Box
Wide Band-Narrow Band Audio
28
30
Modulator
Clock Phase Control
Code
Receiver
WB-NB
AFC
Audio and ADF Output
Code
Audio
Ra
Rh
Rd
Sr, Si, So, Sf.
26
Coder
Ms
Os, Lf2
Ax, Ck
22
K1, K2
Controller
14
Clock Generator
24
Range Control
Range Pulses
Transceiver Unit
-10-

Fig. 4b (Controller 22 of Transceiver 10 - (Cont'd. in Fig 4b))

Fig. 4b (Cont's from Fig 4a) (Controller of Transceiver-10)

60 mc Mixer 206
2nd I.F. 60 mc Amp. -204-
Balanced Modulator ~202~
1st 60 mc I.F. Amp (10 mc Wide) ~200~
Balanced Modulator
Code Wave Form Shaper -203-
Narrow Band Wide Band Mode Relay
54 mc Osc. ~208~
AGC
To Input Terminal 320 (Fig. 7)
AGC From Output Terminal 355 of Fig. 8
Wide Band Signal From Controller ~24~
Decoding Signal "F"
Decoding Signal "G"
From Coder -26-
60 mc Input From Mixer ~37~ (Fig. 5)
Code "F"
Code "G"
+120 V
-18v.
+27v.
+18v.

Fig. 14 (Code Mixer 600 of Coder 26 Fig. 13)
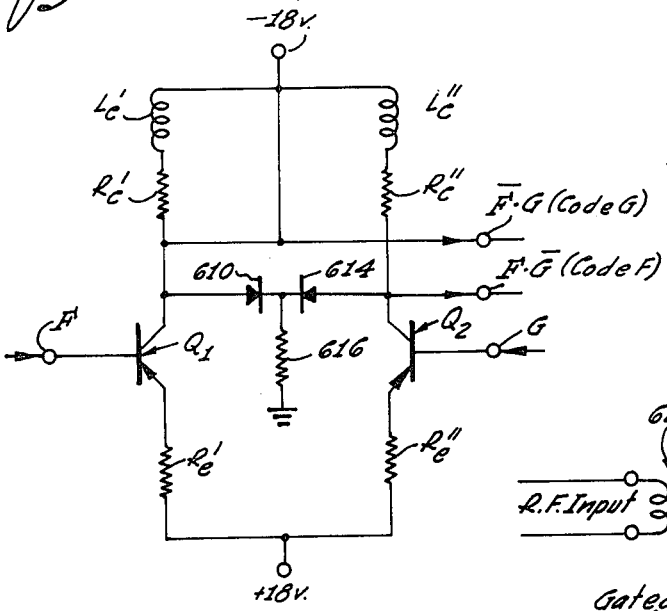
Fig. 15 (Receiver Decoding Stage)
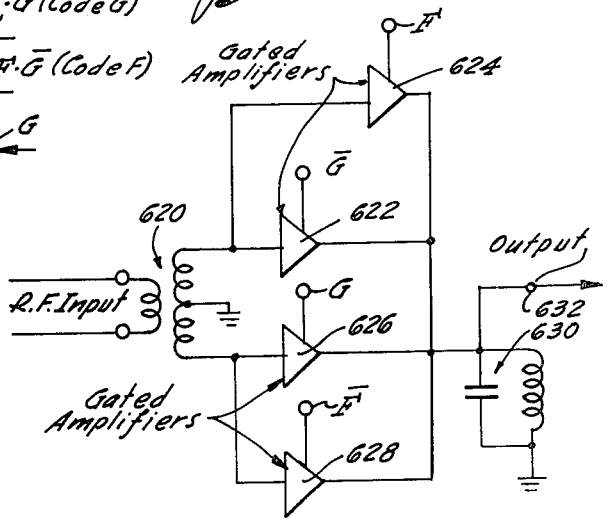
Fig. 16 (Hybrid Balanced Modulator 202 of Receiver 30)
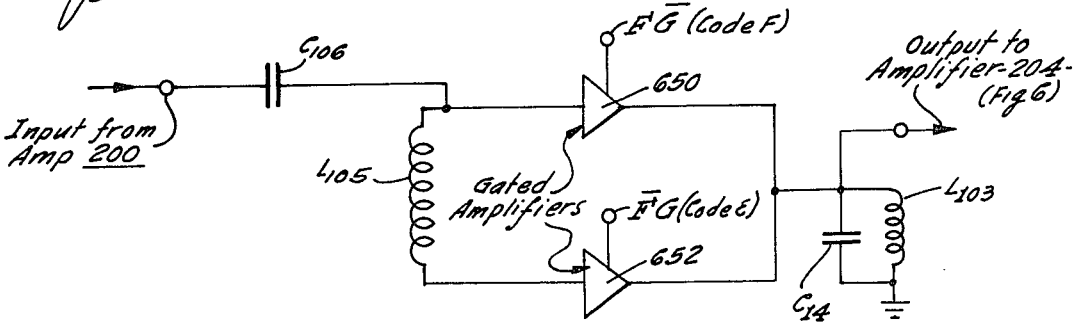

Fig. 17 (60 mc Modulator 28 - Block Diagram)
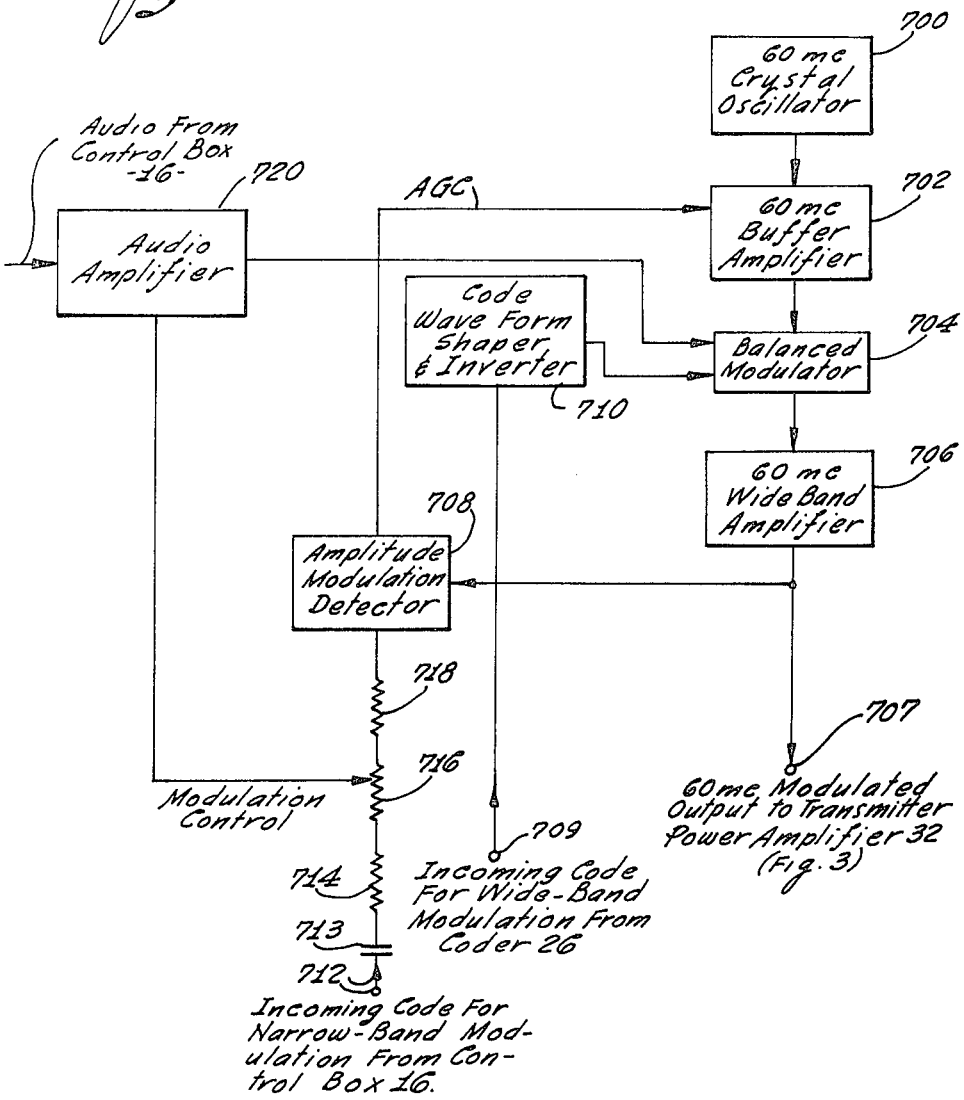
Fig. 19 (Transmitter Power Amplifier 32 of Radio Frequency Unit 12)
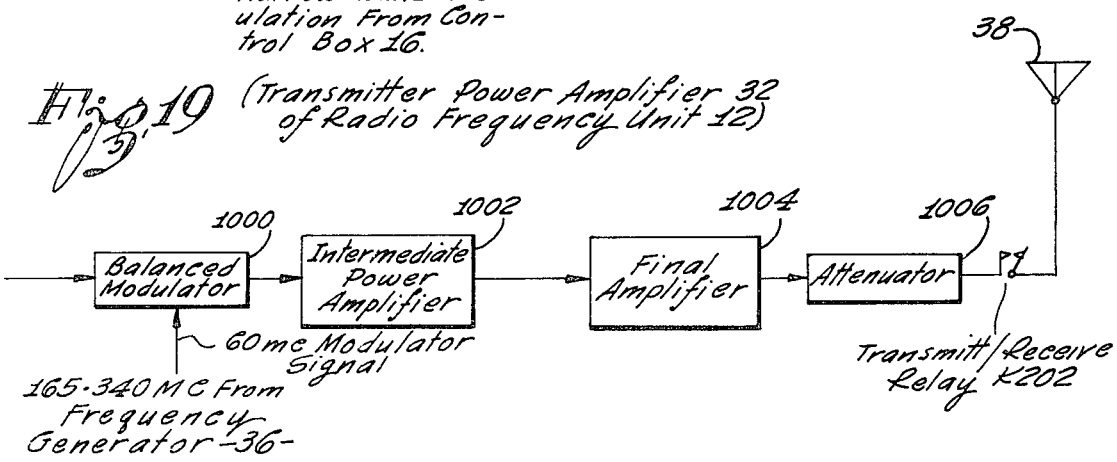

Fig. 20 (Radio Frequency Receiver-Amplifier 34 of Radio Frequency Unit ~12~)
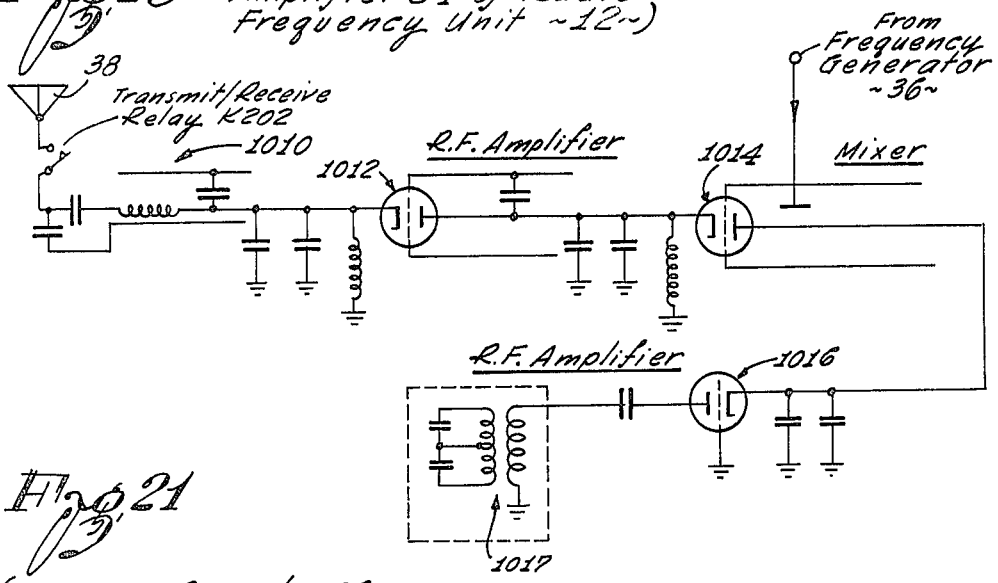
Fig. 21
(Frequency Generator 36 of Radio Frequency Unit-12)
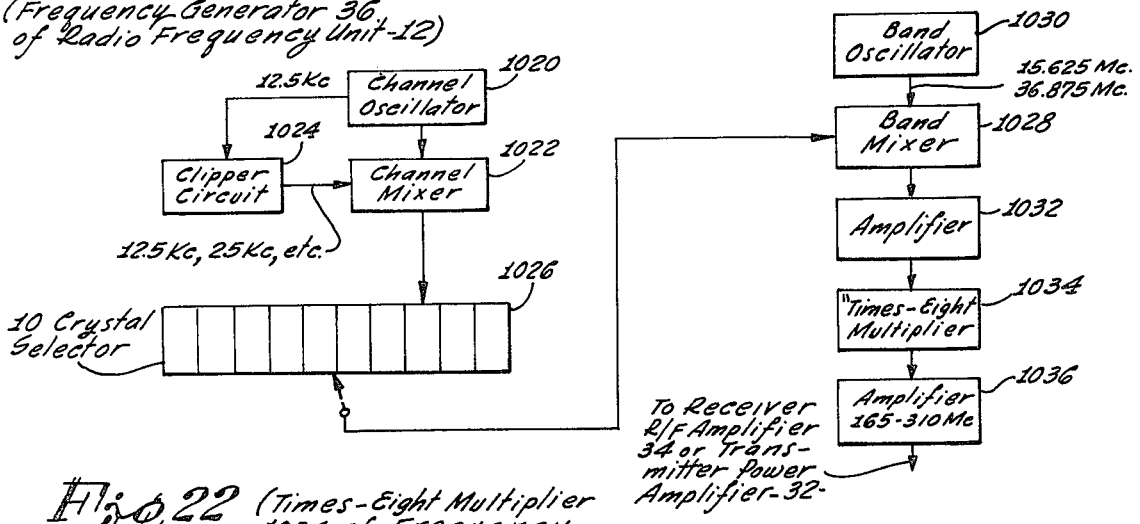
Fig. 22 (Times-Eight Multiplier 1034 of Frequency Generator 36).
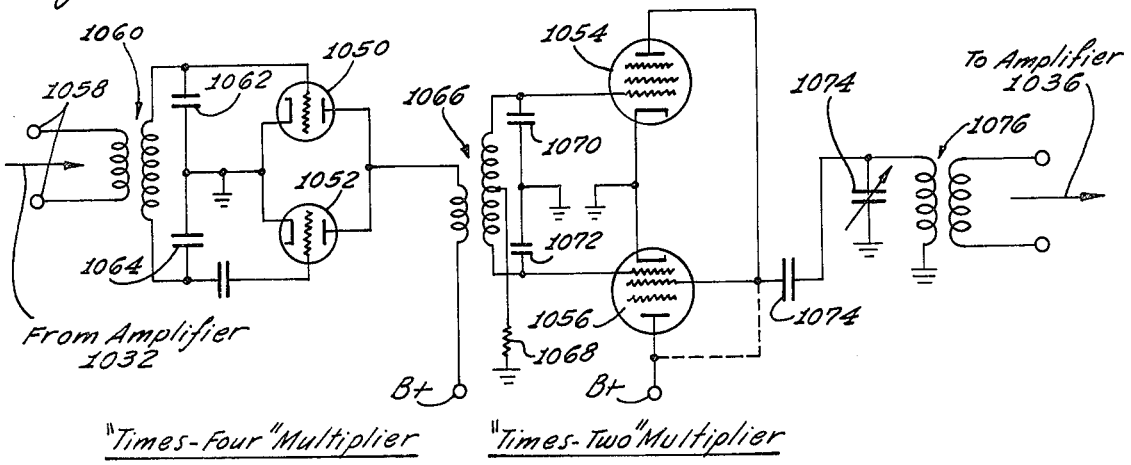

COMMUNICATION SYSTEM

The present invention relates to communication systems in which communcation is provided in coded form between two or more stations.

For private communication between two or more stations, the signals transmitted between the stations to represent intelligence must be coded or otherwise rendered unintelligible to unauthorized receivers. The coded intelligence signals are transmitted to an authorized receiving station, however, in a form such that the signals can be detected and decoded at such a receiving station.

Certain essentials are required to provide a satisfactory coded communication system. One requirement is that the intelligence signals be coded at the transmitter in such a manner that they may be easily decoded at the authorized receiving stations. Furthermore, the coding at the transmitting station and the decoding at the receiving station should be accomplished without any loss of intelligence. A further concurrent requirement, however, is that the coding of the intelligence signals be of such a nature that the code cannot easily be broken by unauthorized stations which may receive the coded intelligence signals. Many attempts have been made to provide a system meeting these requirements, but these attempts have not been entirely satisfactory.

However, a suitable system of the type referred to in the preceding paragraph is disclosed and claimed in copending application Ser. No. 735,089 which was filed May 9, 1958, in the name of Joseph P. Gleason et al. In the system disclosed in the copending application, the criteria outlined in the preceding paragraphs are met by coding the intelligence signal with a coding signal having a "pseudo-random" characteristic.

The term "psuedo-random" is intended to mean signals satisfying most of the requirements of randomness so as to preclude the reception of the intelligence by unauthorized stations. However, the characteristic changes in the pseudo-random coding signal, in reality, proceed in accordance with a fixed pattern or program, and this pattern repeats after a certain finite period. These characteristics of the pseudo-random coding signal enable the coding signal to be easily duplicated in an authorized receiver and used for decoding purposes.

In the system described in the copending application Ser. No. 735,089, a coding signal generator is provided at the transmitting station to produce signals having first and second amplitude levels. When no intelligence is being transmitted, the coding signal generator produces signals which alternate between the first and second amplitude levels at a constant frequency. However, upon the production of intelligence such as audio signals, the signals produced by the coding signal generator become modulated in frequency in accordance with the characteristics of the intelligence. The resulting modulated intelligence signals are combined with the coding signal in a suitable coding unit, such as a balanced modulator, to produce the intelligence signals which are used for transmission to the distant receiving station. At the transmitting station of the copending application, the psuedo-random coding signal produced by the coding signal generator is inverted every time the amplitude of the modulated intelligence signals changes. For example, the pseudo-random coding signal may be considered to have high and low amplitudes at successive periods which do not have any apparent periodicity. During the time that the modulated intelligence signal has a high amplitude, the coding signal continues in its original form. However, when the modulated intelligence signal exhibits its low amplitude level, the coding signal becomes inverted in polarity. This causes the high amplitude portions of the original coding signal to become low amplitude portions and vice versa.

The receiving station of the copending application has a decoder which produces signals in a pseudo-random pattern corresponding to the signals produced by the coder at the transmitting station. The pseudo-random decoding signal is mixed at the receiving station with the coded signal received from the transmitting station so that the modulated intelligence signal may be recovered. The recovered modulated intelligence signal is then introduced to an appropriate detector which enables the intelligence to be recovered.

The present invention is related to a coded communication system similar to the system disclosed in the copending application Ser. No. 735,089 discussed above. The present invention, however, in one of its aspects is more particularly concerned with the control of the transmitting and receiving stations in such a system so that correlation may be achieved, and maintained, between the pseudo-random coding signals developed at the transmitting station and the coding signals developed at the receiving station. In the system of the present invention, such correlation is achieved and maintained in an automatic, rapid and efficient manner.

The coded communication system to be described in predicated upon a principle known as "noise correlation modulation". In accordance with this principle, narrow-band signal information is modulated by the pseudo-random coding signal described above and which exhibits wide-band characteristics. This coding causes a low amplitude transmission to be obtained, the presence of which is extremely difficult to detect by an unauthorized receiver.

This technique of noise correlation modulation causes the energy of the transmitted signal to be spread over a wide frequency range so that the radio frequency energy per unit band width is greatly diminished as compared with narrow-band transmission. Because the transmitted energy is so spread over a wide band and appears as noise, the transmitted signal has a composition which renders it most difficult for an unauthorized receiver to detect and demodulate it or even to be aware of its actual existence. The system of the invention, in the embodiment to be described, includes one or more receiving stations which each include a pseudo-random decoding signal generator, which generator serves to produce a pseudo-random decoding signal which is identical to the coding signal used at the transmitter.

The pseudo-random decoding signal source at each receiving station in the coded communication system of the invention is synchronized with the psuedo-random coding signal source at the transmitting station in a manner to be described. In accordance with the embodiment of the present invention, which will be described, such correlation or synchronization is achieved by first causing the transmitting station to transmit a coded signal which is coded in accordance with a "short code". This "short code" repeats itself after a relatively short time interval so that it is a relatively simple matter for the decoding signal source at an authorized receiving station to achieve correlation with the short-code coding signal. After such correlation is achieved, the transmitting station shifts over to long-code operation. During long-code operation, the transmitted coded intelligence signal is coded in accordance with a pseudo-random coding signal which does not repeat itself until an extremely long period of time has elapsed. However, since the receiver is brought into step with the transmitter during the short-code operation, and since it falls out of step by a very slight amount during the changeover to long-code operation, re-correlation for the long-code may be achieved by a relatively simple searching sequence. This will be described in detail in the subsequent specification.

Another feature of the invention is the provision of a coded communcation system which exhibits a high degree of message privacy. The pseudo-random code generator at the transmitting station of the coded communcation system of the invention, and the identical pseudo-random decoding generators at the different receiving stations in the system, have been constructed in accordance with the concepts of the invention, as will be described, to provide such a degree of message security that unauthorized reception is rendered virtually impossible even with automatic equipment. The coding and modulation of the system of the present invention permits a receiving station which is properly correlated with the transmitting station to receive the transmitted intelligence, while an uncorrelated receiver at one tenth the range would find it most impossible to detect even the presence of signal energy.

The system of the invention is also advantageous in that it exhibits a high degree of immunity to interfering or jamming signals. The system also exhibits high quality and fidelity characteristics for the transmission of speech. Another feature of the invention is that it may be conceived to permit the use of reliable and relatively simple circuitry in both the transmitting and receiving sections of each station. The system to be described also incorporates an ancillary capability, and that is the ability to measure range between any two stations constructed to include apparatus embodying the concepts of the invention.

Other features and advantages of the invention will become evident from a consideration of the following drawings in which:

FIG. 1 is a schematic representation of a coded communication system of the type disclosed in the copending application Ser. No. 735,089, referred to above, the illustrated representation showing in block form the various components which make up the transmitting and receiving stations of a typical station in the system described in that application and this illustration serving as a convenient means for describing the principles upon which the present communication system is predicated:

Figure 3:
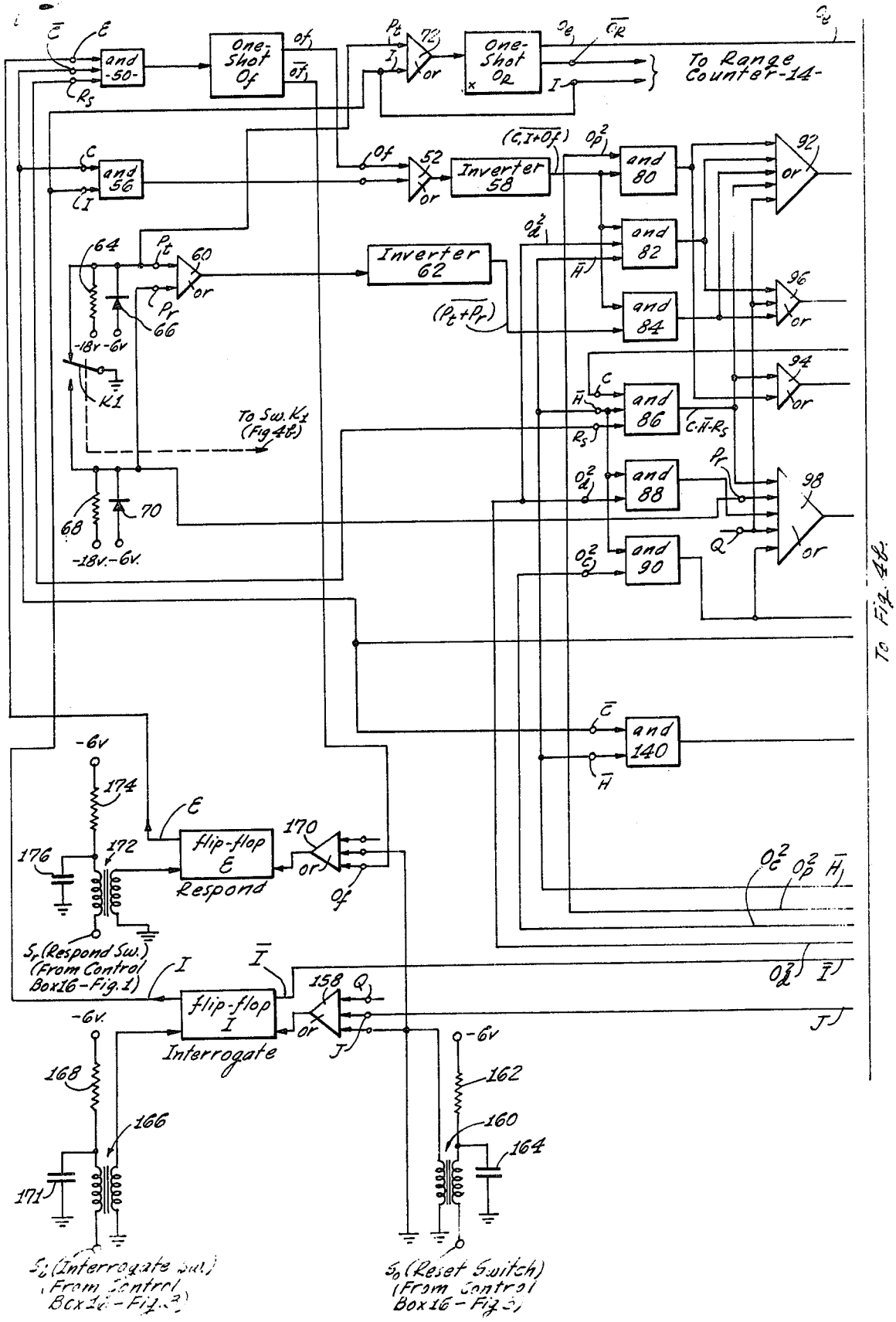
FIG. 3 is a block diagram illustrative of the components which are incorporated into a typical transmitting-receiving station of the system of the present invention and which is capable of carrying out the different control forms and other objectives of the present invention.
Figure 5:
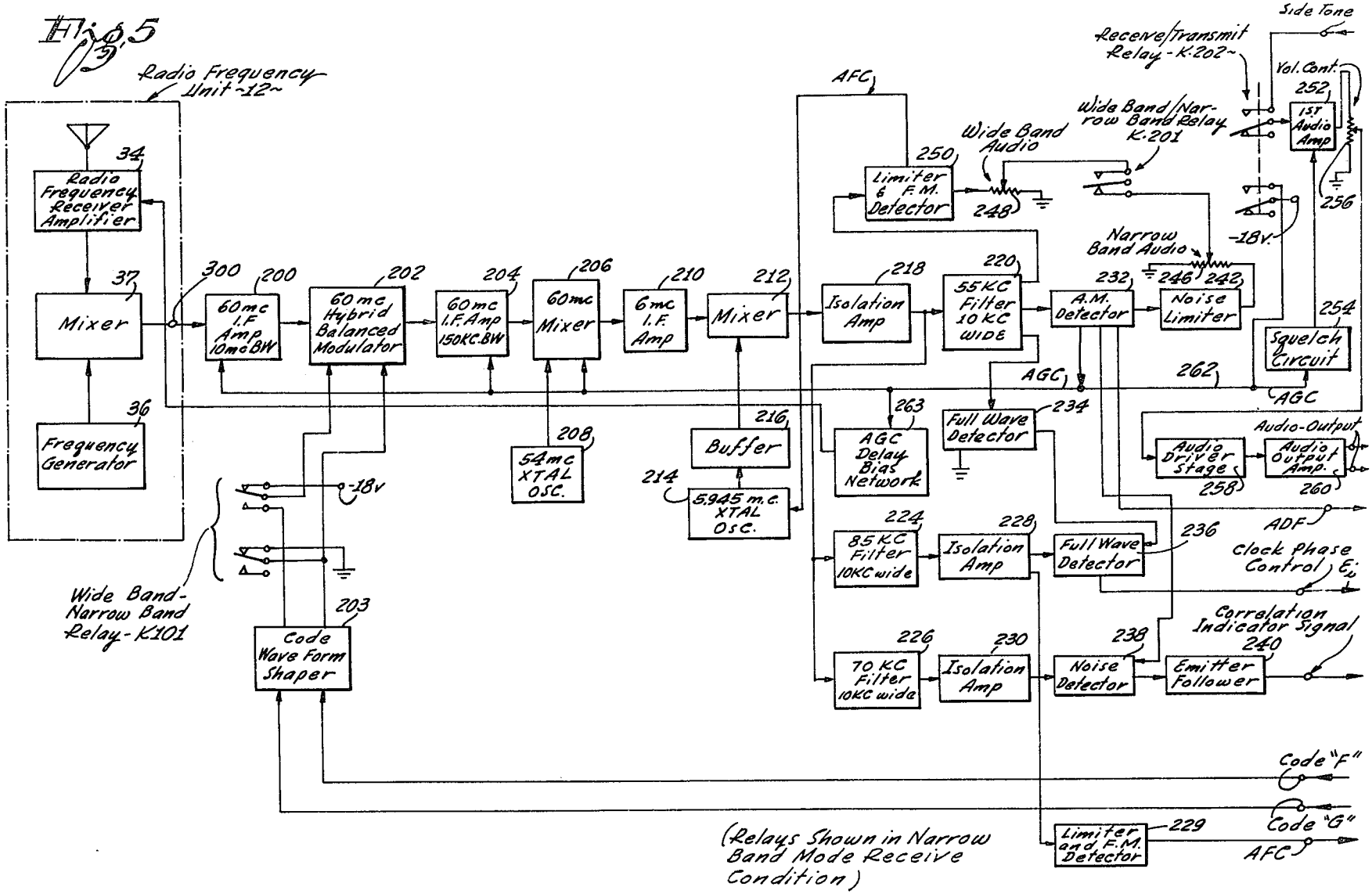
Figure 6:
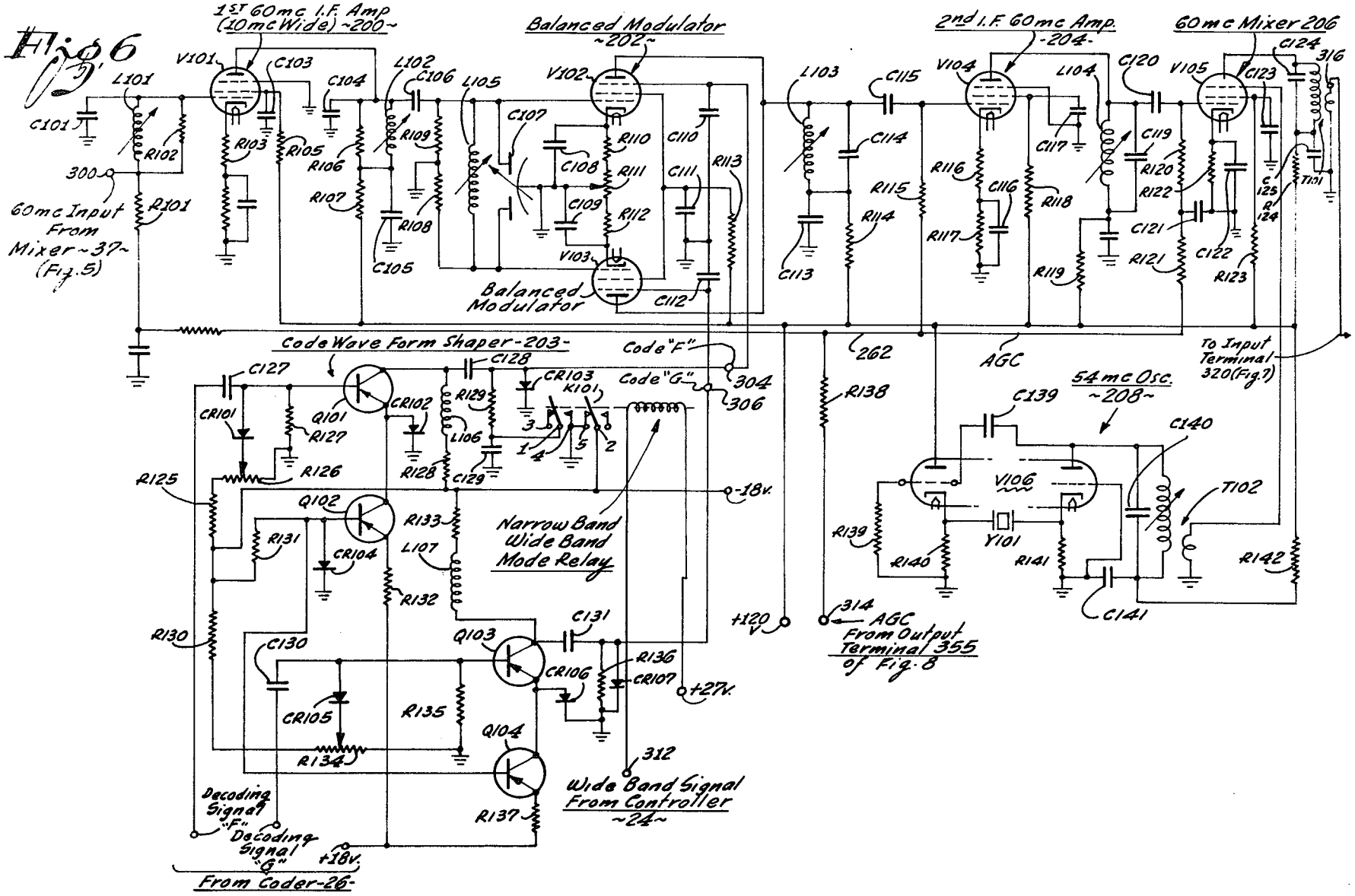
Figure 7:
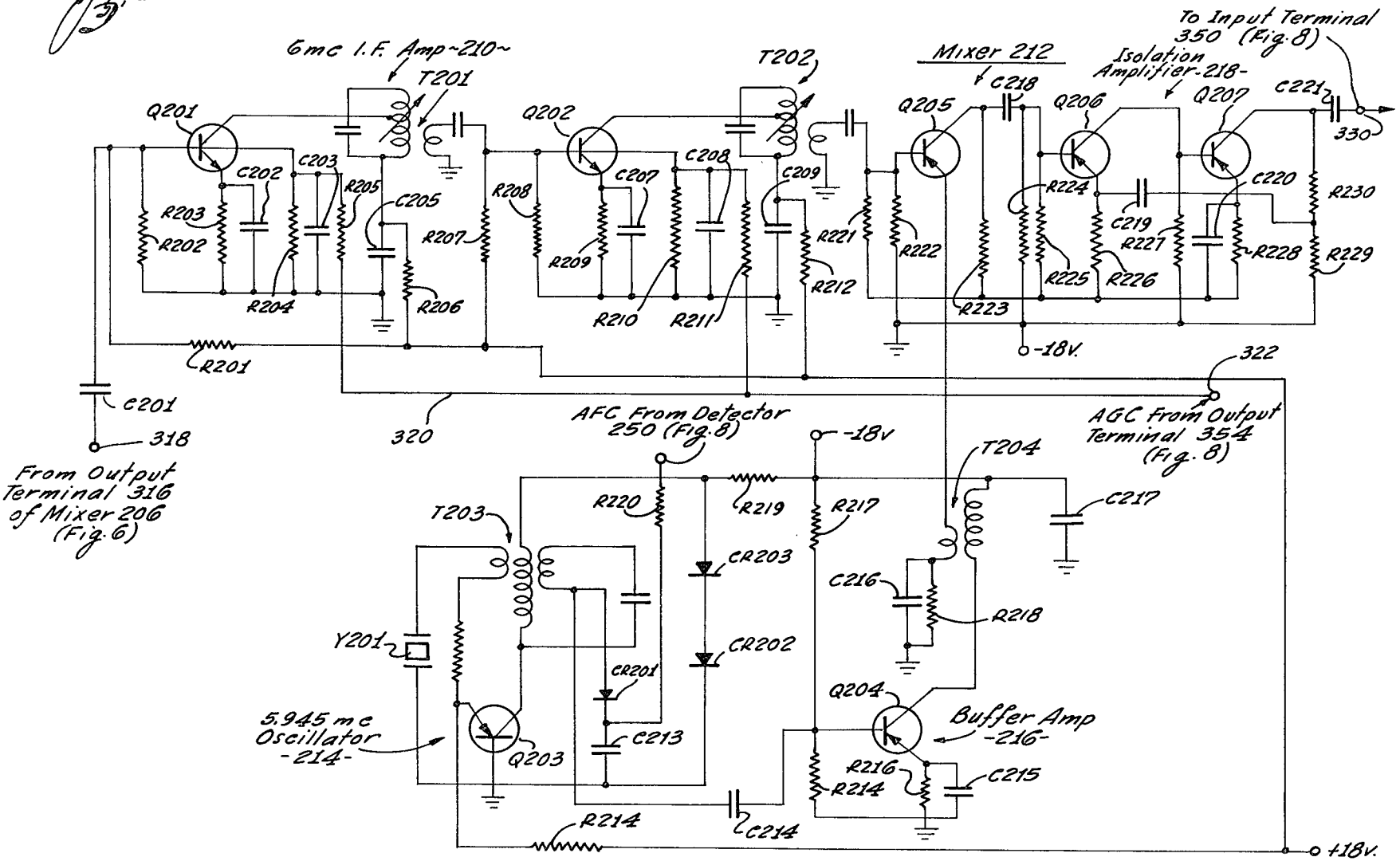
Figure 8:
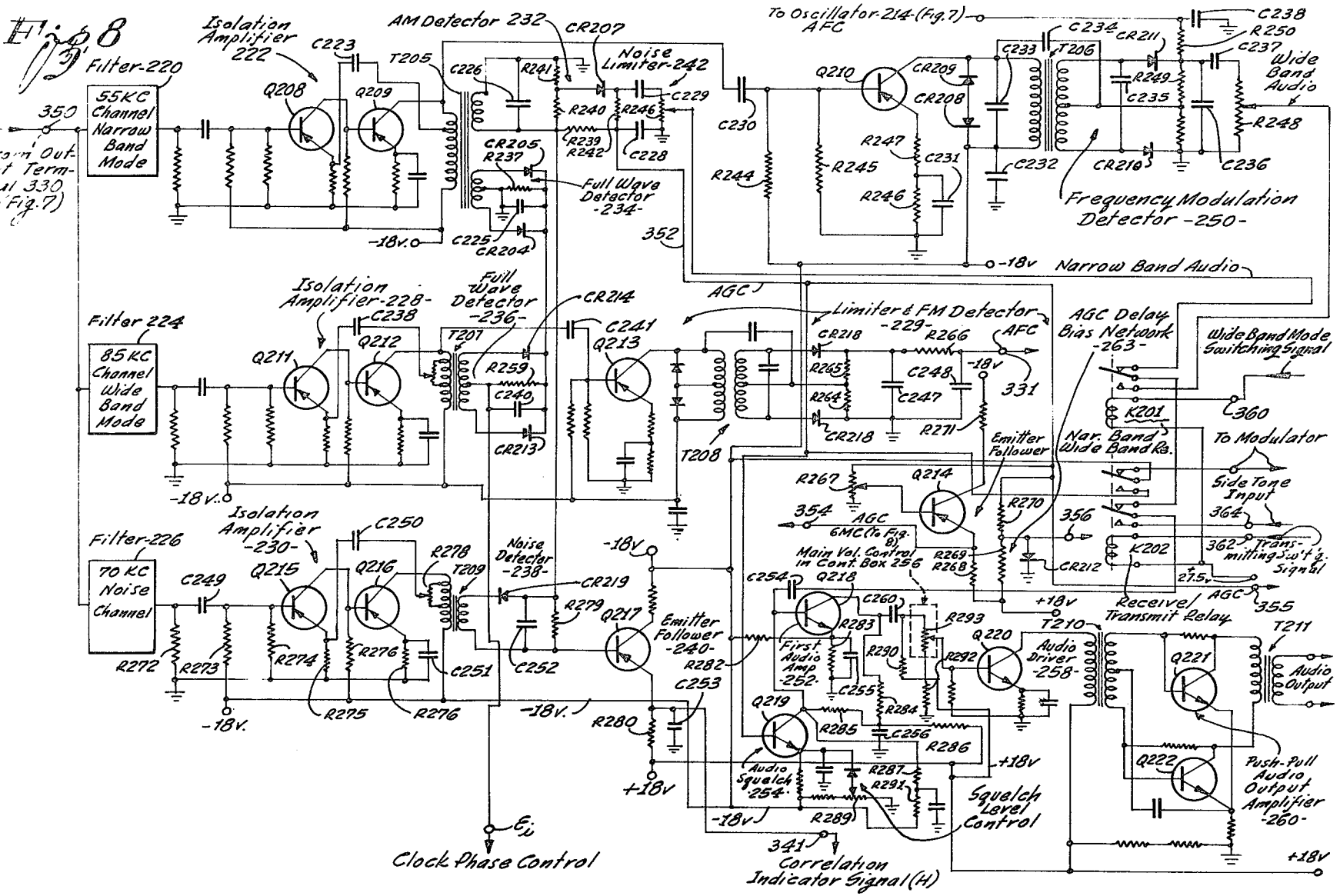
Figure 9:
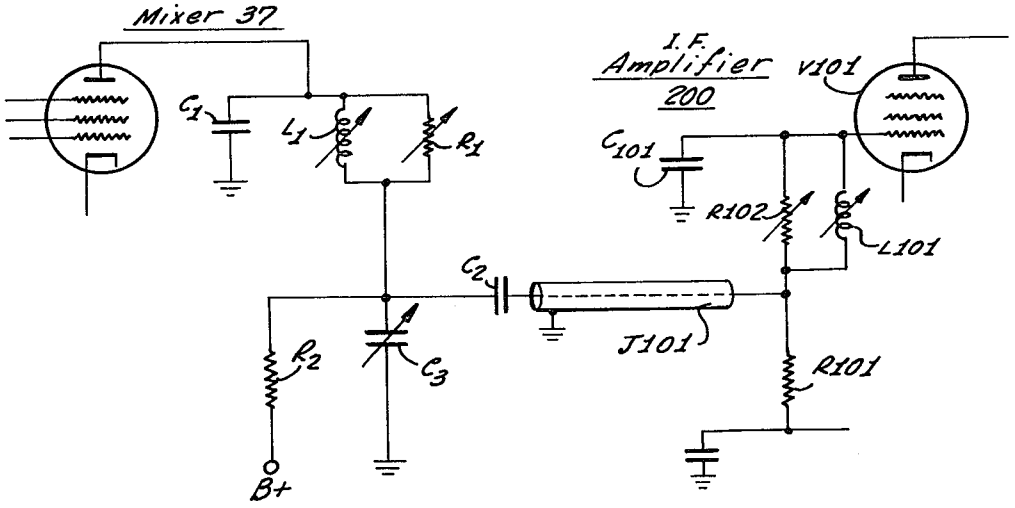
Figure 11:
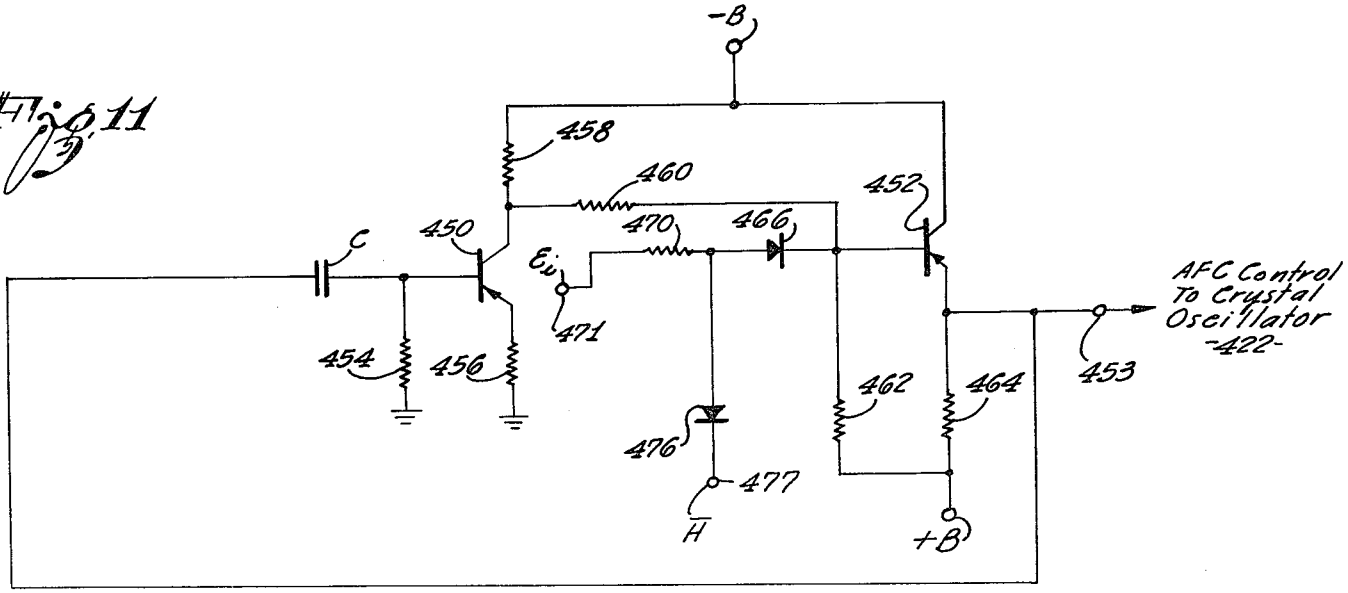
Figure 10:
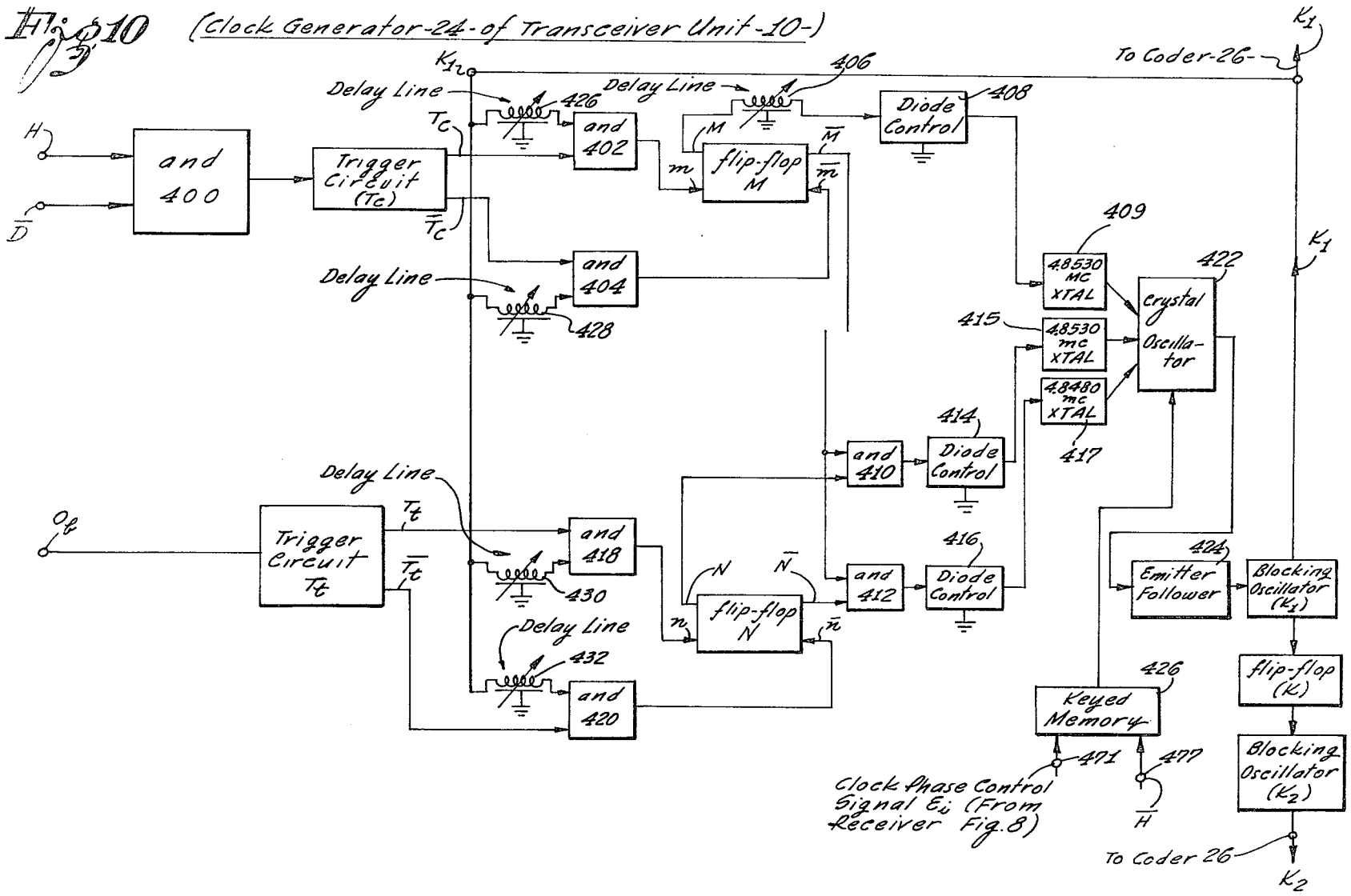
Figure 12:
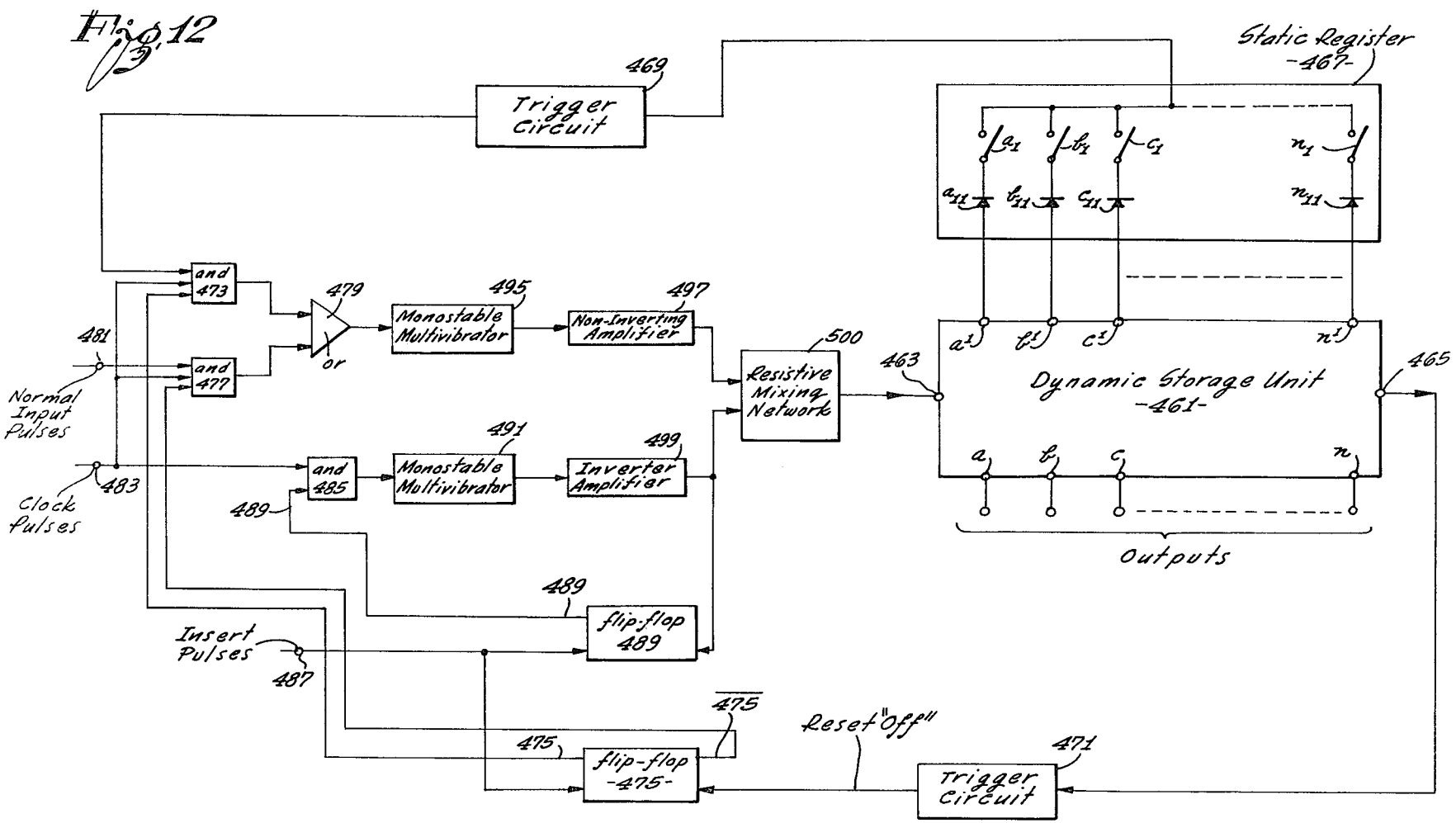
Figure 13:
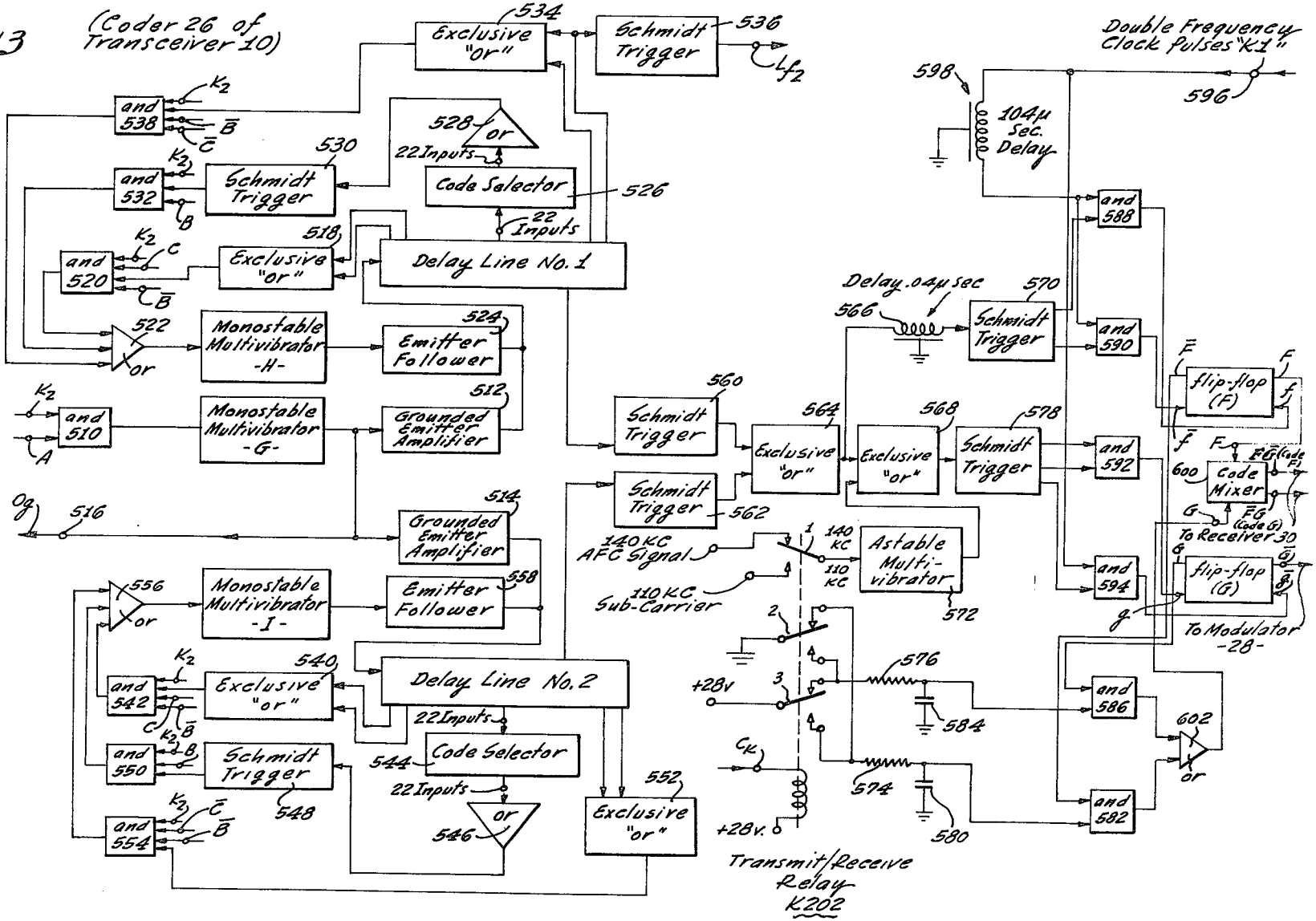
Figure 18:
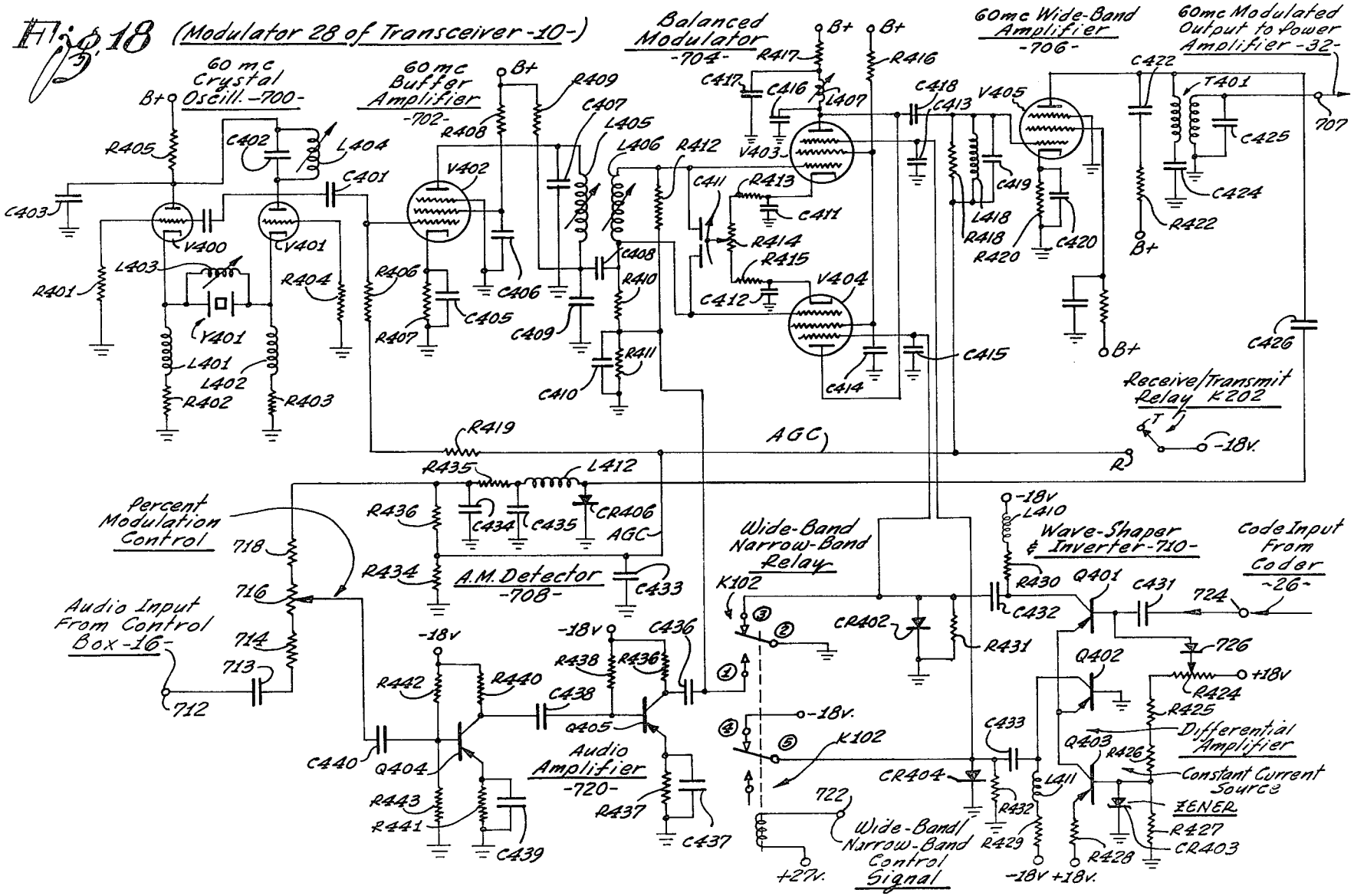
Figure 23A:
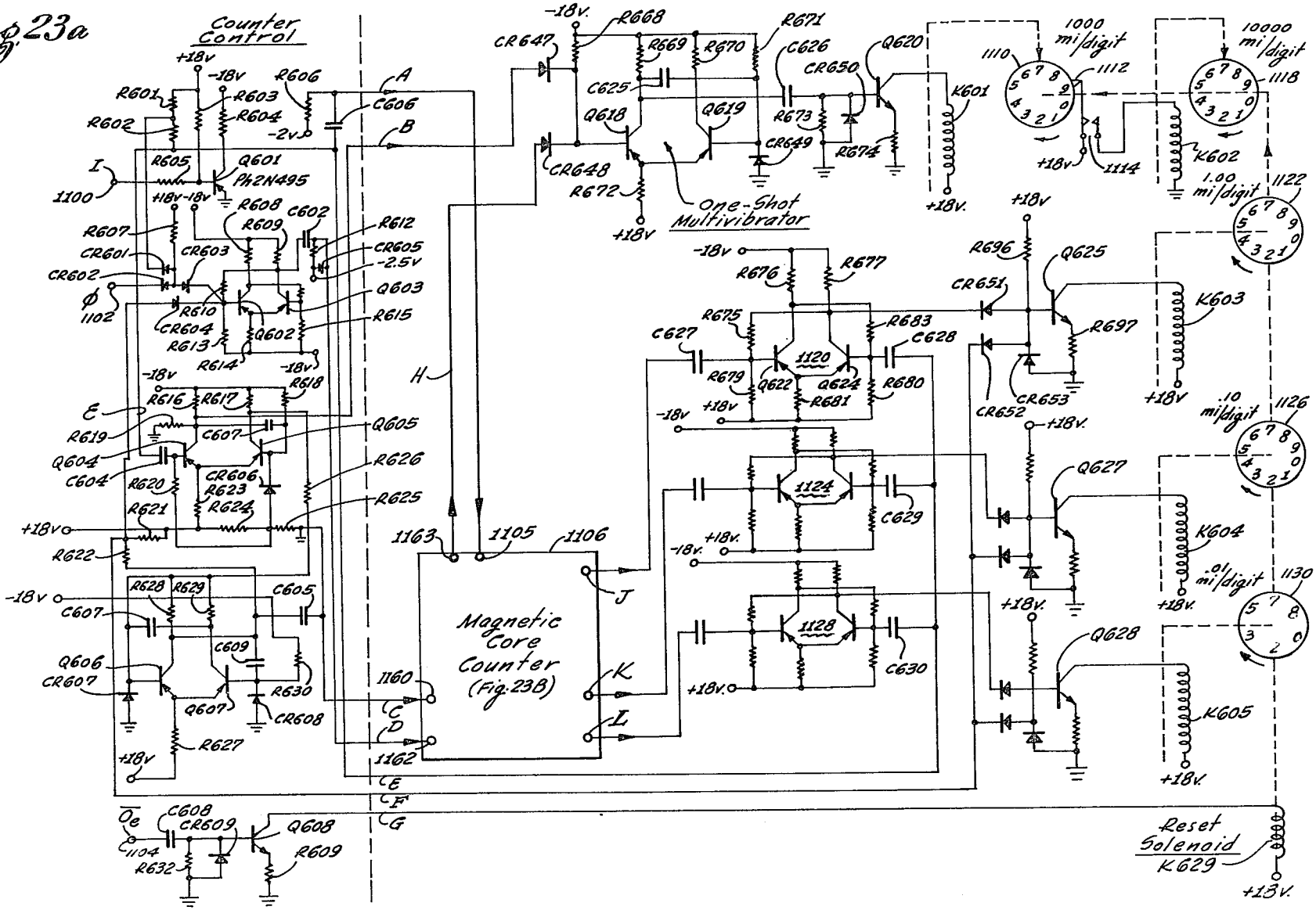
Figure 23B:
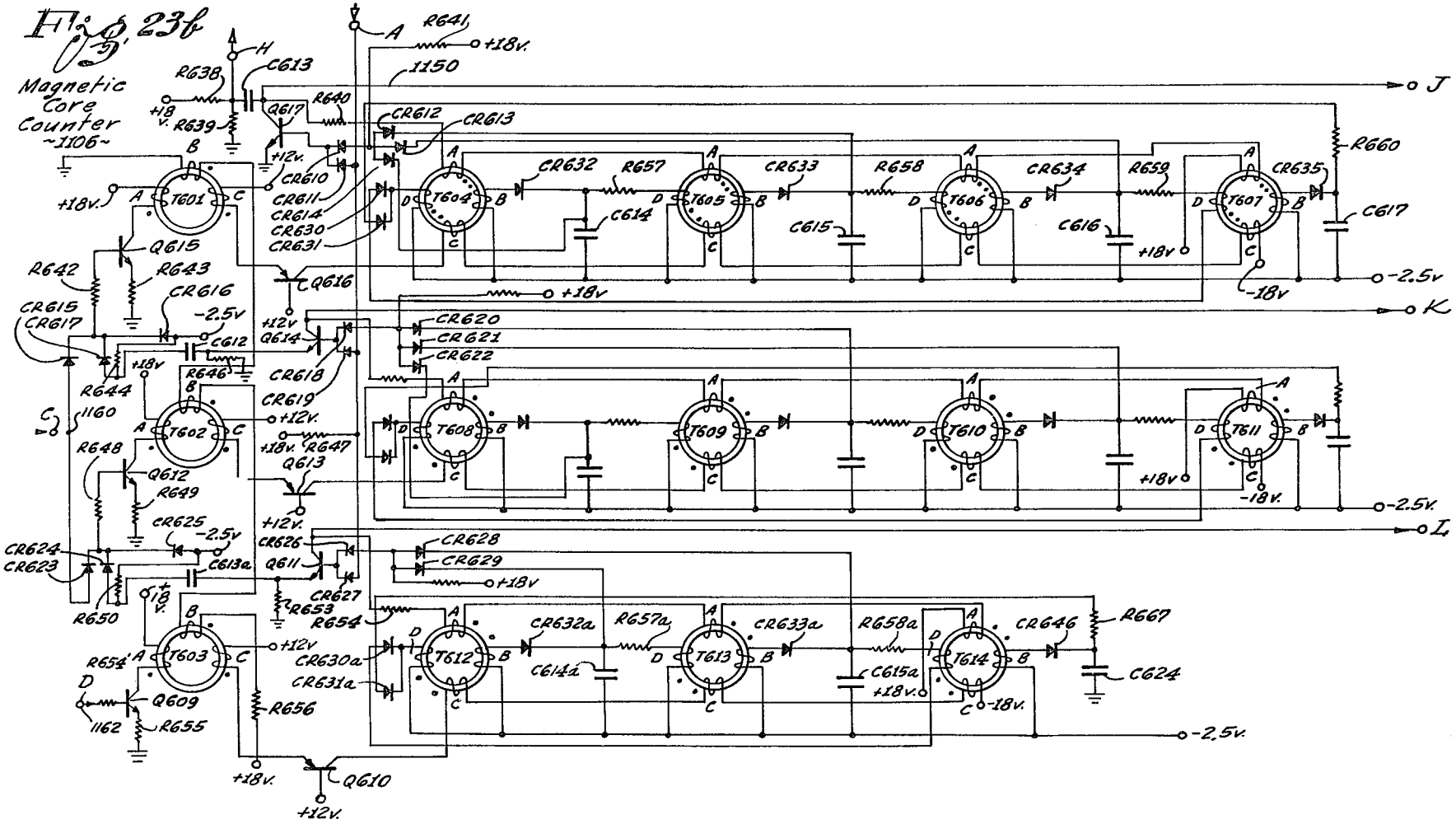

FIGS. 4*a* and 4*b* constitute a composite logical diagram of a controller which is included in the system of the invention and which constitutes one of the components illustrated in FIG. 3, the controller serving to initiate the different controls which are incorporated into the system;

FIG. 5 is a block diagram of the actual receiver which is incorporated into the receiving section of the station to be described, the illustrated receiver serving to receive, decode and demodulate the coded intelligence signal received from the transmitter;

FIGS. 6, 7 and 8 are circuit diagrams of the various components which are included in the receiver of FIG. 5;

FIG. 9 is a fragmentary circuit diagram illustrating the manner in which a received signal is input into the first station of the receiver circuit;

FIG. 10 is a logical block diagram of a clock generator assembly which is included in the station of 3, the illustrated generator assembly serving to generate clock pulses whose frequency are subject to different controls exerted on the clock generator;

FIG. 11 is a logical block diagram of a coding signal generator, which illustrates the basic means whereby a pseudo-random coding signal, or similar decoding signal, suitable for use in the system of the present invention may be generated;

FIG. 12 is a logical block diagram of the actual coding signal generator utilized in the embodiment of the invention to be discussed;

FIG. 13 is a logical diagram illustrating the different components which make up the order used in the embodiment of the invention to be described and also illustrating the appropriate connections between these components;

FIG. 14 is a circuit diagram of a code mixer circuit which is used in the coder of FIG. 13;

FIG. 15 is a diagram of a receiver decoding stage which includes two balanced modulators in parallel and which is useful in explaining the actual decoding stage used in the embodiment of the invention to be described;

FIG. 16 is a circuit diagram of a hybrid balanced modulator which is used in the receiver of the embodiment of the invention to be described to constitute the decoding stage of the receiver;

FIG. 17 is a block diagram of the modulator unit which is incorporated into the embodiment of the invention to be described;

FIG. 18 is a circuit diagram of the modulator unit shown in block form in FIG. 17;

FIG. 19 is a block diagram of a transmitter power amplifier which may be used as a final amplifier for the transmitting section of a station constructed in accordance with the teachings of the invention;

FIG. 20 is a circuit diagram of a radio frequency amplifier which may be used in the receiver section of the station;

FIG. 21 is a block diagram illustrating a suitable frequency generator for use as a carrier wave generator for the transmitting section of the station and as a local oscillator for the receiving section;

FIG. 22 is a circuit diagram of a frequency multiplier for use in the generator of FIG. 21; and FIGS. 23*a* and 23*b* illustrate the logic circuitry and mechanical indicators and counters which may be incorporated into the system for the performance of the range measuring function.

Figure 1:
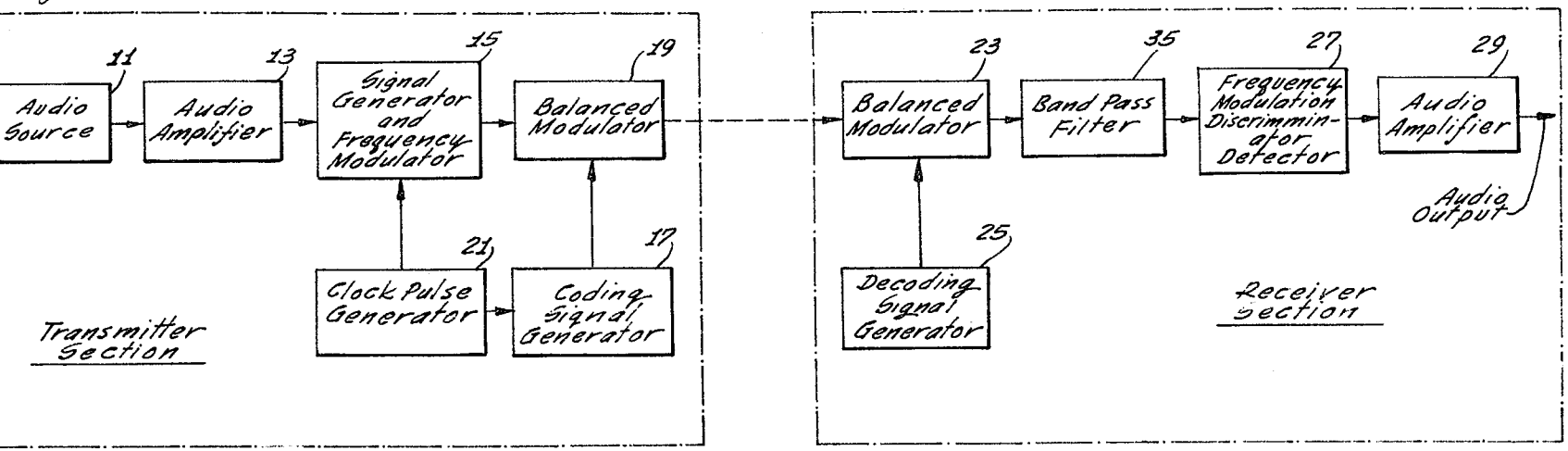

The system illustrated in FIG. 1 is similar to the system disclosed and claimed in copending application Ser. No. 735,089, as indicated above. The system includes a source of intelligence such as an audio source 11. This source may be a microphone, or it may be any other source of voice signal or of other types of intelligence signals to be transmitted by the system. The source 11 may be connected to an amplifier such as an audio amplifier 13 which serves a well-known function of amplifying the audio or intelligence signals. The amplifier 13 is, in turn, connected to a signal generator and frequency modulator 15 so that the amplified intelligence signals from the amplifier may be introduced to the unit 15 to modulate a carrier signal generated by that unit.

The signal generator portion of the unit 15 may, for example, be a frequency modulated since wave oscillator connected to drive a bistable flip-flop circuit. The sine wave generator portion of the unit may, for example, have a center frequency of 25 kilocycles so that the bistable flip-flop circuit will generate a signal having a rectangular wave shape and having a center frequency of 25 kilocycles.

Alternately, the signal generator portion of the unit 15 may be a multivibrator having a natural frequency equal of, for example, 25 kilocycles. The frequency of the multivibrator may be directly controlled by the intelligence signal from the amplifier 13 so that a frequency modulated signal may be directly developed and at any instant be dependent upon the characteristics of the intelligence signal from the amplifier 13.

The signal from the audio amplifier, as noted above, is introduced to the frequency modulator portion of the unit 15 to frequency modulate the rectangular wave carrier signal from the signal generator portion of the unit. The audio amplifier may, for example, change the frequency of the carrier signal from the signal generator portion of the unit by a frequency of $\pm 5$ kilocycles during the frequency modulation process. As previously described, the frequency of the carrier signal at any instant is dependent upon the characteristics of the intelligence signal at that instant, such as the amplitude of the audio signal from the source 11.

The signal generator portion of the unit 15, therefore, generates a rectangular wave carrier signal. This signal exhibits amplitude transitions between two fixed amplitude values and the timing of these transitions changes in accordance with the characteristics of the intelligence signals from the audio amplifier.

When a sine way oscillator and flip-flop circuit are used to constitute the signal generator portion of the unit 15 as suggested above, the signal from the audio amplifier 13 can be used to frequency modulate the output signal of the signal generator by any usual frequency modulator network associated with the sine wave oscillator.

The system shown in FIG. 1 also incudes a coding signal generator 17. This generator produces a coding signal having a rectangular wave shape. This coding signal has amplitude transitions between two fixed amplitude values which are controlled to occur in accordance with a pseudo-random predetermined coding sequence. As indicated above, the pseudo-random nature of this coding sequence is actually in accordance with a definite pattern and is repetitive so as to facilitate the production of similar decoding signals at the receiving station.

The coding signal generator 17 may be similar to the generator described in a report by Neal Zierler entitled "*Several Binary-Sequence Generators*", Massachusetts Institute of Technology, Lincoln Laboratories Technical Report No. 95. The coding signal generator 16 may also be constructed in a manner similar to that disclosed in copending application Ser. No. 714,459 filed Feb. 6, 1958, in the name of Joseph G. Gleason, or in copending application Ser. No. 750,591 filed Feb. 2, 1959 in the name of Robert J. Grady.

The signals from the coding signal generator 17 are introduced to a balanced modulator 19 and the frequency modulated carrier signal from the signal generator and frequency modulator 15 is also introduced to the balanced modulator 19. The balanced modulator functions to invert the coding signal from the generator 17 in response to the frequency modulator signal from the unit 15. Thus, the coded intelligence signal produced at the output terminal of the balanced modulator 19 is a signal having a rectangular wave shape as illustrated in the curve D of FIG. 2 and having certain amplitude transitions from one of its fixed amplitudes to the other. These amplitude transitions result in part from inversions of the coding signal from the generator 17, the coding signal being shown in the curve B of FIG. 2. The amplitude transitions in the coded intelligence signal also results in part from the amplitude transitions in the modulated intelligence signal from the frequency modulator portion of the unit 50, one transition of which is shown in curve C of FIG. 2. The coded intelligence signal from the balanced modulator 19 may be transmitted to the receiving section of a distance station by any known means. For example, the coded intelligence signal from the balanced modulator 19 may be introduced to a suitable radio transmitter for radiation to the distant station.

The system also preferably includes a clock pulse generator 21. This generator, as will be described, produces clock timing pulses which recur at a stabilized and constant repetition frequency, but whose frequency may be controlled for searching purposes. The clock pulses from the generator 21 are introduced to the coding signal generator 17 so that each amplitude transition in the rectangular wave coding signal from that generator will occur in timed coincidence with a corresponding one of the clock pulses. Also, the clock pulses are introduced to the signal generator portion of the unit 15 so that each amplitude transition in the modulated intelligence signal from the unit 15 will also occur in timed coincidence with one of the clock pulses. The frequency of the clock pulse generator is relatively high with respect to the frequency of the amplitude transitions of the modulated intelligence signal from the unit 15 so that the control exerted by the clock pulses on that signal will not shift the transitions sufficiently to cause notable distortion in the modulated intelligence signal produced by the unit 15 or in the coded intelligence signal produced by the balanced modulator 19.

Figure 2:
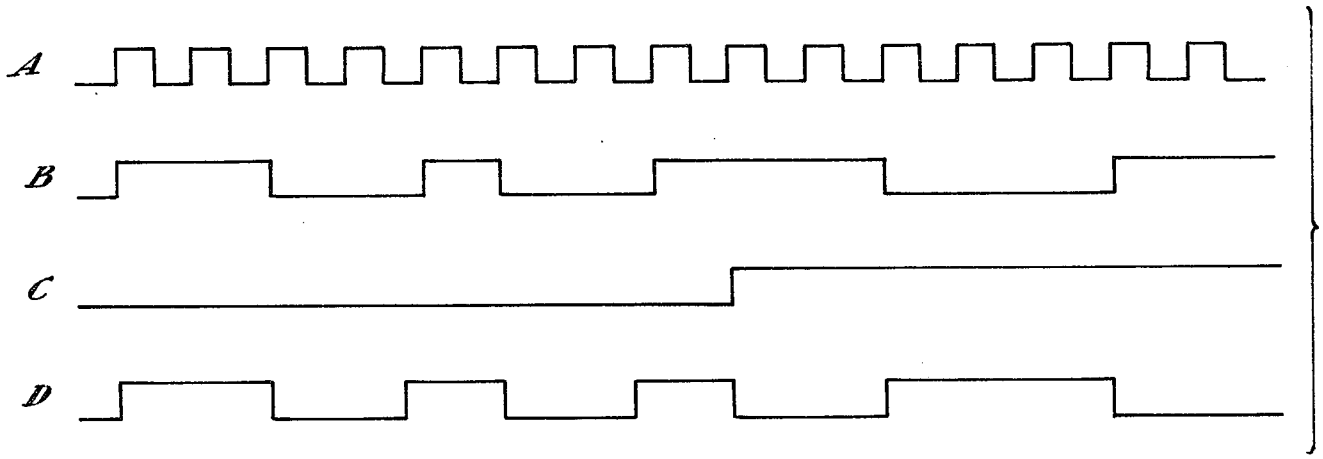
FIG. 2 shows a plurality of curves illustrating the various wave forms developed in the transmitting section of the system illustrated in FIG. 1, these curves being useful in explaining the operation of the system of FIG. 1 and in explaining the purpose and function of the different components making up that system.

The sequence of clock timing pulses from the generator is shown in the curve A of FIG. 2. The coding signal from the generator 17 is shown in the curve B of FIG. 2, and that signal may be provided with a rectangular wave shape as shown. The amplitude transition of the coding signal shown in the curve B of FIG. 2 is in accordance with the pseudo-random coding sequence described above. The amplitude transition of the coding signal shown in the curve B of FIG. 2 is also controlled by the clock pulses from the generator 21, so that each amplitude transition occurs in timed coincidence with the leading edge of a clock pulse.

The modulated intelligence signal produced by the unit 15 is shown in the curve C of FIG. 2. This modulated signal also has a binary rectangular wave shape in the illustrated embodiment. The times of occurrence of the amplitude transitions in the modulated intelligence signal shown in curve C of FIG. 2 are controlled by the intelligence signal from the audio amplifier 13 in the manner described.

The intelligence signal from the audio amplifier 13 is therefore caused to frequency modulate a carrier signal from the signal generator portion of the unit 15. The resultant modulated intelligence signal at the output of the unit 15 may be suitably shaped by any known network to have negligible amplitude modulation. As shown in the curve D of FIG. 2, the coding signal from the generator 17 is passed without inversion by the balanced modulator 19, when the amplitude of the modulated intelligence signal from the unit 15 is in one of its two binary states. Alternately, the balanced modulator 19 operates to invert the amplitude of the coding signal from the generator 17 when the amplitude of the signal from the unit 15 is in its second binary state. The resulting coded intelligence signal produced at the output of the balanced modulator 19 is shown in the curve D in FIG. 2.

The use of the clock pulses of the curve A to control the operation of both the coding signal generator 17 and the signal generator portion of the unit 15 assures that all amplitude transitions involved in the production of the coded intelligence signal (shown in curve D of FIG. 2) will occur with the same basic timing. Therefore, it is virtually impossible for the coded intelligence signal to be analyzed at an unauthorized station and a distinction to be made between the amplitude transitions in the modulated intelligence signal and in the coding signal itself.

The receiver section of the distant station includes a balanced modulator 23 which may be similar to the balanced modulator 19 at the transmitter. The receiver section also includes a decoding signal generator 25. As noted previously, this decoding signal generator generates a pseudo-random decoding signal which has a rectangular wave-shape in which amplitude transitions occur in the same coding sequence as those of the coding signal from the coding signal generator 17 at the transmitter section. The balanced modulator 23 at the receiver, which serves as the decoder, may be connected to a band-pass filter 35 which, in turn, is connected to a frequency modulation discriminator-detector 27. The discriminator-detector 27, in turn, is connected to an amplifier 29 from which the intelligence may be recovered. The decoding signal introduced by the generator 25 to the balanced modulator 23 causes the balanced modulator to re-invert the coded intelligence signal from the transmitter at the precise points at which it was inverted at the transmitter by the coding signal generator 17. Therefore, the balanced modulator 23 develops an output signal similar to the signal shown in the curve C of FIG. 2.

The output signal from the balanced modulator 23 has a rectangular wave-shape and exhibits amplitude transitions at the same frequency as the amplitude transitions of the frequency modulated signal from the signal generator and frequency modulator 15. The frequency modulates signal from the balanced modulator 23 is passed by the band-pass filter 35 to the frequency discriminator-detector 27. The frequency discriminator-detector 27 produces an intelligence signal which duplicates the signal originating at the audio source 11 in the transmitter. This intelligence signal is amplified in the amplifier 29, and the intelligence represented by it is recovered by any suitable transducer (not shown) such as a loud speaker.

The filter 35 may be a narrow band, pass-band filter of known inductance-capacity type. This filter serves to pass the modulated side bands of this signal from the balanced modulator 23 to the discriminator-detector 27. However, the filter 35 discriminates against the background noise signals having a relatively wide frequency band outside the frequency range of the modulated intelligence signal.

The use of the balanced modulator 23 and the band-pass filter 35 provide certain advantages. This is because the production of the modulated intelligence signal and the combination of this signal with the coding signal to produce the coded intelligence signal increases the bandwidth of the transmitted signal. This results from the fact that the coding signal has a wide band width of the order, for example, of 1 megacycle. Since the energy level represented by the coded transmitted intelligence is now distributed over a band width of at least one megacycle, the energy level of the intelligence in the coded intelligence signal is considerably decreased in comparison to the energy level of the intelligence itself. Actually, the energy level of the intelligence in the coded intelligence signal may be below the noise level in the atmosphere. This means that an unauthorized receiver has difficulty in detecting even the actual presence of the coded intelligence signal.

The balanced modulator 23 at the receiver reduces the band width of the received signal from one megacycle to a band width of, for example, 10 kilocycles at a center frequency of, for example, 25 kilocycles. The filter 35 then serves to filter signals having frequencies below 20 kilocycles over and above 30 kilocycles. The signal passed by the filter 35 now has sufficient amplitude over its spectrum, with respect to the residual noise signals translated by the filter, so that the intelligence signal may be detected in the discriminator 27 and its intelligence recovered at the output of the amplifier 29.

In the system of the present invention to be described, and as noted above, two separate pseudo-random coding signals are used. One of these is termed the "short code" and, as described, that code sequence repeats itself after a relatively short time interval. At the beginning of each transmission, the short code is first transmitted from a transmitting station to a receiving station. This permits the decoding signal generator at the receiving station to be brought into correlation with the coding signal generator at the transmitter in a relatively short time interval, as will be described.

When correlation has been achieved in the short code mode, the transmitting station then changes to the long code mode of operation. The long code, as described above, repeats itself only after an extremely long time interval. This long code is, therefore, advantageous from a security standpoint, but it is difficult for a receiver to achieve correlation with such a long code without the initial short code correlation step. The changeover from short code to long code by the transmitter is indicated to the receiver by a particular signal which is transmitted from the transmitting station to the receiving station just before the changeover is made. At the moment that the changeover is made at the transmitting station, the decoding signal generator at the receiver is first speeded up and then slowed down until correlation with the coding signal generator at the transmitter is again achieved. When such correlation is achieved, the decoding signal generator at the receiving station is held in a locked-on condition with the received coded intelligence signal, this being obtained in a manner to be described.

The correlation sequence described above permits correlation in the long code mode to be achieved in a relatively short time interval. This is because such a sequence enables the receiver to start producing the pseudo-random long code decoding signal at approximately the same time that the transmitter starts producing the pseudo-random long code coding signal. Therefore, the displacement between the long-code coding signal generated at the transmitter and the long-code decoding signal generated at the receiver is relatively small. It is, therefore, possible to achieve full correlation at the receiver between the received coded intelligence signal and the locally generated decoding signal in a relatively short time interval, and by a relatively simple searching sequence as will be described.

A transmitting-receiving station constructed in accordance with the present invention is illustrated in FIG. 3. This station includes a transceiver unit 10, a radio frequency unit 12, a range control 14 and a control box 16. An intercommunication set 18 and a direction finder 20 are coupled to the control box 16.

The transceiver unit 10 includes a controller 22, a clock generator 24, a coder 26, a modulator 28 and a receiver 30. The controller 22 controls the clock generator 24 to obtain correlation or synchronization in the system in a manner to be described. The controller also starts an initial code injection into the coder 26 for the short code and also for the long code, as will be described. The controller also determines whether the coder 26 is to produce the short code or the long code. As will be explained, the controller 22 also causes the coder 26 to generate a decoding signal for the receiver 30 for side tone reception when the station is in its transmitting mode and for normal reception when the station is in its receiving mode. The side tone reception enables the station to monitor the coded intelligence being transmitted to the distance receiver. In addition, the controller 22 controls certain components of the radio frequency unit 12 and certain components of the transceiver 10 to control the transmit and receive modes of operation of the system.

The clock generator 24 provides clock pulses for the coder 26 and for the range counter 14. The coder 26 introduces the pseudo-random coding signal to the modulator 28 when the station is in its transmit mode; and it provides the pseudo-random decoding signal in a delayed and in an undelayed state to the receiver 30, for reasons to be described, when the station is in its receive mode. The modulator 28 introduces audio signals to the coder 26 to produce the coded intelligence signal for wide band transmission. The modulator 28 produces a 60 megacycle uncoded amplitude modulated signal, and this signal is applied to a radio frequency transmitter power amplifier 32 in the radio frequency unit 12 for narrow band transmission; and the modulator 28 also produces a 60 megacycle balanced modulated coded intelligence signal, and the latter signal is applied to the power amplifier 32 for wide band transmission.

The receiver 30 demodulates the 60 megacycle coded intelligence signal received from a distant station and introduced to a radio frequency receiver amplifier 34 in the radio frequency unit 12. The receiver 30 provides an audio signal for the intercommunication set 18 by way of the control box 16, and it also provides a correlation signal to the controller 22 and a phase correction signal to the clock generator 24.

The radio frequency unit 12 includes the radio frequency transmitter power amplifier 32 and the radio frequency amplifier 34, referred to above. The radio frequency unit 12 also includes a frequency generator 36. An antenna 38 is connected to the armature of a relay 40. When the relay 40 is de-energized, the antenna 38 is connected to the receiver amplifier 34. However, when the relay 40 is energized by a "transmit" signal (Ck) from the controller 22, it causes the antenna 38 to be connected to the transmitter power amplifier 32. One of the fixed contacts of the relay 40 is connected to the transmitter power amplifier 32, and another of the fixed contacts of that ralay is connected to the radio frequency amplifier 34.

The transmitter power amplifier 32 mixes the modulated signal from the modulator 28 with a radio frequency signal from the frequency generator 36 and amplifies the resulting signal for transmission purposes from the antenna 38. The frequency and the power level of the transmitted signal are selected at the control box 16.

The radio frequency receiver amplifier 34 amplifies the coded intelligence signal from a distant station which is intercepted by the antenna 38, and this amplifier converts that signal to a frequency centered around 60 megacycles. The frequency generator 36 serves as a local oscillator for both the transmitter power amplifier 32 and the radio frequency receiver amplifier 34.

The range counter 14 counts the clock pulses necessary for the system to be re-correlated after having once transmitted and then received a signal. In this manner and as will be described in detail, the range counter generates a display of the range between the two particular stations between which such communication is carried out.

The control box 16 provides means for selecting wide band or narrow band transmission and reception, for selecting tone transmission, for selecting automatic direction finding operation, and for selecting range measurement interrogation and range measurement response. The control box also provides a means for selecting the frequency of the radio frequency channel (as noted above), a "code-of-the day" and the radio level of the receiver. The control box also provides a means for destroying a "code-of-the-day" in an emergency.

When the station is in the wide band transmit mode, the apparatus transmits a coded intelligence signal which comprises a radio frequency carrier balanced-modulated with a pseudo-random modulated coding signal and with audio information contained within the modulation of the coding signal in the form of an ultrasonic subcarrier which is frequency-modulated with audio information.

When coded wide band transmission is initiated, the control box 16 conditions the transmitting components of the system, and a control signal is introduced to the controller 22 to initiate the "transmit" sequence within the controller.

The controller first causes the clock oscillator in the clock generator 24 to be established at a predetermined fixed and stabilized frequency of, for example, 4.853 megacycles. This may be achieved by switching the control of the clock oscillator to a suitable crystal which is resonant at the particular frequency. This particular frequency is advantageous in simplifying range measurements, as will become apparent subsequently.

At the same time, the controller 22 causes a short code initial condition pulse to be injected into the coder. This initial condition pulse causes, in a manner to be described, a selected short code to be generated by the coder. After the initial condition selection has been completed, the coder 26 begins to generate the repetitive pseudo-random short code. The short code generation continues for a period of, for example, 0.25 seconds. At the end of that period, the controller 22 introduces a 5 kilocycle audio signal to the modulator 28 for a short interval of, for example, one millisecond. This 5 kilocycle audio signal is transmitted to the receiving station as an indication to the receiving station that the transmitter is about to switch to long code operation.

The controller 22 now causes a long code initial condition pulse to be injected into the coder 26. This latter initial condition pulse causes the selected long code to be generated by the coder, as will be described. After this latter initial condition operation is completed, the coder 26 generates the pseudo-random long code. During the entire interval the transmitter is operating in the short code mode, a 1 kilocycle audio tone is transmitted by the transmitting system. This tone serves as a warning signal to the operator that communication may not be established at that time.

When one of the stations is conditioned to a transmitting mode, in the manner described above, at least one other similar distant station is in a stand-by mode ready to receive the coded intelligence signal from the transmitting station. When the distant station is in the stand-by mode, its coder 26 is generating a selected short code decoding signal which is identical to the short code coding signal generated at the transmitting station. At this time, the clock generator at the distant stand-by station is operating at a frequency of, for example, 4.848 megacycles. This is 5 kilocycles below the clock frequency at the transmitting station during the short code transmission.

There will, therefore, be a displacement in code phase between a coded intelligence signal received from the transmitting station and the locally generated decoding signal at the receiving station. This enables the locally generated decoding signal at the receiving station to assume all possible time relationships with the received coded intelligence signal in a period of 0.2 seconds, and it assures that when a coded intelligence signal is received which is coded by a short-code coding signal, correlation will occur within that time. Should a signal, coded in accordance with a selected short code, be received from the transmitting station while the receiving station is in its stand-by condition, correlation in the short code mode will occur within 0.2 seconds. The receiver 30 at the receiving station then causes its controller 22 to establish its clock generator 24 at the fixed frequency of, for example, 4.853 megacycles, and this is carried out at the instant the short code correlation occurs. This causes the locally generated short code to be synchronized with the received short-code coded intelligence signal and such synchronization is maintained in a manner to be described by appropriate correlation locking circuits in the receiver.

After an interval of, for example, 0.25 seconds and as discussed above, the transmitting station transmits a 5 kilocycle signal to the receiving station to indicate that the transmitting station is about to change from short code to long code transmission. This 5 kilocycle signal is used at the receiving station to cause the controller to insert the long code initial condition into the coder 26. At the same time, the controller at the receiving station causes the clock generator frequency to change so as to initiate a search for synchronism with the long code which is now received from the transmitting station. The control of the clock generator 24 at the receiving station is such that the generator is set first at a frequency of 5 kilocycles above the normal frequency of 4.853 megacycles and then at a lower frequency.

Because of delays inherent in the receiving channels, the phase of the totally generated long code will tend to lag behind the received long code coded intelligence signal. It is, therefore, necessary initially to increase the frequency of the clock generator at the receiving station when the changeover to long-code transmission is made at the transmitting station in order to achieve correlation. A search period of 70 milliseconds at the 5 kilocycle search rate is sufficient to bring the locally generated long code at the receiving station into correlation with the long-code coded intelligence signal received from the transmitting station. Should correlation fail to occur due to fading conditions or other difficulties, the system at the receiving station will make repeated attempts to achieve correlation. This is carried out by following a search sequence of performing a search at a frequency of 5 kilocycles lower than normal clock frequency after a 100 millisecond period of searching the frequency 5 kilocycles above the normal clock frequency.

When long code correlation is achieved between the received coded intelligence signal and the locally generated long code, the clock frequency is returned to its normal value of, for example, 4.853 megacycles, and the clock signal at the receiving station is locked in phase with the received long code coded intelligence signal. By correlation control circuitry to be described, the receiving station is now provided with a locally generated long code which is synchronized with the lone-code coded intelligence signal received from the transmitting station. The receiving station is now able to derive the audio intelligence contained in the coded intelligence signal received from the transmitting station.

Should a break in the transmission occur, either due to fading or a termination of transmission, a keyed memory is energized in the clock generator 24 at the receiver. This memory holds the clock frequency at the value it last had when the break occurred. The reappearance of the signal from the transmitter again causes the clock frequency at the receiver to lock with the received signal, should the former signal reappear within the interval established by the keyed memory.

However, should the signal from the transmitting station fail to reappear after an interval of, for example, 1 second after such a transmission break, the controller 22 causes the clock generator 24 to initiate a search sequence. This does not cause any change in the operation of the coder 26. This controller search will be referred to as "auto search". If the signal from the transmitter should again be received during the search and should long code correlation again be achieved, the controller 22 at the receiving station causes the clock generator 24 again to lock in phase with the coded intelligence signal received from the transmitting station. However, if after a search of 300 milliseconds, correlation has not occurred, the receiving station is automatically set by the controller to its stand-by condition. This latter operation is termed "auto reset".

Range measurements are performed by allowing one station, designated as the "Interrogator" to transmit to a second station designated as the "Responder". When synchronization in long code has been achieved, the responder is placed in the transmit mode without resetting its coder; and the interrogator is placed in receive search mode without resetting its coder. At this instance, the code signals produced at each station are displaced in phase by an amount proportional to the distance between the two stations. It is, therefore, merely necessary for the interrogator to measure the number of cycles of clock displacement necessary to achieve correlation with the responder in order to measure the range between the two stations.

The interrogator will be placed in stand-by condition before the interrogation procedure is begun. Interrogation is initiated by the operator who causes the control box 16 of the interrogator to send a control signal to the controller 22. Upon receipt of this control signal, the controller causes the clock generator 24 to produce the normal clock frequency of, for example, 4.853 megacycles. At the same time, the controller 22 at the interrogator causes the short code initial condition to be inserted into the coder 26 and the short code to be generated. The transmitting section of the interrogator is placed in its transmit mode and the receiving section of the interrogator is conditioned for side tone operation.

In the manner described above, the interrogator transmits the short code for an interval of, for example, 0.25 seconds. At the end of the short code transmission, and in a manner similar to that described previously, the interrogator transmits the 5 kilocycle tone signal to the responder. The interrogator then changes to long code transmission in the described manner.

When the interrogator begins its long code transmission, the 5 kilocycle tone signal is again sent to the responder to produce a side tone signal at the responder. After a period of 0.5 seconds, the controller 22 of the interrogator removes the 5 kilocycle tone signal from the modulator 28 of the interrogator, and it also conditions the interrogator for reception. The clock generator at the interrogator is now placed in its search mode by the controller which sets its frequency 5 kilocycles below normal.

The procedure described above results in a 0.5 second period of wide band transmission in which the audio generator is modulated with a 0.5 kilocycle control tone after the system is in long code operation. The interrogator is now returned to its received condition but the coder 26 continues to produce the long code.

During the operation described above, the controller 22 introduces signals to the range control 14 to reset the range control and to permit a count to be performed. The clock generator 24 compares the search clock frequency with a highly accurate crystal control oscillator running at the normal clock frequency. This provides the range control 14 with a direct indication of clock displacement.

The responder may be in any condition when the respond operation is begun. Respond operation is initiated by a control signal which is sent from the control box 16 to the controller 22. No change in output from the controller occurs at this time, and this permits the responder to be used in the normal communication mode when range measurement is not being made. However, if the responder receives a signal from the interrogator, the short code/long code sequence described above occurs.

When the responder is in long code condition, the 5 kilocycle tone from the interrogator is sent from the receiver 30 of the responder to the controller 22. This causes the controller to set the responder to the transmit mode. Then after a period of, for example, 3 seconds, the controller sets the responder to stand-by condition. The procedure outlined in the preceding paragraph permits the responder as noted to be used in normal communication mode when a range measurement is not being made. When a range measurement is being made, the controller 22 causes the responder to synchronize in long code mode with the interrogator, and then causes the responder to transmit for a 3 second period with no change in the code being generated. This permits the interrogator to synchronize with the transmitting responder and thus obtain a range measurement on the counter 14.

For narrow band uncoded transmission, the radio frequency unit 12 transmits an amplitude modulated carrier over the antenna 38. An amplitude modulated signal for this purpose is obtained from the modulator 28 of the transceiver unit 10. The radio frequency transmitter power amplifier 32 mixes the amplitude modulated signal with the radio frequency signal from the frequency generator 36, and the amplifier 32 linearly amplifies the signal for transmission by the antenna 38.

For narrow band reception, the antenna 38 is connected to the receiver amplifier 34 by the relay 40, and the amplifier 34 supplies the received amplitude modulated signal in amplified form and heterodyned to 60 megacycles by the frequency generator 36 to the receiver 30. The received signal is converted to 6 megacycles in the receiver, then amplified and converted to 55 kilocycles and then it is detected in the usual manner to recover the amplitude modulations.

The logical components which make up the controller 22 are shown in block form in FIGS. 4A and 4B. The controller includes logical circuitry which operates to control the receiver 30, the modulator 28, the coder 26, the clock generator 24 and the range counter 14. The controller provides signals for the receiver to control the side tone circuits. It also introduces signals to the coder to inject the initial conditions into the coder and to determine whether operation is to be in long code or short code. The controller also introduces control signals to the clock generator 24. In addition, the controller sends signals to the range counter 14 to control the coding or range pulses and to reset the range counter.

The controller 22 as shown in FIG. 4A includes an "and" gate 50. This type of gate is well known to the electronic digital computer art, and appropriate circuitry for the gate is also well known. For example, the "and" gate 50 may be constructed in a manner similar to that described and shown on page 32 of "Arithmetic Operations in Digital Computers" by R. K. Richards (published by D. Van Nostrand Company of Princeton, N.J., in 1955). The "and" gate includes a plurality of input terminals at which a corresponding plurality of different terms are introduced. The output terminal from the "and" gate is true only when all the input terminals are true.

The "and" gate 50 is connected to a "one-shot" multivibrator (Of). "One-shot" or "monostable" multivibrators are also well-known to the electronic art. These multivibrators have a stable state and an unstable state. The introduction of an input signal to the multivibrator causes it to be triggered from its stable state to its unstable state. The multivibrator then returns to its stable state after a time interval determined by its internal parameters. One-shot multivibrators such as the multivibrator Of may be constructed in a manner similar to that shown and described on pages 5–52 and 5–53 of "Control Engineers Handbook" published by McGraw-Hill Book Company, Inc., in 1958.

The "one-shot" multivibrator Of is connected to an "or" gate 52 and to an "or" gate 54. This latter type of logic gate is also well known to the electronic digital computer art. The "or" gate has a plurality of input terminals to which a corresponding plurality of input terms are introduced. The "or" gate produces an output term which is true if any of the input terms are true. The "or" gates 52 and 54 may also be constructed in a manner similar to that described and shown on page 32 of "Arithmetic Operations in Digital Computers" by R. K. Richards.

A plurality of terms E, $\overline{C}$ and Rs are introduced to the "and" gate 50. These terms, like others to be described, are derived from multivibrators which are respectively designated by the same letters. The unbarred terms are derived from the "true" output terminals of their corresponding multivibrators, and the barred terms are derived from the "false" output terminals. The "true" output terminal of each multivibrator appears near the upper left corner of the box designating the multivibrator, and the "false" output terminal of each multivibrator appears near the upper right corner of the box designating the multivibrator. In like manner, the "true" and "false" input terminals to each multivibrator respectively appear near the lower left and right corners of the box designating the multivibrator.

The terms $\overline{C}$ and I are introduced to an "and" gate 56, and this "and" gate is connected to the "or" gate 52. The "or" gate 52 is connected to an inverter 58 of any suitable construction. The output term of the inverter is true when its input term is false, and vice versa. The input term $(\overline{C}\cdot I+Of)$ is introduced to the inverter 58, and it produces the term $(\overline{C\cdot I+Of})$ in response to the input term.

A "transmit" term (Pt) and a "receive" term (Pr) are introduced to an "or" gate 60, and the "or" gate 60 is connected to an inverter 62. The transmit term (Pt) is derived from a network including the grounded armature and a normally-closed fixed contact of a transmit-receive relay K1. The fixed contact is connected to a resistor 64, to the cathode of a clamping diode 66 and to the "or" gate 60. The resistor 64 is connected to the negative terminal of a source of direct voltage having a value, for example, of 18 volts. The anode of the diode 66 is connected to the negative terminal of a source of direct voltage having a value, for example, of 6 volts.

A group of signals (Rj), (Rh) and (Ra) from the receiver 30 of FIG. 1 are introduced to a corresponding plurality of trigger circuits (J), (H) and (R3) respectively. A filter 150 receives the signal (Ra), this filter being connected to the cathode of a diode 152. The anode of the diode 152 is connected to the trigger circuit (Rs) and to a grounded resistor 154. The resistor 154 is shunted by a capacitor 156. The trigger circuit (J) introduces the term (J) to an "or" gate 158 and to the "false" input terminal of the flip-flop (D). The trigger circuit (H) supplies the term (H) to the clock generator 24 of FIG. 3, and it supplies the term $(\overline{H})$ to the "and" gates 82, 86 and 140. The trigger circuit (Rs) supplies the term (Rs) to the "and" gates 50 and 86.

The "or" gate 158 also receives the term (Q). This "and" gate is connected to the "false" input terminal of the flip-flop (I). The secondary winding of a transformer 160 is also connected to the "or" gate 158 and to ground. The primary of that transformer receives the reset switch term (So) from the control box 16 of FIG. 3. The primary is also connected to a resistor 162 and to a grounded capacitor 164. The resistor 162 is connected to the negative terminal of a 6 volt direct voltage source.

The secondary of a transformer 166 is connected to ground and to the "false" input terminal of the flip-flop (I). The primary of the transformer receives the term (Si) from the interrogate switch in the control box 16 of FIG. 1. The primary is also connected to a resistor 168 and to a grounded capacitor 171. The resistor 168 is connected to the negative terminal of the 6 volt direct voltage source. The flip-flop (I) introduces the term (I) to the "and" gates 56 and 72 and to the diode 124 and to the range counter 14 of FIG. 1. The flip-flop (I) introduces the term $(\overline{I})$ to the "and" gate 100 and to the diode 128.

The secondary of the transformer 160 is also connected to an "or" gate 170. The terms $(\overline{of})$ and (Q) are also introduced to the "or" gate 170. The "or" gate 170 is connected to the "false" input terminal of the flip-flop (E). The secondary of a transformer 172 is connected to ground and to the "true" input terminal of the flip-flop (E). The term (Sr) from the "respond" switch in the control box 16 of FIG. 1 is introduced to the primary of the transformer 172. The primary is also connected to a resistor 174 and to a grounded capacitor 176. The resistor 174 is connected to the negative terminal of the 6 volt direct voltage source. The flip-flop (E) supplies the term (E) to the "and" gate 50.

The receive term (Pr) is derived from a network including the grounded armature and a normally open fixed contact of the transmit-receive relay K1. This latter fixed contact is connected to a resistor 68, to the cathode of a clamping diode 70, and to the "or" gate 60. The resistor 68 is connected to the negative terminal of a source of direct voltage having a value, for example, of 18 volts. The anode of the diode 70 is connected to the negative terminal of a source of direct voltage having a value, for example, of 6 volts.

The transmit term (Pt) is also introduced to an "or" gate 72, as is the term (I). The "or" gate 72 is connected to a one-shot multivibrator (Oe). The "true" output terminal of the multivibrator (Oe) is connected to the respective anodes of a pair of diodes 74 and 76, and this output terminal is also connected to the "or" gate 54.

The inverter 58 is connected to each of a plurality of "and" gates 80, 82 and 84. The inverter 62 is also connected to the "and" gate 84, and it supplies the term $(\overline{Pt}+\overline{Pr})$ to that "and" gate. A term $(Od^2)$ is also introduced to the "and" gate 82, as is a term $(\overline{H})$. A term $(Op^2)$ is applied to the "and" gate 80.

The circuitry of FIG. 2 also includes a plurality of "and" gates 86, 88 and 90. A group of terms (C, $\overline{H}$ and Rs) are introduced to the "and" gate 86; a pair of terms $(\overline{H})$ and $(Od^2)$ are applied to the "and" gate 88; and a pair of terms (H) and $(Oc^2)$ are applied to the "and" gate 90.

The "and" gate 80 is connected to an "or" gate 92 and to an "or" gate 94. The "and" gate 82 is connected to an "or" gate 96 and to the "or" gate 92. The "and" gate 84 is connected to the "or" gates 92 and 96. The "and" gate 86 introduces the term $(C\cdot\overline{H}\cdot Rs)$ to the "or" gate 92 and to an "or" gate 98. The "and" gate 88 is also connected to the "or" gate 98, as is the "and" gate 90. The term (Q) is applied to the "or" gates 92, 96 and 98, and the term (Pr) is applied to the "or" gate 98.

The "and" gate 90 is further connected to a "one-shot" multivibrator (Od) which, in turn, is connected to a blocking oscillator ($Od^2$). Blocking oscillators are believed to be sufficiently well known to the electronic art so as to preclude the need for a detailed description in the present specification. The blocking oscillator introduces the term ($Od^2$) to the "and" gates 82 and 88.

The "or" gate 92 is connected to the true input terminal of a flip-flop (A) and to the true terminal of a flip-flop (B). Flip-flop multivibrators are well known to the electronic digital computer art. These units are bi-stable networks, and are triggerable between a "false" state and a "true" state by input terms respectively introduced to their "false" input terminals and their "true" input terminals. When in the "true" state the flip-flop develops a true term at its "true" output terminals. When in a "false" state, the flip-flop develops a true term at its "false" output terminals.

The flip-flop (A) develops the term (A) at its "true" output terminals, and it develops the term ($\overline{A}$) at its "false" output terminals. The flip-flop (B) develops the term (B) at its "true" output terminals, and it develops the term ($\overline{B}$) at its "false" output terminals.

The "or" gate 96 is connected to the "true" input terminal of the flip-flop (C), and the "or" gate 94 is connected to the "false" input terminal of that flip-flop. The flip-flop (C) develops the term (C) at its "true" output terminals, and it develops the term ($\overline{C}$) at its "false" output terminals.

A pair of terms (Og) and ($Lf_2$) derived from the coder 26 are introduced to the false input terminals of the flip-flops (A) and (B) respectively. The terms A, $\overline{A}$, B, $\overline{B}$, C and $\overline{C}$ are all introduced to the coder 26 of FIG. 1, as described above.

The "or" gate 98 is connected to a "one-shot" multivibrator (Ob) and to the "true" input terminal of the flip-flop (D). A term (J) is applied to the "false" input terminal of the flip-flop (D). The multivibrator (Ob) supplies the term (Ob) to an "and" gate. A term ($\overline{I}$) is also introduced to that "and" gate. The "and" gate 100 develops an output term ($V=\overline{I}\cdot Ob$). The terms (V) and (Ob) are introduced to the clock generator 24 of FIG. 1, as described above. The flip-flop (D) develops the term ($\overline{D}$) which also is applied to the clock generator 24 of FIG. 1, as described above.

A 5-kilocycle oscillator 102 develops an output signal (A5), and a 1 kilocycle oscillator 104 develops an output signal (A1). The output signal A5 is introduced to the anode of a diode 106 and to the anode of a diode 108. The output signal (A1), on the other hand, is connected to a pair of normally open contacts of a tone relay (K2), and to the anode of a diode 110. The normally open contacts also connect to the cathode of a diode 112.

The anode of the diode 112, and the anode of each of a plurality of diodes 114, 116 and 118, are connected to a resistor 120 and to an output terminal designated (Ax). The resistor is connected to the positive terminal of the 18 volt direct voltage source, and the output terminal supplies the term (Ax) to the modulator 28 of FIG. 1.

The term ($\overline{C}$) is introduced to the anode of a diode 122. The cathodes of the diodes 74, 108, 122 and 114, and the cathode of a diode 124, are connected to a resistor 126. This resistor is connected to the negative terminal of the 18 volt direct voltage source. The term ($\overline{I}$) is applied to the anode of the diode 124. The term (I) is introduced to the anode of a diode 128. The cathodes of the diodes 118, 128, 110 and 76 are all connected to a resistor 130. The resistor 130 is connected to the negative terminal of the 18 volt direct voltage source.

The term (Op) is applied to the anode of a diode 132, and the term (C) is applied to the anode of a diode 134. The cathodes of the diodes 106, 116, 132 and 134 are all connected to a resistor 136. The resistor 136 is connected to the negative terminal of the 18 volt direct voltage source.

The transmit relay also controls a second pair of normally open contacts (K1). These latter contacts are connected to ground and to an output terminal (CK). The output terminal supplies the term (CK) to the clock generator 24, the receiver 30, the modulator 28, the coder 26, the relay 40 and the power amplifier 32 of FIG. 3. The energizing coil of the transmit relay (K1) is connected to the negative terminal of the 18 volt direct voltage source and to the output terminal of an amplifier 138. The "or" gate 54 introduces its output term to the amplifier 138. The amplifier 138 also has its input terminals connected to a further pair of normally open grounded contacts of the relay K2. The term (Ms) from the "push-to-talk" switch in the control box 16 of FIG. 1 is also introduced to the amplifier 138.

The terms ($\overline{C}$) and ($\overline{H}$) are introduced to an "and" gate 140. This "and" gate is connected to a one-shot multivibrator Oc which, in turn, is connected to a block oscillator ($Oc^2$). The blocking oscillator supplies the term ($Oc^2$) to the "and" gate 90.

The term (Pt) is applied to a one-shot multivibrator (Oa). The multivibrator (Oa) is connected to a one-shot multivibrator (Op) which, in turn, is connected to a blocking oscillator ($Op^2$). The blocking oscillator introduces the term ($Op^2$) to the "and" gate 80. The one-shot multivibrator (Op) introduces the term (Op) to the anode of the diode 132.

When a transmission is initiated by the operator, the transmitter section of the station is activated and the signal (Ms) is sent to the controller 22 from the control box 16 (FIG. 3) to initiate the transmit sequence within the controller. The controller now sends two signals (H+D) to the clock generator to set the clock frequency at 4.853 megacycles. At the same time, the controller sends 3 signals (A, B and C) to the coder 26 to cause the coder to generate the short code. The coder sends the signal (Og) to the controller to indicate the receipt of the above signals, and it subsequently introduces the signal ($Lf_2$) to the controller to indicate that it has started to generate the short code.

During the above interval, a 1 kilocycle tone (Ax) from the oscillator 104 is transmitted to the receiving station as a coded modulation to tell the operator at the receiving station to wait for the long code before he establishes communication. Then, at the end of 0.25 seconds, the 5 kilocycle tone from the oscillator 102 is transmitted to the receiving station to indicate that the transmitter is about to change to long code operation.

To initiate the long code transmission, the controller sends the signals (A, B and $\overline{C}$) to the coder. Again the coder responds, first by introducing the signal (Og) to the controller and then by introducing the signal ($Lf_2$) to the controller.

For the receiving station to be in stand-by mode with its coder generating the short code and with its clock operating at 4.848 megacycles, it is necessary that the signals $\overline{B}$ or $\overline{C}$ from the controller in the receiving station be introduced to its coder, and also that the signal $\overline{H}$ from its controller be introduced to its clock generator.

When the coded intelligence signal is received from the transmitting station, and when correlation has been achieved, the signal (Rh) is sent from the receiver to the controller in the receiving station. This signal has a rise time, for example, of about 70 microseconds but it has a signal-to-noise ratio no better than that of the received signal. The signal (Rj) is also sent from the receiver to the controller in the receiving station. The latter signal has a rise time of approximately 700 microseconds and it correspondingly has a signal-to-noise ratio which is 10 decibels greater than that of the received signal.

The controller processes the two signals (Rh) (Rj) to provide the signals H and $\overline{D}$, and to introduce the latter signals to the clock generator at the receiving station to return the clock generator to a 4.853 megacycle. The signal (H) is derived in the controller from the signal (Rh), and thus has a delay of less than 70 microseconds. The signal (H) provides a means for rapidly returning the clock to its normal frequency. The signal ($\overline{D}$) is initiated in the controller by the signal (Rj), and the signal ($\overline{D}$) has a delay of less than 700 microseconds.

The 5 kilocycle signal which was originally transmitted for 1 millisecond by the transmitting station is sent from the receiver to the controller in the receiving station as the signal (Ra). The controller in the receiving station uses the signal (Ra), together with loss of the signal (Rh), to produce the signals (A, B and $\overline{C}$) for the coder in the receiving station, as the transmitting station changes over to the long code mode. As described above, these signals cause the coder in the receiving station to generate the long code at the same time the controller at the receiving station sends the signals (B) and (Ob) to the clock generator to cause the clock generator to search. As noted above, the signal (Ob) appears for a 100 millisecond period, causing the clock generator to search first at a frequency of 5 kilocycles higher than normal. The clock generator then searches at a frequency 5 kilocycles lower than normal upon the termination of the signal (Ob).

When correlation occurs between the long code generated at the transmitting station and the long code generated at the receiving station, the receiver at the receiving station immediately sends the signal (Rh) and (Rj) to its controller. As described above, these signals are processed in the controller at the receiving station to provide signals (H) and ($\overline{D}$) and to introduce the latter signals to the clock generator. These latter signals serve to return the clock generator immediately to its normal frequency of 4.853 megacycles.

Should a break in the transmission occur, the signal (Rj) is no longer sent from the receiver to the controller in the receiving station, and this causes the controller to introduce the signal ($\overline{H}$) to the clock generator. The clock uses the signal ($\overline{H}$) to energize a keyed memory. The reappearance of the signal (Rj) from the receiver at the receiving station within a particular time interval, such as 1 second, causes the controller to remove the signal ($\overline{H}$) from the clock generator to return the clock generator to its normal clocked control, as will be described. However, should the signal (Rj) fail to appear within 1 second, the keyed memory causes the clock generator to initiate a search sequence of the type described above. After the signal (Rj) again reappears from the receiver in the receiving station during the search period, indicating that correlation has been reachieved, the controller sends the signals (H and $\overline{D}$) to the clock generator causing it to return to its normal frequency and to be locked in phase with the received coded intelligence signal.

Range interrogation is initiated by actuating an interrogate switch at the control box 16 to cause the signal (Si) to be sent from the control box to the controller 22 to the interrogating station, and by actuating a respond switch at the responder to produce the term (Sr). Upon the receipt of this signal, the controller sends the signal (Ck) to the clock generator 24 so that normal clock frequency may be produced. At the same time, the controller sends the signals A, B, C and $C_k$ to the coder to cause it to produce the short code and to place the coder in the transmit mode. The signal ($C_k$) is also sent to activate the transmitting section of the station and to place the receiving station in side tone operation mode. When the interrogator changes to long code operation, the signal (Ax) is sent to the respond station to produce the side tone signal.

After a period of 0.5 seconds, the controller at the interrogator removes the signal (Ax) from the modulator and removes the signal ($C_k$) from the other components so as to place the interrogator in a receive condition. The signal ($\overline{H}$) is now sent to the clock generator to cause it to search at a frequency of 5 kilocycles below normal. During the entire operation, the signals (I) and ($\overline{Oe}$) are sent from the interrogator to the range counter to reset the range counter and to permit a count to be performed.

A respond switch in the control box of the responder station is actuated to produce the respond signal (Sr). After the signal (Sr) has occurred and the responder receives a signal from the interrogator, the short code/long code sequence occurs in the manner explained above. When the system is in long code operation, the 5 kilocycle tone is transmitted from the interrogator and this causes the controller at the responder to produce the signal ($C_k$) so that the responder may be set to its transmit mode for the reasons described above.

Should either the respond switch (Sr) or the interrogate switch (Si) be depressed in error, the controller can be reset by depressing the reset switch (So). This causes the signal (So) to be introduced from the control box to the controller so that the controller may be reset.

Reception by the interrogator of a correlated signal from the responder causes the signals (Rh) and (Rj) to be produced by the receiver in the interrogator. The controller of the interrogator uses these signals to apply the signal (I) to the range counter, and this latter operation causes the range counter to indicate the distance between the interrogator and the responder.

The three flip-flops A, B and C in FIG. 4B develop the coder control terms A, $\overline{A}$, B, $\overline{B}$, C and $\overline{C}$ referred to above. It will be remembered that when the flip-flops A, B and C are true, the initial condition for short code may be injected into the coder. After the initial condition selector pulse has been inserted into the coder, the coder sends the signal (Og) to the controller which sets the flip-flop A false. After the initial condition selection has been completed the coder sends the signal ($Lf_2$) to the controllr which sets the flip-flop B false. The same conditions obtain for conditioning the coder for long code except that the flip-flop C is set false, so that the term $\overline{C}$ is true, as noted above.

The flip-flop A is set true by the same trigger which sets the flip-flop B ture. The expression for the trigger which sets the flip-flop A and B true may be summarized as follows:

$$a=b=\overline{H}\cdot O_d^2\overline{(\overline{C}\cdot I+Of)}+(P_t+P_r)\overline{(\overline{C}\cdot I+Of)}=O_p^{2}\cdot\overline{(\overline{C}\cdot I+Of)}+C\cdot\overline{H}\cdot R_5+Q \quad (1)$$

the second expression may be transformed to $(P_t+P_r)$ $[\overline{Of}(\overline{I}+C)]$ (2)

The term (Pt) may be considered as a negative going pulse which occurs at a changeover from the "receive" to the "transmit" condition of the station, and the term (Pr) may be considered a negative going pulse which occurs at a changeover from a "transmit" to a "receive" condition of the station. These pulses are generated by the relay K under the control of the microphone push-to-talk switch. Therefore, the flip-flops A and B are set true each time the microphone switch is opened or closed providing the expression $[\overline{Of}\ (I+C)]$ is true. In the latter expression, the term $(\overline{Of})$ is true only if the station is not responding to a range interrogation. The term $(\overline{I})$ is true only if the station is not interrigating. Also, the term (C) is true only if the station is not generating short code.

The first expression in equation (1) namely, $$\overline{H}\cdot O_d^2\ \overline{(\overline{C}\cdot I+Of)}$$

will now be considered. This expression can be transformed to $$\overline{H}\cdot O_d^2\ [\overline{O}_f(\overline{I}+C] \quad (2A)$$

Therefore, the expression $(\overline{H}\cdot O_d^2)$ can set the flip-flops A and B true under the same conditions as the term (Pt+Pr) considered above. The term (H) is derived from the trigger network $\overline{H}$ and it is true whenever the term (Rj) from the receiver is introduced to the trigger network (H) to indicate a loss of correlation at a receiving station with the coded intelligence signal from the transmitting station. The term $(O_d^2)$ is a timing term and it serves to render the expression $(\overline{H}\cdot O_d^2)$ true only when the loss in communication is more than a particular interval of, for example 1.3 seconds.

It should be pointed out at this time that the superscript notation $(^2)$ in the present description refers to the generation by blocking oscillator (or similar circuit) of a negative pulse from a positive going signal. The blocking oscillator output pulse is "late" or "second", the first pulse being a negative going signal which necessarily precedes the positive going signal. In the preceding paragraph, therefore, the $(\overline{H}\cdot O_d^2)$ expression, generated as loss of communication $(\overline{O}h)$ is still present when the blocking oscillator pulse $Od^2$ is generated at the end of the 1.3 second Od period.

There are three remaining sets of conditions as set forth in the remaining expression of equation (1), which serve to trigger the flip-flops A and B true. The third expression of equation (1) for example, may be transformed to $$O_p^2[\overline{O}_f(\overline{I}+C)] \quad (3)$$

This is the "changeover" expression from short code to long code when the station is transmitting, and which occurs a predetermined period after the station has been in the short code mode of operation. The duration of this period is determined by the term $(O_p^2)$, and when this term appears it causes the controller to introduce the long code initial condition terms A, B and $\overline{C}$. The term $(O_p^2)$ also causes the 5 kilocycle signal to be transmitted as described to the receiving station for a short interval to inform the receiving station that a changeover is about to occur at the transmitting station.

The $(O_p^2)$ term sets the flip-flops A and B true and this term also sets the flip-flop C false. This is provided that the receiving station is not responding to a range interrogation $(\overline{O}f)$ and is not interrogating itself $(\overline{I})$.

The fourth expression of equation (1) is $$C\cdot\overline{H}\cdot R_5$$

This expression causes the receiving station to inject the long code initial condition into its coder when in the receiving mode and upon the receipt of the 5 kilocycle warning signal (R5) from the transmitting station. Again to inject the long code initial condition into the coder, the flip-flops A and B are triggered true and the flip-flop C is triggered false. For such an operation to occur in response to the term $C\cdot\overline{H}\cdot R_5$ the station must presently be in short code mode (C), correlation must have been lost (H) due to the transmitter switching over to long code, and the 5 kilocycle signal (R5) must have been produced.

The last term (Q) in equation (1) is generated by a relay circuit (not shown). This term is a negative going pulse which is generated when the set is first turned on. The purpose of the term (Q) is to assure that the flip-flops A and B will both be triggered true at the outset. This pulse assures that the station will be in its normal receiving stand-by condition in the short code mode of operation when it is first turned on.

As noted above, the flip-flop A is set false by the signal (Og) from the coder and the flip-flop B is set false by the signal $(Lf^2)$ from the coder. The development of these signals will be described in detail in the subsequent description of the coder.

It will be remembered that upon a changeover from the short code mode of operation to the long code mode, the receiving station introduces the signal (D) to its clock generator to cause the clock generator to enter the search mode of operation and a signal (Ob) having a one millisecond period is also introduced to the clock generator to cause the clock generator to search at a frequency which is 5 kilocycles higher than normal and then at a frequency of 5 kilocycles lower than normal. The signal (D) is developed when the flip-flop D is triggered true and the signal (Ob) is developed by triggering the one-shot trigger circuit (Ob).

The terms controlling the flip-flops D and the one-shot trigger circuit (Ob) may be set out in the following equation:

$$d=O_b=(\overline{H}\cdot O_d^2)+(\overline{H}\cdot O_c^2)+Q+Pr+C\cdot\overline{H}\cdot R_5 \quad (4)$$

All of the terms except $H\cdot Oc^2$ have been discussed above and the same conditions which caused the flip-flops A and B to be set true, cause the flip-flop D to be set true and cause the one-shot trigger circuit (Ob) to be triggered.

The term $H\cdot Oc^2$ is true when correlation is lost $(\overline{H})$ and when the received coded intelligence signal is in long code. The pulse $Oc^2$ is a negative going blocking oscillator output pulse marking the end of the 1 second memory period which was initiated by the triggering of the one-shot trigger circuit (Oc). The one-shot trigger circuit (Oc) is triggered by the term $\overline{C}.\overline{H}$ when the receiving station is receiving the coded intelligence signal in the long code mode and correlation is lost. Such an occurrence causes the receiving station to search in the manner described previously above.

The range measuring logic which controls the functions of "respond" and "interrogate" includes the flip-flops E and I. When the respond switch at the control box is operative, the signal (Sr) sets the flip-flop E true. On the other hand, when the interrogate switch at the control box is operative, the signal (Si) sets the flip-flop I true. The flip-flop E is set false by the expression $$\bar{e}=Q+\bar{O}f+So$$

The term (Q) is the power reset, described above which sets the components of the system to particular states when the system is first turned on. The term (So) is a reset term which is true when the reset switch in the control box is operated. The term (Of) is derived from the one-shot trigger circuit (Of), this trigger circuit being triggered by the term $E.\overline{C}r^5$ upon the receipt of the 5 kilocycle tone signal from the interrogating station.

When an operator wishes to respond to an interrogation request, he depresses the respond switch on the control box of his station and thereby sets the flip-flop E true. Later, when the interrogation automatic transmission is received, the response sequence from short code to long code is carried out in a manner to be explained in detail. The 5 kilocycle signal is received by the responder at the time that the code changes so that R5 is true. The negative going signal $\overline{C}$ supplies the trigger signal to the one-shot trigger circuit (Of).

When the term (Of) is true, the transmit relay K1 is energized through the "or" gate 54 and through the amplifier 138. This relay remains energized for a period of 3 seconds. Then, when the one-shot trigger circuit (Of) reverts to its stable state, the negative going ($\overline{Of}$) signal sets the flip-flop E false. When the transmit relay K1 is so energized, the respond station is set to its transmit mode in accordance with the ranging sequence explained above.

The interrogate flip-flop (I) is set false by the expression Q+J+So. The Q and So signals have been discussed above. The J signal appears when correlation occurs with the responding signal and this ends the ranging sequence, as described above.

The (I) and ($\overline{Oe}$) signals are introduced to the range counter to set and stop certain counters included therein. The trigger circuit (Oe) is a one shot having a 0.5 second period. The trigger for the one-shot (Oe) may be expressed by the following expression:

$$O_e=Pt+I$$

The Pt term triggers the one shot (Oe) at the start of each speech transmission to control a gate which generates a 1020 CPS signal for an interval lasting 0.5 seconds. The (I) term also triggers the one shot (Oe) to supply the 5 kilocycle tone for 0.5 seconds to the transmitter audio output (Ax). This latter tone is decoded by the respond receiver to produce the signal R5 to trigger the one shot (Of), as described above.

The signal ($\overline{I}$) is used in the "and" gate 100 to inhibit the (Ob) signal to the clock generator 24 when the term ($\overline{I}$) is not true. This "and" gate generates the term V which prevents the clock generator from operating at a frequency higher than the clock frequency of the transmitting station.

Figure 4:
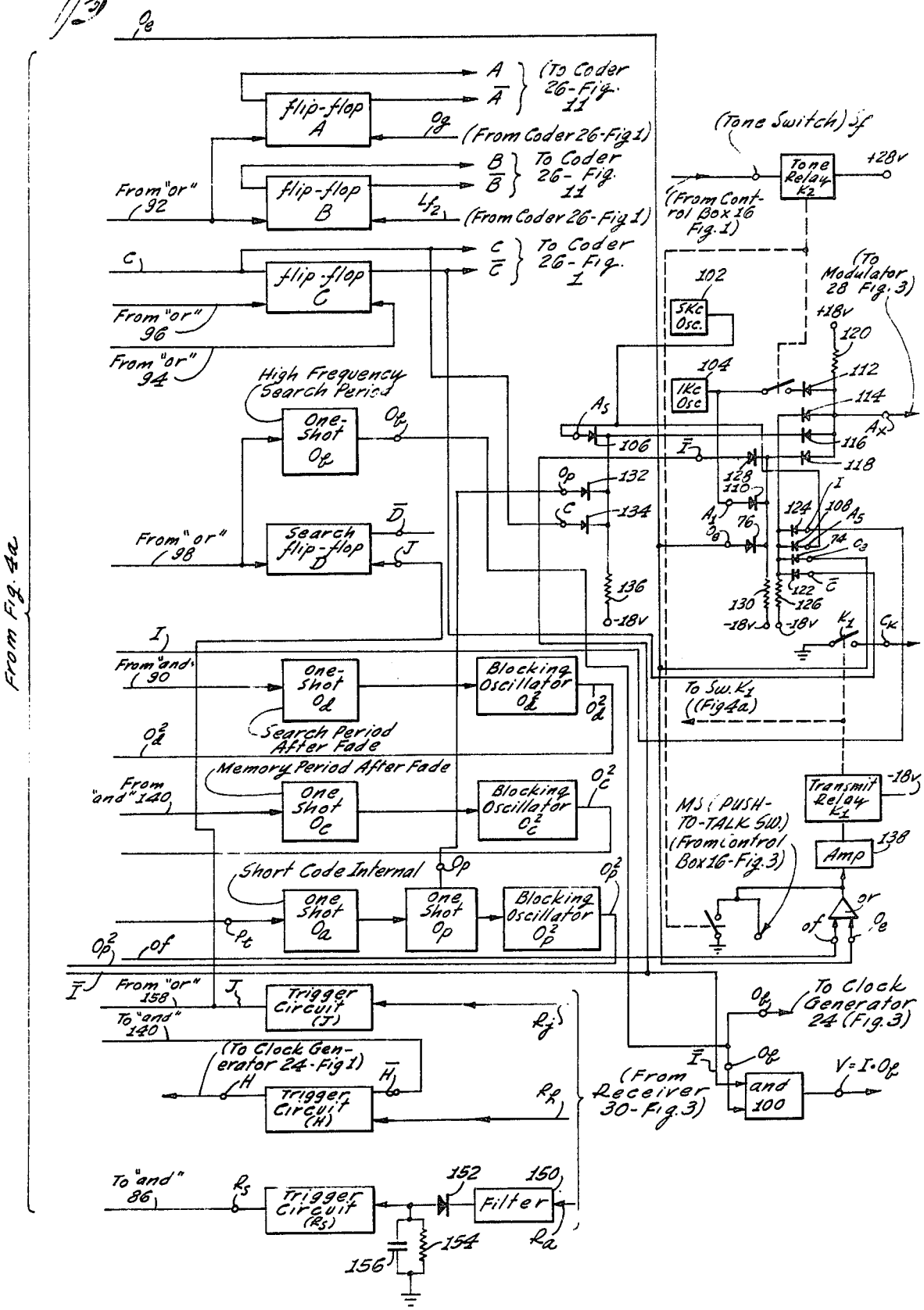

The 5 kilocycle signal which is transmitted from a transmitting station to a receiving station upon the short code/long code changeover is generated by the auxiliary 102 and designated A5 in FIG. 4. The 1 kilocycle signal which is transmitted to the receiving station during the entire interval of a short code operation is generated by the auxiliary 104 and designated A1 in FIG. 4.

During the transmission of the signals A1 or A5, the transmitted signal is introduced to the modulator 28 of FIG. 1 as the term (Ax). These signals are introduced to the output terminal designated (Ax) in FIG. 4 in a selective manner through a diode gate matrix which is made up of the diodes 74, 76, 106, 108, 110, 114, 116, 118, 122, 124, 128, 132 and 134. These diodes form an "or" gate which produces the (Ax) term and also from 4 "and" gates which control the input to the "or" gate. The term (Ax) can be expressed by the following equation:

$$A_x=A_1\cdot\bar{I}\cdot O_e+A_5\cdot I\cdot O_e\cdot\overline{C}+A_5\cdot Op\cdot C+A_1\cdot K_2(\text{Relay})$$

Therefore, the 5 kilocycle or 1 kilocycle tone (Ax) is generated under the following condition:

$A_1\cdot\bar{I}\cdot O_e$—1 Kc—Shortly after short code transmission $A_5\cdot I\cdot O_e\cdot\overline{C}$—5 Kc—When automatic interrogation is made $A_5\cdot Op\cdot C$—5 Kc—1 millisecond before change-over to long code $A_1\cdot K_2$—1 Kc—closing tone switch (relay implemented).

There are 3 relay circuits in the control system of FIG. 4. These are the relays (K1), (K2) and (K3). The relay (K1) is the master transmit relay and it serves to ground the terminal (Ck) in FIG. 4 when it is energized. This, in turn conditions the various components of the station to the transmitting mode, as will be described in detail. The energizing of the transmit relay (K1) may be summarized by the following equation:

$$K1=Oe+Of+K2+Ms$$

The terms Oe and Of are one-shot trigger network outputs of 0.5 and 3 seconds respectively as described above. These two terms are implemented by means of the "or" gate 54 in FIG. 4. The tone relay K2 has a pair of normally-open contacts which close when the relay K2 is energized. The term Ms is derived from the operation of the push-to-talk switch on the microphone. The tone relay K2 is energized as long as the operator closes the tone switch located on the control unit panel.

The relay K3 generates the power reset term "Q". The receiver 30 in the transceiver unit 10 of FIG. 3 is shown in block form in FIG. 5, and circuit details of the receiver are shown in FIGS. 6, 7 and 8. The function of the receiver 30 is to detect correlation between the received coded intelligence signal and the locally generated decoding signal, to provide a phase locking signal in order to maintain such correlation, and to provide audio information once the correlation is obtained. The phase locking signal is used to keep the locally generated decoding signal synchronized with the incoming coded intelligence signal. The phase locking signal is required to increase the frequency of the clock generator in the receiving station when the locally generated decoding signal lags the received coded intelligence signal, and to decrease the frequency of the clock generator in the receiving station when the locally generated decoding signal leads the received coded intelligence signal.

The phase locking signal is produced in the receiver station by comparing the received coded intelligence signal with two locally generated decoding signals. These locally generated decoding signals will be designated G and F respectively. The two decoding signals will each correspond to the particular short code or to the particular long code being used for any particular transmission. The decoding signal G has the same timing as the decoding signal generated by the coder in the receiving station, but the decoding signal F is delayed by a predetermined amount. In order that the decoding signal G may be distinguished from the decoding signal F, an identifying 140 kc square wave signal is modulated on the decoding signal G.

As explained above, the transmitted coded intelligence signal consists of a radio frequency carrier which has been balanced modulated with a code signal which, in turn, has been modulated, for example, with a 110 Kc frequency-modulated subcarrier containing the audio information. In order to obtain the audio information in the receiver, and as also explained above, it is necessary to perform a balanced demodulation process. This latter process at the receiving station yields a carrier modulated only with the 110 kc frequency modulated subcarrier. Therefore, the received and demodulated coded intelligence signal would have side bands at ±110 kc, for example, if it were demodulated solely by an unmodulated decoding signal. However, when the received code intelligence signal is in phase with the modulated decoding signal G, additional side bands will occur due to the intermodulations of the ±110 kc and ±140 kc signals. Two of the side bands are displaced ±30 kc from the center frequency of 60 megacycles, and two are displaced ±250 Kc from the center frequency. The amplitude of these side band signals will decrease as the received coded signal moves away from perfect synchronism with the modulated locally generated decoding signal G. On the other hand, when the received coded intelligence signal is in phase with the locally generated unmodulated decoding signal F, the frequency modulation side bands which are produced ±110 kc from the center frequency. In the same manner, the amplitude of these latter two side band signals will decrease as the received coded intelligence moves away from perfect synchronism with the unmodulated locally generated decoding signal F.

The phase locking signal for controlling the decoding signal generator is obtained by rectifying the 30 kc side band signals referred to above and which are associated with the modulated decoding signal G, this rectification being such that a positive direct current signal is obtained; and by rectifying the 110 kc side band signals associated with the decoding signal F to obtain a negative direct current signal. The positive direct current signal and the negative direct current signal are then compared to obtain a difference signal, and this difference signal is applied to the clock generator at the receiving station to advance or retard the frequency of the clock generator and thereby control the phase relation of the decoding signals and the received coded intelligence signal, as will be described. The result is that the received coded intelligence signal is locked halfway between perfect synchronism with the locally generated decoding signal F and the locally generated decoding signal G.

The receiver 30 of FIG. 1 is shown in block form in FIG. 5, as noted above, and the circuit details of the receiver are shown in FIGS. 6–8. As shown in FIG. 5, the radio frequency amplifier 34 of the radio frequency unit 12 in FIG. 3, and the frequency generator 36 of FIG. 3, are coupled to a mixer 37 which produces the first intermediate frequency signal for the receiver. This first intermediate signal has a frequency, for example, of 60 megacycles. The first intermediate frequency signal is introduced to a first intermediate frequency amplifier 200 which has, for example, a 10 megacycle bandwidth. The intermediate frequency amplifier 200 is coupled to a hybrid balanced modulator 202 which will be described, and which serves as the decoder for the receiving section of the station. The locally generated decoding signals are introduced to the balanced modulator 202 through a wave form shaper 203, the respective decoding signals being derived from a pair of input terminals designated "code F" and "code G".

The wide band/narrow band relay K 101 is interposed in the circuit connections between the shaper 203 and the modulator 202. When this relay is de-energized, the decoding signals are removed from the balanced modulator 202, and a voltage of −18 volts is introduced across the input terminals of the balanced modulator for narrow band operation, as will be described.

The balanced modulator 202 is coupled to a 60 megacycle intermediate frequency amplifier 204 which has a bandwidth of 150 kilocycles. The intermediate frequency amplifier 204, in turn, is coupled to a heterodyne mixer 206 which has a crystal oscillator 208. The oscillator 28 may produce a frequency of, for example, 54 megacycles, and this frequency causes the mixer 206 to produce an intermediate frequency signal of, for example, 6 megacycles.

The intermediate frequency from the mixer 206 is amplifier in an intermediate frequency amplifier 210 and introduced to a second heterodyne mixer 212. A crystal oscillator 214 is coupled to a buffer 216 which, in turn, is coupled to the mixer 212. The crystal oscillator 214 may generate a signal frequency of 5.945 megacycles. The output from the mixer 212 is passed through an isolation amplifier 218 to a 55 kilocycle filter 220. The filter 220 may have a band width, for example, of 10 kilocycles, and it is coupled to an isolation amplifier 222.

The isolation amplifier 218 is also coupled to a 85-kilocycle filter 224 and to a 70-kilocycle filter 226. Both of these filters may have an acceptance band of, for example, 10 kilocycles. The filter 224 is coupled to an isolation amplifier 228, and the filter 226 is coupled to an isolation amplifier 230. The isolation amplifier 222 is coupled to an amplitude modulation detector 232 and to a full wave detector 234. The full wave detector 234 is coupled to a second full wave detector 236, as is the isolation amplifier 228.

The isolation amplifier 230 is coupled to a noise detector 238, and the amplitude modulation detector 232 is also coupled to the noise detector 238. The noise detector 238 is coupled to an emitter follower 240 which produces the correlation indicator signal H.

The full wave detector 236 produces the clock phase control signal Ei. The amplitude modulation detector 232 produces an automatic direction finding signal ADF, and this detector is also connected to a noise limiter 242. The noise limiter 242 is connected to one terminal of a potentiometer 246, the other terminal of which is grounded. The armature of the potentiometer 246 is connected to a pair of normally closed contacts of the wide band/narrow band relay K201. Corresponding normally open contacts of that relay are connected to the armature of a potentiometer 248, the potentiometer 246, the narrow band audio control and the potentiometer 248 and its wide band audio control. One of the terminals of the latter potentiometer is grounded and the other is connected to a limiter and F.M. detector 250. The detector 250 produces an automatic frequency control signal which is introduced to the crystal oscillator 214.

The armature of the contacts of the relay K201 referred to above is connected to a pair of normally closed contacts of the received transmit relay K202, these contacts being connected to a first audio amplifier 252. A received side tone signal is introduced to a pair of normally open contacts associated with these normally open contacts. The relay K202 also controls a pair of normally open contacts which serve to introduce −18 volts to a squelch circuit 254 when the relay K202 is energized. The squelch circuit 254 is connected to the first audio amplifier 252. The output from the first audio amplifier 252 is connected to a potentiometer 256 which is grounded, and which has an armature connected to an audio driver stage 258. The audio driver stage connects with an audio output amplifier 260 and the audio output signals are produced at the output of that amplifier.

The amplitude modulation detector 232 produces an automatic gain control signal which appears on the lead 262, and which is introduced to the intermediate frequency amplifiers 200 and 204, to the mixer 206 and to the squelch circuit 254. This lead is established at −18 volts when the receive/transmit relay K202 is energized to provide the receive mode. The AGC lead is connected to an AGC delay bias network 214. This latter network applies the AGC voltage to the radio frequency receiver amplifier 34 after a particular amplitude delay has been provided. The receiver circuitry as shown in FIG. 6 includes, for example, the intermediate frequency amplifier 200, the balanced modulator 202, the code wave form shaper 203, the intermediate frequency amplifier 204, the mixer 206 and the oscillator 208. The 60 megacycle input signal from the mixer 37 of FIG. 5 is introduced to an input terminal 300 in FIG. 6. This input terminal is connected to a resistor R101 which may have a value of 1 kilo-ohm and to a variable inductance coil L101. The resistor R101 is connected to the junction of a resistor R125 and of a grounded capacitor C126. The resistor R125 may, for example, have a resistance of 1 kilo-ohm and the capacitor C126 may have a capacity of 1003 microfarads. The resistor R125 connects with the lead 262 on which the automatic gain control potential is developed.

The inductance coil L101 is shunted by a resistor R102, and this coil is also connected to a grounded capacitor C101 and to the control grid of an electron discharge tube V101. The capacitor C101 may have a capacity of 10 micromicrofarads.

The cathode of the tube V101 is connected to a resistor R103 which, in turn, is connected to a grounded resistor R104, the latter resistor being shunted by a capacitor C102. The resistor R103 may have a resistance of 39 ohms. For example, the resistor R104 may have a resistance of 150 ohms and the capacitor C102 may have a capacity of 300 micromicrofarads.

The suppressor grid of the tube V101 is grounded and the screen grid of that tube is connected to a resistor R105 and to a grounded capacitor C103. The resistor R105 is connected to the positive terminal of a 120 volt source of direct voltage. The capacitor 103 may have a capacity of 330 micromicrofarads and the resistor R105 may have a resistance of 10 kilo-ohms.

The anode of the tube V101 is connected to a resistor R106, a capacitor C106, a variable inductance coil F102, and to a grounded capacitor C104. The resistance R106 connects with a resistor R107 and with a grounded capacitor C105, the capacitor also being connected to the other terminal of the inductance coil L101. The resistor R107 is also connected to the positive terminal of the 120 volt direct voltage source.

The capacitor C104 may have a capacity of 10 micromicrofarads, the capacitor C106 may have a capacity of 5 micromicrofarads, the capacitor C105 may have a capacity of 330 micromicrofarads and the resistor R107 may have a resistance of 470 ohms.

The balanced modulator 202 includes a vacuum discharge tube V102 and a vacuum discharge tube V103. The control grid of the tube V102 is connected to the capacitor C106 and to a grounded resistor R109 whereas the control grid of the tube V103 is connected to a grounded resistor R108. Each of these resistors may have a resistance of 10 kilo-ohms and they are shunted by a variable inductance coil L105 and by a dual stator variable capacitor C107. The rotor of the capacitor C107 is grounded.

The cathode of the vacuum discharge tube V102 is connected to a resistor R110, and the cathode of the tube V103 is connected to a resistor R112. Each of these resistors may have a resistance of 100 ohms. A potentiometer R111 is connected to the resistor R110 and R112, the potentiometer having a resistance of 200 ohms, for example. The armature of the potentiometer resistor R111 is grounded. The cathode of the tube V102 is connected to a grounded capacitor C108, and the cathode of the tube V103 is connected to a grounded capacitor C109. Each of these capacitors may have a capacity of 330 micromicrofarads.

The suppressor electrode of the tube V102 is connected to a grounded capacitor C110 and to an output terminal 304 of the code wave form shaper 203. The suppressor of the tube V103, on the other hand, is connected to a grounded capacitor C112 and to an output terminal 306 of the code wave form shaper. Each of the capacitors C110 and C112 may have a capacity of 10 micromicrofarads. The screen electrodes of the tube V102 and V103 are both connected to a grounded capacitor C111 and to a resistor R113, the resistors being connected to the positive terminal of the 120 volt direct voltage source. The capacitor C111 may have a capacity of 330 micromicrofarads and the resistor R113 may have a resistance of 470 ohms.

The code F described above is introduced to an input terminal 308 of the code wave form shaper 203 and the code G is introduced to an input terminal 310. These codes, of course, are derived from the coder 26 of FIG. 3. The input terminal 308 is connected to a capacitor C127 which may have a capacity of 1 microfarad and which is connected to the base of a transistor Q101. The transistor may be of the type presently designated 2N495. The base of the transistor Q101 is also connected to a grounded resistor R127 and to the anode of a diode CR101. The resistor may have a resistance of 10 kilo-ohms and the diode may be of the type designated IN643. The cathode of the diode CR101 is connected to the armature of a potentiometer R126. This potentiometer may have a resistance of 300 ohms and it is connected to ground and to a resistor R125. The resistor R125 is connected to the junction of a pair of resistors R130 and R131 and this junction is connected to the negative terminal of an 18 volt direct voltage source. The resistor R125 may have a resistance of 5.6 ohms, the resistor R130 may have a resistance of 5.6 ohms and the resistor R131 may have a resistance of 3.3 kilo-ohms.

The resistor R131 is connected to the base of a transistor Q102. This latter transistor may also be of the type designated 2N495. The base of the transistor Q102 is connected to a diode CR104. This latter diode is a 5.2 volt Zener diode of the type designated 65K7. The cathode of the diode is grounded.

The collector of the transistor Q101 is connected to a coupling capacitor C128 and to an inductance coil L106. The inductance coil L106 is connected to a resistor R128. The resistor R128 is connected to the negative terminal of an 18 volt direct voltage source. The resistor R128 may have a resistance of 910 ohms and the coupling capacitor C128 may have a capacity of 101 microfarads.

The coupling capacitor C128 is connected to the output terminal 304, to a resistor R129 and to a diode CR103. The resistor R129 is connected to a grounded capacitor C128 and to the armature 1 of the narrow band/wide band relay K101. The cathode of the diode CR103 is grounded. The resistor R129 may have a resistance of 47 kilo-ohms, the capacitor C129 may have a capacity of 0.01 microfarads and the diode CR103 may be of the type designated IN643.

The collector electrode of the transistor Q102 is connected to the emitter of the transistor Q101. A diode CR102 has its anode connected to these common electrodes and the cathode of the diode is grounded. The diode CR102 may be of the type designated IN643.

The input terminal 310 is connected to a coupling capacitor C130 which, in turn, is connected to the cathode of a transistor Q103. The transistor Q103 is connected to an inductance coil L107 and to a coupling capacitor C131. The inductance coil L107 is connected to a resistor R133 which, in turn, is connected to the negative terminal of the 18 volt direct voltage source. The coupling capacitor C131 is connected to the output terminal 306 and to an armature 2 of the relay K101.

The emitter of the transistor Q103 is connected to the collector of a transistor Q104. The emitter of the transistor Q104 is connected to a resistor R137 and the emitter of the transistor Q102 is connected to a resistor R132. Both of these resistors are connected to the positive terminal of the 18 volt direct voltage source and each may have a resistance of 1.2 kilo-ohms. The base of the transistor Q104 is connected back to the base of the transistor Q102. The transistors Q103 and Q104 may be similar to the transistors Q101 and Q102, and the circuitry associated with the resistors Q103 and Q104 may be identical to the circuitry described above in conjunction with the transistors Q101 and Q102. For that reason, the latter circuitry will not be described in detail.

The narrow band/wide band relay K101 is controlled by an energizing coil which is connected to the positive terminal of a 27 volt direct voltage source and to an input terminal 312. The input terminal 312 receives a wide band control signal from the controller 24, so that the relay K101 is energized for wide band signal operation to receive the coded intelligence signal from the transmitting station.

The relay K101 has a normally closed contact 3 associated with the armature 1 and which is connected to the negative terminal of the 18 volt direct voltage source. The relay also has a normally open grounded contact 4 associated with the armature 1 and a normally closed grounded contact 5 associated with the armature 2.

It is clear that when the relay K101 is deenergized for narrow band moded reception, both the output terminals 304 and 306 of the code form wave shaper 203 are grounded so that no code signal is introduced to the balanced modulator 202 and the modulator functions as an amplifier for the uncoded received narrow band intelligence signal. However, when the relay K101 is energized, the ground connections are removed from the output terminal 304 and 306 to permit the code signals to be introduced to the balanced modulator.

The balanced modulator 202 is connected to the second intermediate frequency amplifier 204, as described in conjunction with FIG. 5. This connection is made to the junction of a variable inductance coil L103 and a coupling capacitor C115. The inductance coil L103 is shunted by a capacitor C114 and these elements are connected to a grounded capacitor C113 and to a resistor R114. The resistor R114 is connected to the positive terminal of the 120 volt direct voltage source. The capacitor C115 has a capacity of 10 micromicrofarads, for example, and the capacitor C114 may have a capacity of 20 micromicrofarads, the capacitor C113 may have a capacity of 330 micromicrofarads and the resistor R114 may have a resistance of 470 ohms.

The coupling capacitor C115 is connected to the control grid of a tube V104, the control grid being connected to a resistor R115 which in turn is connected to the AGC lead 262. The cathode of the tube V104 is connected to a resistor R116 which in turn is connected to a grounded resistor R117, the latter resistor being shunted by a capacitor 116. The resistor R115 has a resistance of 10 kilo-ohms. For example, the resistor R116 may have a resistance of 39 ohms, the resistor R117 may have a resistance of 150 ohms and the capacitor C116 may have a capacity of 330 micromicrofarads.

The screen electrode of the tube V104 is connected to the resistor R118 and to a grounded capacitor C117. The resistor R118 is connected to the positive terminal of the 120 volt direct voltage source, and it may have a value of 10 kilo-ohms. The capacitor C117 may have a value of 330 micromicrofarads. The suppressor electrode of the tube V104 is grounded.

The automatic gain control voltage is derived in a manner to be explained in conjunction with FIG. 8. This voltage is introduced to an input terminal 314. The input terminal 314 is connected to a resistor R138 which may, for example, have a resistance of 1 kilo-ohm. The resistor R138 is connected to the AGC lead 262. This lead is connected to a grounded capacitor C138, and the capacitor may have a capacity of 0.01 microfarads.

The anode of the discharge tube V104 is connected to a variable inductance coil L104 and to a coupling capacitor C120. The coil L104 is shunted by a capacitor C119, and these elements are connected to a grounded capacitor C118 and to a resistor R119. The resistor R119 is connected to the positive terminal of the 120 volt direct voltage source. The capacitor C120 may have a capacity of 10 micromicrofarads, the capacitor C119 may have a capacity of 20 micromicrofarads, the capacitor C118 may have a capacity of 330 micromicrofarads, and the resistor R119 may have a resistance of 470 ohms.

The capacitor C120 is coupled to the control grid of a vacuum discharge tube V105, this latter tube being included in the heterodyne mixer 206 of FIG. 5. The control grid is connected to the resistor R120 which in turn is connected to the junction of a grounded capacitor C121 and a resistor R121. The resistor R121 is connected to the AGC lead 302. The cathode of the tube V105 is connected to a grounded resistor R122 which is shunted by a capacitor C122. The resistor R120 may have a resistance of 10 kilo-ohms, the resistor R121 may have a resistance of 1 kilo-ohm, the resistor R122 may have a resistance of 220 ohms. The capacitor C121 may have a capacity of 330 micromicrofarads, and the capacitor C122 may have a capacity of 0.01 microfarads.

The screen electrode of the vacuum tube V105 is connected to a resistor R123 and to a grounded capacitor C123. The resistor R123 is connected to the positive terminal of the 120 volt direct voltage source and it may have a resistance of 10 kilo-ohms. The capacitor C123 may have a capacity of 0.01 microfarads.

The anode of the tube V105 is connected to the primary winding of a coupling transformer T-101. This winding is shunted by a capacitor C124 which may have a capacity of 50 micromicrofarads. The primary winding is also connected to a grounded capacitor C125 which may have a capacity of 0.01 microfarads and to a resistor R124. The resistor R124 is connected to the positive terminal of the 120 volt direct voltage source, and it may have a resistance of 470 ohms. The secondary winding of the transformer T-101 is connected to an output terminal 316 and to ground. The output terminal 316 is connected to the input terminal 318 of the intermediate frequency amplifier 210 whose circuit details are shown in FIG. 7.

The 54 megacycle oscillator 208 includes a double triode V106. The anode of 1 triode section is directly connected to the 120 volt direct voltage source, the control grid of that triode section is connected to a grounded resistor R139 and the cathode of that triode section is connected to a grounded resistor R140. The resistor R139 may have a resistance of 4.7 kilo-ohms and the resistor R140 may have a resistance of 33 ohms.

A capacitor C139 is coupled between the control grid of the first triode section and the anode of the second triode section. The control grid of the second triode section is grounded, and the cathode of the second triode section is connected to a resistor R141. The capacitor C139 may have a capacity of 15 micromicrofarads and the resistor R141 may have a resistance of 33 ohms. A crystal Y101 is connected between the cathodes of the two triode sections.

The anode of the second triode section is also connected to the primary winding of a transformer T102, this primary winding being shunted by a capacitor C140 and being connected to a grounded capacitor C141 and to a resistor R142. The capacitor C140 may have a capacity of 20 micromicrofarads, the capacitor C141 may have a capacity of 330 micromicrofarads, and the resistor R142 may have a resistance of 470 ohms. The resistor 142 is connected to the positive terminal of the 120 volt direct voltage source. The secondary winding of the transformer T102 is connected to ground and to the suppressor electrode of the vacuum tube 105 in the mixer 206.

The input terminal 318 in FIG. 7 is connected to a capacitor C201 which in turn is connected to the base of a transistor Q201. The capacitor C201 may have a capacity of 0.001 microfarads, and the transistor Q201 is of the NPN type presently designated as 3N33. The base of the transistor Q201 is also connected to a grounded resistor R202 of 3.3 kilo-ohms and the emitter of the transmitter is connected to a grounded resistor R203 of one kilo-ohm. The latter resistor is shunted by a capacitor C202 which may have a capacity of 0.005 microfarads.

The collector of the transistor Q201 is connected to a top on the primary of a transistor T201. This primary is shunted by a capacitor C204 which may have a capacity of 100 micromicrofarads and which is connected to a grounded capacitor C205. The latter capacitor may have a capacity of 0.005 microfarads. The fourth electrode of the transistor Q201 is connected to a grounded resistor R204 and to a resistor R205. Both these resistors may have a resistance of 10 kilo-ohms, the resistor R204 being shunted by a capacitor C203 of 0.005 microfarads. The resistor R205 is connected to a lead 320 on which an automatic gain control potential is introduced from an input terminal 322.

The base of the transistor Q201 is also connected to a resistor R201 which may have a resistance of 15 kilo-ohms and which is connected to the positive terminal of the 18 volt direct voltage source. The primary of the transformer 201 is connected to a resistor R206. The latter resistor may have a resistance of 1 kilo-ohm and it too is connected to the positive terminal of the 18 volt direct voltage source.

The secondary of the transformer T201 is connected to ground and to a coupling capacitor C206. The coupling capacitor C206 may have a capacity of 0.001 microfarads, and it is connected to the base of a transistor Q202. The latter transistor is also of the type presently designated as 3N33.

The base of the transistor Q202 is connected to a resistor R207 which may have a resistance of 15 kilo-ohms and which is connected to the 18 volt direct voltage source. The base is also connected to a resistor R208 which may have a resistance of 3.3 kilo-ohms and which is grounded. The emitter of the transistor Q202 is connected to a grounded resistor R208 which may have a resistance of 1 kilo-ohm and the emitter is also connected to a grounded capacitor C207 which may have a capacity of 0.005 microfarads. The fourth electrode of the transistor Q202 is connected to a grounded resistor R210 which may have a resistance of 10 kilo-ohms, to a grounded capacitor C208 which may have a capacity of 0.005 microfarads, and to a resistor R211 which may have a resistance of 10 kilo-ohms. The latter resistor is connected to the AGC lead 320.

The collector of the transistor Q202 is connected to a tap on the primary winding of the transformer T202. This primary winding is shunted by a capacitor C210 which may have a capacity of 100 micromicrofarads. The primary winding is connected to a grounded capacitor C209 having a capacity of 0.005 microfarads, and it is also connected to a resistor R212. The resistor R212 may have a resistance of 1 kilo-ohm, and it is connected to the positive terminal of the 18 volt direct voltage source.

The secondary winding of the transformer T202 is connected to ground and to a coupling capacitor C211. The coupling capacitor may have a capacity of 0.04 microfarads, and it is connected to the base of a transistor Q205. The transistors Q201 and Q202 constitute the 6 megacycle intermediate frequency amplifier 210 of the receiver, and the transistor Q205 constitutes the mixer 212. The latter transistor may be a PNP transistor of the type designated as 2N495.

The base of the transistor Q205 is connected to a resistor R221 and to a grounded resistor R222. The collector of the transistor Q205 is connected to a grounded resistor R223 and to a coupling capacitor C218. The coupling capacitor is connected to the base of a transistor Q206 which also may be of the type designated 2N495. The collector of the transistor Q206 is directly connected to the base of a transistor of a similar transistor Q207. The transistors Q206 and Q207 form the isolation amplifier 218.

The base of the transistor Q206 is connected to a resistor R274 and to a grounded resistor R225. The emitter of the transistor Q206 is connected to a grounded resistor R226 and a capacitor C219. The latter capacitor is connected to the junction of a pair of resistors R229 and R230. The resistor R229 is connected to the negative terminal of the 18 volt direct voltage source, as are the resistors R221 and R224. The resistor R230 is connected to the collector of the transistor Q207. The base of the transistor Q207 is connected to a resistor R227 which also is connected to the negative terminal of the 18 volt direct voltage source. The emitter of the transistor Q207 is connected to a grounded resistor R228 which is shunted by a capacitor C220.

The 5.945 megacycle oscillator 214 includes a transistor Q203 which may be of the type designated 2N495. The transistor is connected as a crystal controlled oscillator which is frequency-stabilized by a crystal Y201, and which includes a transformer T203 which supplies the necessary feedback signals.

An automatic frequency control signal is derived from the detector 250 in FIG. 8 (as will be described), and this signal is introduced through a resistor R220 across a capacitor C213. The resulting voltage across the capacitor C213 is used to control the frequency of the oscillator through a diode CR201 and a tertiary winding of the transformer T203. The output signal of the oscillator is developed across the tertiary winding and this signal is introduced through a coupling capcitor C214 to the base of a transistor Q204. The collector of the transistor Q203 in the oscillator receives its excitation through a winding of the transformer T203 and through a resistor R219, the latter resistor being connected to the negative terminal of the 18 volt direct voltage source. The junction of the resistor R219 and the transformer T203 is connected to the anode of a diode CR203. The cathode of that diode is connected to the anode of a diode CR202 and the cathode of the latter diode is grounded.

The transistor Q204 is connected to form the buffer amplifier 216. The base of that transistor is connected to a grounded resistor R214 and to a resistor R217. The latter resistor is connected to the negative terminal of the 18 volt direct voltage source and to a grounded capacitor C217. The secondary of the transformer T204 is connected to a grounded resistor R218 and to the emitter of the mixer transistor Q205. The resistor R218 is shunted by a capacitor C216, and the collector of the isolation amplifier transistor Q207 is also connected to a coupling capacitor C221. This coupling capacitor is connected to an output terminal 330.

The output terminal 330 of FIG. 7 is connected to an input terminal 350 of FIG. 8. The input terminal 350 in FIG. 8 is connected to the three filters 220, 224 and 226. The filter 220 has a bandwidth of 55 kilocycles for the narrow band mode, the filter 224 has a bandwidth of 85 kilocycles for the wide band mode and the filter 226 has a 10 kilocycle bandwidth to define a noise channel.

The filters 220, 224 and 226 are coupled to the isolation amplifiers 222, 228 and 230, respectively. Each of these amplifiers may have a similar circuitry, and only the isolation amplifier 230 will be described in detail. The isolation amplifier 222 includes a pair of transistors Q208 and Q209, these transistors being coupled to an output transformer T205. The isolation amplifier 228 includes a pair of transistors Q211 and Q212, these are coupled to an output transformer T207. The isolation amplifier 230 includes a pair of transistors Q215 and Q216, and these are coupled to an output transformer T209.

The filter 226 is connected to a coupling capacitor C249 of an 0.001 microfarad and to a grounded resistor R272 of 1 kilo-ohm. The capacitor C249 is connected to the base of a transistor Q215, to a resistor R273 and to a resistor 274. The resistor R273 has a resistance of 3.3 kilo-ohms and it is connected to the negative terminal of the 18 volt direct voltage source. The resistor R274 may have a resistance of 18 kilo-ohms. The emitter of the transistor Q215 is connected to a grounded resistor R274 and to a capacitor C250. The resistor R275 may have a resistance of 750 ohms. The capacitor C250 is connected to the armature of a potentiometer R278, the potentiometer being connected across a portion of the primary of the transformer T209.

The base of the transistor Q216 is connected to a resistor R276 which, in turn, is connected to the negative terminal of the 18 volt direct voltage source. The emitter of the transistor Q216 is connected to a grounded resistor R277. The latter resistor is shunted by a capacitor C251, and the capacitor may have a capacity of 0.05 microfarads.

The output transformer T205 of the isolation amplifier 222 has a first secondary which is connected to the amplitude modulation detector 232, and a second secondary is connected to the full wave detector 234.

The amplitude modulation detector 232 recovers the narrow band audio signal. This detector includes a diode CR206 which is connected from one terminal of the secondary of the winding T205 and ground; and it also includes a resistor R239 and a capacitor C228 which are connected to the other terminal of the secondary and to ground. The other terminal of the secondary winding of the transformer T205 is also connected to a grounded capacitor C226 and to a resistor R240. The resistor R240 is connected to a grounded resistor R241 and to the anode of a diode CR207. The cathode of the diode CR207 is connected to a resistor R242 and to a capacitor C229. The resistor R242 is connected to the junction of the resistor R239 and the capacitor 228, and to a lead 352. This latter lead is connected to an output terminal 355 at which an automatic gain control voltage is developed. The terminal 355 introduces the AGC voltage to the lead 262 in FIGS. 5 and 6. The capacitor C229 is connected to the potentiometer 246, across which the narrow band audio signal is developed.

The primary winding of the transformer T205 is also connected to a coupling capacitor C230. The coupling capacitor C230 is connected to the base electrode of a transistor Q210. This transistor may be of the type designated as 2N495 and it is connected to form the amplitude limiter portion of the limiter and frequency modulation detector 250.

The base of the transistor Q210 is connected to a resistor R244 which in turn is connected to the negative terminal of the 18 volt direct voltage source. The base of the transistor Q210 is also connected to a grounded resistor R245. The emitter of the transistor Q210 is connected to a resistor R247, and the resistor R247 is connected to a grounded resistor R246 and to a grounded capacitor C231. The collector of the transistor Q210 is connected to a pair of back-to-back diodes CR209 and CR208. These diodes are shunted by a capacitor C233. The cathode of the diode CR208 is connected to the negative terminal of the 18 volt direct voltage source and to a grounded capacitor C232.

The frequency modulation detector 250 includes a pair of diodes CR210 and CR211. These diodes are connected as a known type of frequency modulation detector circuit in conjunction with a frequency discriminator transformer circuit T206. The detected frequency modulation signal is produced across a pair of resistors R248 and R249, these resistors being shunted by a capacitor C236. The potentiometer 248 is connected in series with a capacitor C237 across the capacitor C236. As described, the wide band audio signal is derived at the armature of the potentiometer 248. A resistor R250 is connected to the resistor R249 and to a grounded capacitor C238. The automatic frequency control signal for the oscillator 214 in FIG. 7 is derived from the junction of the resistor R250 and the capacitor C238.

The automatic gain control voltage developed on the lead 352 is introduced to one terminal of a potentiometer R267. The other terminal of the potentiometer is grounded, and its armature is connected to the base of a transistor Q214. This latter transistor may be of the type designated 2N495, and it is connected as an emitter follower. The collector of the transistor is connected to a resistor R271 which is connected to the negative terminal of the 18 volt direct voltage source, and the emitter of the transistor is connected to a resistor R268 which is connected to the positive terminal of that source. The emitter is also connected to an output terminal 354 which introduces the AGC voltage to the input terminal 322 of FIG. 7.

A pair of series resistors R269 and R270 are also connected to the AGC lead 352 and to the positive terminal of the 18 volt direct voltage source. The junction of these two resistors is connected to the anode of a grounded diode CR212 and to an output terminal 256. These elements form the AGC delay bias network 263 of FIG. 6. The amplitude-delayed AGC voltage for the radio frequency stages of the receiver is developed at the output terminal 356, and this AGC voltage is introduced to the radio frequency receiver amplifier 34 of FIG. 5.

The wide-band demodulated audio signal produced across the potentiometer R248, and the narrow-band demodulated audio signal produced across the potentiometer R246, are introduced to corresponding contacts of the narrow band/wide band relay K201; so that one of the other of these audio signals may be introduced to the corresponding contacts of the receive-transmit relay K202.

The wide band mode switching signal for controlling the relay K201 is introduced to an input terminal 360 connected to the energized coil of that relay. The transmit switching signal for the relay K202 is introduced to an input terminal 362 connected to the energizing coil of that relay. When the relay K202 is de-energized the system is in its "receive" mode, and the selected demodulated audio signal from the relay K201 is then introduced to the firt audio amplifier 252 through a coupling capacitor C254. The side tone audio input signal is introduced to an input terminal 364 when the system is in its "transmit" mode. For that mode, the side tone signal is introduced for monitoring purposes to the first audio amplifier 252 through the receive-transmit relay K202.

The first audio amplifier 252 includes a transistor Q218 which may be of the type designated 2N339. The base of the transistor is connected to a resistor R258 which, in turn, is connected to a resistor R286 and to a grounded capacitor C256. The resistor R286 is connected to the positive terminal of the 18 volt direct voltage source. The collector of the transistor is connected to a resistor R284 and to a capacitor C259, the resistor R284 also being connected to the grounded capacitor C256. The emitter of the transistor Q218 is connected to the resistor R282 and to a grounded resistor R283. The resistor R282 is connected to the negative terminal of the 18 volt direct voltage source. A capacitor C225 is shunted across the resistor R283.

The capacitor C259 is connected to a potentiometer R293. This potentiometer forms the volume control 256 which is located in the control box 16 of FIG. 3. The potentiometer R293 is connected to a grounded resistor R292. The armature of the potentiometer is connected to the coupling capacitor C260 and the coupling capacitor is connected to the base of a transistor Q220. This latter transistor may be of the type designated 2N339, and its circuit constitutes the audio driver 258 of FIG. 5. The audio driver is connected to a coupling transformer T210, and that transformer is connected to the circuit of a pair of transistors Q221 and Q222. These transistors may each be of the type designated as 2N497, and they are connected as the pushpull audio output amplifier 260 of FIG. 5. This amplifier is connected to the primary winding of an audio output transformer T211, and the audio output signal of the system is derived across the secondary winding of that transformer.

The automatic gain control lead 352 is further connected to the base of a transistor Q219. This latter transistor may be of the type designated 2N339, and this circuit constitutes the audio squelch circuit 254. The collector of the transistor Q219 is connected to the base of the transistor Q218 in the first audio amplifier 252. The squelch circuit 254 includes a squelch level control potentiometer R289.

The output transformer T207 of the isolation amplifier 228 is connected to the full wave detector 236. This detector includes a pair of diodes CR213 and CR214 and a resistor R259 across which the detected signal appears. This resistor is shunted by a capacitor C240. The resulting detected signal is introduced to the clock generator 24 (FIG. 10) as the clock phase control signal Ei.

The primary winding of the transformer T207 is also connected to a coupling capacitor C241. The coupling capacitor is connected to the base of a transistor Q213. The latter transistor may be of the type designated 2N415, and it is connected as an amplitude limited circuit to form the limiter portion of the limiter and frequency modulation detector 229. The frequency modulation detector portion of that circuit includes a transformer T208 and a pair of diodes CR217 and CR218. A pair of resistors R264 and R265 are connected across these diodes, and an automatic frequency control signal is obtained across a capacitor C248. The capacitor C248 is connected to a resistor R266 which, in turn, is connected to a grounded capacitor 247 connected across the resistors R264 and R265. The junction of the resistor R266 and of the capacitor C248 is connected to an output terminal 331 at which this AFC signal is produced.

The output transformer T209 of the isolation amplifier 230 is connected to the noise detector 238. This noise detector includes a diode CR219, and the detected noise signal appears across a resistor R279 connected to that diode and shunted by a capacitor C252. The resistor R279 is connected to the base of a transistor Q217. The latter transistor may be of the type designated 2N495, and it is connected to constitute the emitter follower 240 of FIG. 5. The correlation indicator signal H is derived across a grounded capacitor C253, which is connected to the emitter of the transistor Q217. This signal is produced at an output terminal 341 which is connected to the emitter of the transistor Q217.

The wide band intermediate frequency amplifier 200 of FIGS. 5 and 6 serves as an isolation amplifier between the receiver amplifier 34 of FIG. 5 and the receiver section of the system. The uncorrelated coded intelligence signal from the receiver amplifier 34 is heterodyned in the mixer 37 of FIG. 5 with the signal from the frequency generator 36. The resulting 60 megacycle wide-band intermedite frequency signal is introduced to the 60 megacycle intermediate frequency amplifier 200 at the input terminal 300 in FIGS. 5 and 6.

In order to pass the wide-band intermediate frequency signal from the mixer 37 of FIG. 5, the coupling circuit to the discharge tube V101 in FIG. 6 must have a wide-band frequency response. This coupling circuit (as shown in more detail in FIG. 9) consists of two tuned circuits L1, C1 and L101, C101, with coupling capacitances consisting of the variable capacitors C3 and the capacitance of the coaxial cable J101. By temporarily making the capacitance C3 large, the inductance coils L1 and L101 are individually tuned to 60 megacycles. The capacity of the capacitor C3 is then reduced so that the bandwidth is increased to, for example, ∓5 megacycles at a center frequency of 60 megacycles. The values of the resistors R1, and R101 are then selected so as to obtain a flat response over the 10 megacycle pass band.

The 60 megacycle balanced modulator 202 of the receiver, described in conjunction with FIG. 6, combines the 60 megacycle received signal with the locally generated code signals G and F to achieve correlation. In the wide band mode of operation, the balanced modulator produces, for example, signal frequencies of 60.10 and 59.890 megacycles when the received coded intelligence signal is in phase with the delayed decoding signal G. On the other hand, it produces signal frequencies of 60.030, 59.750, 60.250 and 59.970 megacycles when the received coded signal is in phase with the undelayed decoding signal F.

The decoding signals F and G are phase controlled in a manner to be described so that the phase relationship between these signals and the received coded intelligence signal is such, that the phase of the received coded intelligence signal is half way between the delayed decoding signal G and the undelayed decoding signal F. This creates six bands of frequencies which contain frequency modulation voice information. The circuitry necessary for generating the decoding signals G and F is contained in the coder section of the system, and this circuitry will be described in detail subsequently in conjuntion with FIG. 13.

The output of the first intermediate frequency amplifier 200 is fed to the balanced modulator 202 in FIG. 6 through a double tuned circuit. This circuit is made up of the elements L102, C106, L105, C107, C104, and R106-R109. The coupling capacitor C106 is selected to produce a 10 megacycle bandwidth, for example, the values of the resistors R106, R107, R108 and R109 are selected to obtain a flat frequency response over that bandwith. The amplified 60 megacycle intermediate frequency coded intelligence signal from the amplifier 200 is applied in push-pull to the control grids of the tubes V102 and V103 of the balanced modulator 202. If both suppressor grids of these tubes receive equal positive decoding signals, and if the intermediate frequency signals at their control grids are equal and opposite in phase, no output will occur since the anodes of the modulator tubes are connected in parallel.

The conductances of the modulator tubes V102 and V103 are equalized by the cathode balance control potentiometer R111. The intermediate frequency inputs to the control grids of the balanced modulator tubes are equalized by an adjustment of the differential capacitor C107. The adjustment of the capacitor C107 increases the capacity on one side and decreases the capacity on the other side, so that the intermediate frequency ground point may be established where equal intermediate frequency signals exist on the control grids of the two balanced modulator tubes V102 and V103. Varying the value of the capacitor C107 does not appreciably change the tuning of the resonant circuit L105, C107.

The decoding signals F and G are processed by the circuitry of the transistors Q101 and Q103 in the code waveform shaper 203 of FIG. 6. The two decoding signals are then fed to the suppressor grids of the modulator tubes V102 and V103, respectively. Since the transistor Q101 performs the same function to the decoding signal G as the transistor Q103 does to the decoding signal F, only the action of the circuit of the transistor Q101 will be described.

The transistor Q101, and its associated circuitry, serve to provide the signal with a rectangular waveform representative of the decoding signal G. It is necessary to restore the original rectangular characteristics of the decoding signal in this circuitry, because it is possible for the signal to have been degraded by stray capacitances which result in coupling the signal from the coder 26 to the receiver. The transistor Q101 also removes fluctuations in the amplitude of the decoding signal. The transistor Q102 provides a constant current source for the emitter of the transistor Q101. The value of this current is determined by the Zener diode CR104, and by the resistor R132. A negative going decoding signal applied to the base of the transistor Q101 will drive the emitter signal positive which, in turn, causes the diode CR102 to conduct.

The current controlled by the transistor Q101 will flow into its collector circuit. The resulting collector current produces a voltage across the resistor R129. The inductance coil L106 is used to reduce the rise and fall time of the signal, and the capacitor C128 serves as a coupling capacitor. The diode CR103 together with the resistor R129 top-clamps the code signal to ground so that the suppressor grid of the corresponding modulator tube V102 is at ground potential each time that tube is activated.

The signals from the output of the 60 megacycle balanced modulator 202 of FIG. 6 lie within a narrow frequency band. For this reason, the second intermediate frequency amplifier 204 is provided to exhibit high gain and narrow bandwidth. The cathode resistor R116 of that amplifier is not by-passed. This is in order to minimize the Miller effect which would otherwise cause de-tuning when the AGC voltage is varied.

The 54 MC oscillator 208 in FIG. 6 is a Butler oscillator which operates, for example, at 15 megacycles. The crystal Y101 functions, for example, in its third harmonic mode, and it may be stabilized in a crystal oven which is regulated at a temperature of 75° centigrade. The output signal of the oscillator 208 is injected into the suppressor grid of the discharge tube V105 in the second mixer 206. The output signal of the mixer 206 is centered around 60 megacycles, and this output signal is coupled through the transformer T101 and the output terminal 316 in FIG. 6, and from there to the input terminal 320 of the 6 MC intermediate frequency amplifier 210 of FIG. 7.

The intermediate frequency amplifier 210 includes two stages of tetrode transistor amplification centered at approximately 6 megacycles. These stages are similar to conventional triode transistor amplifiers plus the addition of the second base electrode and associated circuitry. As shown in the circuit diagram of FIG. 7, the second base potential of the transistor Q201 is determined by the resistors R204 and R205 in the first stage of the amplifier, and the second base potential of the transistor Q202 is determined by the resistors R210 and R211 in the second stage of the amplifier.

The gain of the intermediate frequency amplifier 210 is controlled by varying the second base current by voltage derived at the input terminal 322 from the AGC source in FIG. 8. Automatic gain control is fed from that terminal through the resistor R205 to the first stage and through the resistor R211 to the second stage. The pass band of the intermediate frequency amplifier 210 extends, for example, from 5.870 megacycles to 6.050 megacycles. The components of the signals which will be passed by the intermediate frequency amplifier in the wide band mode of operation, for example, are the 5.890, 5.970 and 6.030 megacycle components described above.

The components which pass through the intermediate frequency amplifier 210 are mixed with the signal from the oscillator 214 which includes the transistor Q203. This mixing is carried out in the heterodyne mixer 212 which, as described, includes the transistor Q205. The signal from the oscillator 214, as described, is amplified by the buffer amplifier 216 and then introduced to the mixer 212. The output signal of the mixer 212 consists only of the cross modulation products in the frequency range up to a few hundred kilocycles. The components for the wide band mode include 55, 85 and 70 kilocycles; and the components for the narrow band mode include 55 kilocycles. The frequency components passed by the mixer 212 are then amplified as a group by the isolation amplifier 218 which, as described, includes the transistors Q206 and Q207. The different frequency components are then separated by the filters 220, 224 and 226 of FIG. 8. The filter 220 has a center frequency of 55 kilocycles, for example. The filter 224 has a center frequency of, for example, 85 kilocycles. The filter 226 has a center frequency of, for example, 70 kilocycles. Each filter may have their 3 decibel attenuation points at ∓5 kilocycles from the center frequency, for example, and their 40 decibel attenuation points at ∓10 kilocycles from the center frequencies. The operation of each of the three low frequency channels of the receiver formed by these filters, and which are shown in FIG. 8 will be considered separately.

The filters 220 and 224 pass two wide-band mode signals, one being derived from the decoding signal G with the delayed timing, and the other being derived from the decoding signal F with the undelayed timing. These two wide-band mode signals indicate the degree of correlation between the undelayed and the delayed decoding signals by using the incoming coded intelligence signal as a reference. The circuits following the filters 220 and 224 provide a direct-current output using the diodes CR204 and CR205 in the full wave detector 234, and by using the diodes CR213 and CR214 in the full wave detector 236, for the 55 kilocycle and 85 kilocycle signals, respectively. A control voltage proportional to the difference in amplitude between these two signals is delayed, and that control voltage appears at the output terminal designated Ei. The polarity of this signal Ei indicates whether the clock frequency should be increased or decreased to maintain correlation, and the signal is introduced to the clock generator 24 of FIG. 10 for that purpose.

In addition to the clock control, the 85 kilocycle signal from the filter 224 provides a signal to the limiter stage formed by the transistor Q213. The output from the limiter is introduced to the frequency modulation detector 229 to produce an automatic frequency control signal at the output terminal 331. This AFC signal is used to control the frequency of the 140 kilocycle signal, the latter signal being used in a manner to be described to modulate the undelayed decoding signal F so that it may be distinguished from the delayed decoding signal G.

The filter 220 is used for both wide and narrow band mode reception. For the narrow band uncoded mode of reception, this filter passes the amplitude modulated 55 kilocycle signal produced in the heterodyne mixer 212 of FIG. 7. The signal is amplified in the isolation amplifier 222 of FIG. 8 and detected in the amplitude modulation detector 232. The resulting signal provides a narrow band automatic gain control voltage on the lead 352, and it also provides audio output across the potentiometer R246.

For the wide band coded mode of reception, the signal from the isolation amplifier 222 in FIG. 8 is applied through the coupling capacitor C230 to the base of the transistor Q210 which serves as an amplitude limiter. The 55 kilocycle amplitude limited signal output from the amplitude limiter transistor Q210 is introduced to the discriminator transformer T206 of the frequency modulation detector 250. This signal is amplitude limited to 5 volts, for example, by the action of the Zener diodes CR208 and CR209. The frequency modulation detector 250 is a usual Foster-Seeley discriminator-detector, and its audio output is developed across the potentiometer R248. This audio output is fed in the described manner, through the relays K201 and K202 to the audio amplifier 252. The direct current output of the discriminator appearing across the capacitor C238 is used to control the frequency of the oscillator 214 in FIG. 7.

The output signal from the isolation amplifier 228 in the 85 kilocycle channel is fed to the transistor Q213 for amplitude limiting, and it is then introduced to the frequency modulation detector 229. As noted, the output signal from the detector 229 is used as an automatic frequency control for the 140 kilocycle signal produced by the oscillator in the coder 26 to modulate the decoding signal F.

The transformer T205 in the channel of the 55 kilocycle filter 220 also supplies an amplitude modulated 55 kilocycle signal to the amplitude modulation detector 232. The resulting detected output signal appears across the capacitor C226, and the signal is negative with respect to ground. A portion of the voltage across the resistor R240 is applied to the anode of the series noise limiter diode CR207. The average value of the demodulated signal exists across the capacitor C228, and it is applied to the cathode of the diode CR207 through the resistor R242. If a noise pulse at the anode of the diode CR207 exceeds the average voltage at the cathode, the diode conducts and no noise appears at the audio output control potentiometer R246.

The automatic gain control voltage is taken from the amplitude modulation detector 232, as mentioned above. Negative voltage, proportional to the signal strength, is developed across the resistors R240 and R241; and the audio components are filtered out by the long time constant filter R242, C228. The automatic gain control output signal from this filter is applied directly to the 60 megacycle amplifiers 200 and 204 in FIGS. 5 and 6, as explained above, and the signal is also applied to the AGC delay bias network 263. This network is made up in FIG. 8 of the resistors R269 and R270 and of the diode CR212. The output of the network 263 provides an amplitude-delayed automatic gain control voltage for the radio frequency amplifier 34 in the radio frequency unit 12 of FIG. 3.

The amplitude-delayed automatic gain control signal referred to in the preceding paragraph permits the radio frequency amplifier to operate at maximum gain on weak signals. The radio frequency amplifier will be biased negatively by the AGC signal for reduced gain, only when the signal level is above the noise level of the first mixer 206.

The automatic gain control signal for the 6-megacycle intermediate frequency amplifier 210 of FIG. 7 is obtained from the emitter follower circuit of the transistor Q214 in FIG. 8 (as mentioned above). This circuit supplies a bias current to the second base electrode of the transistors Q201 and Q202 in the intermediate frequency amplifier 210 of FIG. 7. The input to the base electrode of the emitter follower transistor Q214 is obtained from the adjustable potentiometer R267 connected across the main automatic gain control source. The amount of the automatic gain control action in the intermediate frequency amplifier 210 can be controlled by manual adjustment of this potentiometer.

In order to stop the clock pulse generator 24 of FIG. 3 from searching when correlation with the received coded intelligence signal occurs, the correlation indicator signal H is required. This correlation indicator signal H must be relatively free of noise. If the signal were obtained from only the 55 kilocycle channel of the filter 220; large noise signals could stop the search, but this should occur only when the desired correlation signal is produced.

In order to improve the signal-to-noise ratio of the correlation indicator signal H, a method of noise cancellation is utilized. This method makes use of a noise signal from the 70 kilocycle filter 226. The noise channel connected to the filter 226 produces a signal which is proportional to noise and which is independent of the amplitude of the received signal from the transmitter. The output signals of both the 55 kilocycle channel of the filter 220 and the 70 kilocycle channel of the filter 226 are introduced to the terminal 341 in series opposition to obtain a correlation signal H which is free of noise.

The detected output of the noise detector 238 in the 70 kilocycle noise channel appears across the resistor R279 at the output of the noise detector 238, and the detected signal output of the 55 kilocycle channel appears across the resistors R240 and R241 at the output modulation detector 232. Both these outputs are connected in series opposition and the combined output is fed to the transistor Q217 in the emitter follower stage 240. The emitter follower 240 produces the correlation indicator signal H at the output terminal 341, this signal being relatively free of noise. The rectified output signal from the 70 kilocycle noise channel of the filter 226 can be adjusted by varying the potentiometer R278 connected across a portion of the primary winding of the coupling transformer T209. This varies the feedback and the resulting output signal of the isolation amplifier 230. Since the output signals of both the 70 kilocycle and the 55 kilocycle channels can be utilized, the noise signals are cancelled and cannot simulate a correlation signal.

The narrow band/wide band relay K201 connects the first audio amplifier 252 to either the narrow band amplitude control potentiometer R246 in the amplitude modulation detector 232 or to the narrow band/wide band audio amplitude control potentiometer R248 in the frequency modulation detector 250. The first audio amplifier includes the transistor Q218 and this transistor is resistance coupled, and it has the collector of the transistor Q219 in the squelch circuit 254 connected to its base.

The main volume control R293 of the receiver which (as noted above) is included in the control box 16, is connected between the first audio amplifier 252 and the audio driver amplifier 258. The driver amplifier 258 is transformer coupled to the push-pull output amplifier 260 by the transformer T210. The push-pull output amplifier 260 may be operated in Class AB in order to improve efficiency. Since the output load impedance may vary from 50–150 ohms, a considerable amount of degeneration is used to maintain a constant output level.

An objectionable amount of noise may exist in the absence of a signal or during the reception of weak signals. The squelch control transistor Q219 in the audio squelch circuit 254 operates to bias the first audio transistor Q218 to cut off until an output signal is received. The signal level at which the squelch transistor will allow the audio amplifier 252 to function is controlled by the squelch level control potentiometer R289.

The signal that controls the squelch circuit is obtained from the automatic gain control voltage developed on the lead 352 by the amplitude modulation detector 232. Increasing signal strength causes the AGC signal to drive the base of the transistor Q219 more negative than its emitter and thereby bias the transistor to cut off. The emitter is not allowed to become more negative than the bias set by the squelch level control potentiometer R289. This is controlled by the clamping diode CR228, which is connected so that the emitter of the transistor Q219 may go more positive but not more negative than the level pre-set by the potentiometer R289.

When the squelch control transistor Q219 conducts, a collector current flowing through the resistor R287 and R291 forces the potential at the base of the first audio transistor Q218 to become more negative. Since the emitter of the transistor Q218 is relatively fixed by the voltage divider R282 and R283, the transistor Q218 is cut off when its base is driven negative by the transistor Q219.

The resistors R286 and R290 and the capacitor C256 form a low frequency filter which is used to eliminate power supply hum from the input of the audio amplifier 252.

The clock generator 244 of the transceiver unit 10 of FIG. 3 is shown in logical and block form in the diagram of FIG. 10. The illustrated system includes an "and" gate 400 which receives the terms H and $\overline{D}$. The "and" gate 400 is connected to a trigger circuit Tc. The true output terminal Tc of the trigger circuit is connected to an "and" gate 402 and the false output terminal Tc is connected to an "and" gate 404. The "and" gate 402 is connected to the true input terminal N of the flip-flop M, and the "and" gate 404 is connected to the false input terminal $\overline{M}$ of that flip-flop.

The true output terminal M of the flip-flop M is connected to the flip-flop 406 which, in turn, is connected to a diode controlled unit 408. The false output terminal M of the flip-flop M is connected to a pair of "and" gates 410 and 412. The "and" gate 410 is connected to a diode control unit 414, and the "and" gate 412 is connected to a diode control unit 416. The term $O_f$ is introduced to a trigger circuit $T_t$. The true output terminal of the trigger circuit $T_t$ is connected to an "and" gate 418, and the false output terminal $T_t$ of the flip-flop is connected to an "and" gate 420. The "and" gate 418 is connected to the true input terminal n of a flip-flop N, and the "and" gate 420 is connected to the false input terminal n of that flip-flop. The true output terminal N of the flip-flop N is connected to an "and" gate 410, whereas the false output terminal $\overline{N}$ of that flip-flop is connected to the "and" gate 412.

The diode control unit 408 is coupled, for example, to a 4.8530 megacycle crystal 409; the diode control unit 414, is connected for example, to a 4.8530 megacycle crystal 415; and the diode control unit 416, for example, is connected to a 4.8480 megacycle crystal 417. The crystals 409, 415 and 417 are selectively coupled to a crystal oscillator 422. The crystal oscillator is coupled to an emitter follower 424 which, in turn, introduces its output signal to a blocking oscillator K1. The output signal K1 of the blocking oscillator is connected to a group of four delay lines 426, 428, 430 and 432. These delay lines are respectively connected to the "and" gates 402, 404, 418 and 420. The blocking oscillator K1 is also connected to a flip-flop K which serves as a 2:1 frequency divider, and the flip-flop K is coupled to a blocking oscillator K2. The blocking oscillator K2 produces an output signal K2 which has a frequency which is one half the frequency of the signal K1. Each of the signals K1 and K2 is in the form of a series of clock pulses, and both these series of clock pulses are applied to the coder 26.

The keyed memory 426 will be described in some detail in conjunction with FIG. 11. This unit is connected to the crystal oscillator 422, and it receives the clock phase control signal Ei from the receiver (FIG. 8), and it also receives the correlation term $\overline{H}$ from the controller 22.

The clock generator 24 of FIG. 10 is an oscillator which is used to supply the clock pulses K1 and K2 to the coder 26 in FIG. 3, so as to maintain a precise time relationship in the operation of the coder. As described above, the clock generator produces a first train or series of clock pulses K1, and it also produces a second train or series of clock pulses K2. The pulses of the second train are frequency divided by a ratio of 2:1 with respect to the pulses of the first train. The individual clock pulses must be sufficiently narrow to prevent jitter in the code train, and they also must be sufficiently noise free to permit reliable gating. These pulses must also have sufficient power to operate several low impedance logic gates in the coder 26.

In addition, the phase of the clock pulses from the clock generator 24 of FIG. 10 must be extremely stable. This stability should be of the order of approximately one part in a million and over relatively long periods of time. This is necessary in order that the phase of the code signal may also exhibit a desired degree of stability. At the same time, the frequency of the clock pulses K1 and K2 must be controllable so that the decoding signals generated at the receiving station may be brought into phase with the coded intelligence signal received from the transmitting station.

The stringent requirements enumerated in the preceding paragraphs cannot practically be made by a simple crystal controlled oscillator. This is because switching transients caused by sudden changes in the phase of the clock pulses K1 and K2 would completely disrupt the functioning of the coder 26. In order to avoid this, the crystal switching in the clock system of FIG. 10 is carried out in a manner to eliminate the possibility of such transients.

A major component of the clock generator of FIG. 10 is the crystal controlled oscillator 422. This oscillator feeds a sine wave through the emitter follower amplifier 424 into the blocking oscillator K1. The blocking oscillator K1 generates sharp clock pulses at the frequency of the crystal oscillator 422. The clock pulses K1 are used in the coder 26, as mentioned above and as will be described in detail subsequently. These clock pulses, as also mentioned above, are fed to the flip-flop K which divides their repetition frequency by a factor of 2.

The resulting frequency divided pulses are re-shaped by the blocking oscillator K2, and the output clock pulses K2 from the blocking oscillator are used by the coder 26. The remaining portion of the circuitry of the clock generator system in FIG. 10 is used to control the frequency of the crystal oscillator 422. It will be remembered that so long as correlation exists between the locally generated decoding signals and the received coded intelligence signal, the correlation term H is true. Also, so long as the system is in a search phase the term $\overline{D}$ is true. Therefore, when correlation is achieved by the system during a search phase, the terms H and $\overline{D}$ both become true, and the "and" gate 400 enables the trigger circuit $T_c$ to generate the trigger signal $T_c$. The trigger signal $T_c$ combines with a corresponding clock pulse K1 to trigger the flip-flop M true. This causes the diode control unit 408 to couple the crystal 409 into the circuit of the crystal oscillator 422 so that the crystal oscillator oscillates at a frequency of 4.8530 megacycles under the control of that crystal. During this interval, the clock phase control signal Ei from the receiver is introduced to the keyed memory 426, and it serves to maintain the clock pulses K1 and K2 at the proper locked frequency.

The clock pulses K1 are introduced to the "and" gates 402, 404, 418 and 420 in the clock generator system to establish the time at which the crystals 409, 415 and 417 are actually switched into the circuit of the oscillator 422. This clocking of the switching of the crystals into the oscillator circuit assures that the crystal being switched into the circuit produces a signal which is in phase with the signal of the oscillator at the time of switching. In this manner, the production of switching transients is prevented.

During the short code search interval, the terms H and $\overline{D}$ are false and the trigger circuit Tc is in its stable state to cause the term $\overline{Tc}$ to be produced. The flip-flop N is false at this time so that the "and" gate 412 is enabled. Therefore, the moment that the flip-flop M is set false, the resulting signal passed by the "and" gate 412 causes the diode control unit 416 to switch the 4.8480 megacycle crystal 417 into the circuit of the crystal oscillator 422 which is desired during the search interval.

During the search interval, the occurrence of the signal $O_b$ causes the trigger circuit $T_t$ to trigger the flip-flop N true. This latter action enables the "and" gate 410 and disables the "and" gate 412. The enabling of the "and" gate 410 causes the diode control unit to switch the 4.8530 megacycle crystal 415 into the circuit of the crystal oscillator 422 when the flip-flop M is set false. The latter action returns the oscillator 422 to the 4.8530 megacycle frequency for that interval. This latter action produces the high-low search sequence described above.

The keyed memory control for the oscillator 422 is a fine frequency control, and the phase control signal Ei from the receiver is used to achieve exact synchronization between the locally generated decoding signals and the incoming coded intelligence signal. This latter control effect is removed by the keyed memory 426 in the presence of the loss of correlation signal $\overline{H}$, so that the system can enter the search phase described above upon such a loss for a predetermined interval determined by the keyed memory.

The keyed memory 426 is included to avoid loss of synchronization during short periods of communication fades. Normally, a long memory time in the memory is inconsistent with a rapid response to the input signal, but both features are required here. For that reason, the memory 426 is provided with a variable response time which varies from long to short as dictated by the presence or absence of the loss of correlation signal $\overline{H}$ from the controller 24. The keyed memory in effect has a short time constant whenever the receiver is synchronized with the incoming coded intelligence signal, and it has a long time constant whenever the receiver is not synchronized and the signal $\overline{H}$ becomes false.

The keyed memory 426 of FIG. 10 is shown in circuit detail in FIG. 11. The memory circuit of FIG. 11 includes a transistor 450. A capacitor C is connected to the base of the transistor, and this capacitor is also connected to the emitter of a transistor 452. The transistor 452 is connected as an emitter follower, and its emitter is connected to an output terminal 453 which is connected to the oscillator 422 in FIG. 10 to control the frequency of that oscillator.

The base of the transistor 452 is connected to a grounded resistor 454, and the emitter of that transistor is connected to a grounded resistor 456. The collector of the transistor 450 is connected to a resistor 458 and it is also connected to a resistor 460. The resistor 458 is connected to the negative terminal B− of a source of direct voltage as is the collector of the transistor 452. The resistor 460 is connected to a resistor 462 which in turn is connected to the positive terminal B+ and to the emitter of the transistor 452. The base of the transistor 452 is connected to the cathode of a diode 466 and to the junction of the resistors 460 and 462. The anode of the diode 466 is connected to a resistor 470 and to the anode of a diode 476. The resistor 470 is connected to a terminal 471, and the clock phase control signal Ei is introduced to that terminal. The loss of correlation signal H from the controller is applied to the cathode of the diode 476 by way of an input terminal 477.

Under normal correlated operation, the clock phase control signal Ei is introduced to the base of the transistor 452 through the diodes 476 and 466. This follows because the gate circuit formed by the diode 466 is enabled by the fact that the loss of correlation signal $\overline{H}$ is false. Under these circumstances, the signal across the emitter follower resistor 464 follows the signal Ei, so that the signal applied to the crystal oscillator 422 to control its frequency is under the control of the Ei signal. The signal across the capacitor C is also caused to follow the Ei signal under these conditions.

Immediately upon the loss of correlation, however, the signal $\overline{H}$ becomes true, and the gate path through the diode 466 is disabled. Now, the signal across the emitter follower resistor 464 corresponds to the last voltage developed across the capacitor C when correlation was lost. The capacitor C now discharges into a relatively high impedance load, and it exhibits a substantially constant voltage for a relatively long time interval. This causes the AFC control voltage across the resistor 464 to be held substantially constant, and the frequency of the oscillator 422 remains essentially at its last controlled frequency before correlation was lost. If correlation is re-established within a particular time interval, the signal $\overline{H}$ again goes false and the Ei signal again takes over. However, if at the end of the particular interval, correlation is not re-established, the receiver system goes into a search mode of operation, as discussed above.

The coder 26 of the transceiver 10 of FIG. 10 may be similar in concept to the coder described in the co-pending application Ser. No. 790,519 which was filed Feb. 2, 1959, in the name of Robert J. Grady. For purposes of clarifying the present description, the coder disclosed in that application will now be described briefly in conjunction with FIG. 12. The system illustrated in FIG. 12 includes a dynamic storage unit 461, which may be of the delay line type. The dynamic storage unit 461 includes an input terminal 463 to which binary data in the form of input pulses may be introduced. The unit also includes an output terminal 465, at which the input pulses inserted in the terminal 463 appear as output pulses after a predetermined time delay. Suitable circuitry is usually provided for interconnecting the output terminal 465 with the input terminal 463 to provide a normal circulation path for the information stored in the dynamic storage unit.

The storage unit also includes a plurality of intermediate output terminals (abc . . . n). These intermediate output terminals are capable of producing pulses having different time relations with respect to one another and with respect to the pulses at the output terminal 465. For example, when a delay of 12 bit times exists between the input terminal 463 and the output terminal 465, it may be appropriate to provide a one bit delay between the input terminal 463 and the intermediate output terminal a, a two bit delay between the input terminal 463 and the output terminal b, and so on. The dynamic storage unit 461 is also provided with a plurality of output terminals a', b', c', n' and these latter output terminals correspond respectively with the output terminals, a, b, c . . . n.

The illustrated system also includes a static register 467. The static register may include a set of switches, a, b, c . . . n. These switches may be capacle of being manually set, or they may be set in any appropriate automatic mechanical or electrical manner. Moreover, the switches may well be individual flip-flops in the static register with an open switch representing a flip-flop in a false state and a closed switch representing a flip-flop in a true state. The open or closed condition of the switches in the static register 467 determines the "code-of-the-day" referred to above.

A plurality of diodes a'', b'', c'' . . . n'', are included in the static register 467. These diodes have their cathodes connected respectively to different ones of the switches a, b, c . . . n, and the diodes have their anodes connected respectively to different ones of the output terminals a', b', c' . . . n' of the dynamic storage unit 461. The switches a', b', c' . . . n' are illustrated as being of the single-pole, single-throw type, with the armatures of the respective switches being respectively connected to the cathodes of the diodes a'', b'', c'' . . . n''. A closed switch of this group may be considered as representing binary "1" and an open switch may be considered as representing binary "0".

The fixed contacts of all the switches a', b', c' . . . n' in the static register 467 are connected together and to the input terminal of a trigger circuit 469. The trigger circuit 469 may be of any usual type such as a Schmidt trigger.

The trigger circuit 469 responds to input pulses of one polarity only to change from its stable state to its unstable state. The trigger circuit then changes back to its original state after a predetermined interval. This action of the trigger circuit in response to the input pulses results in the production of rectangular output pulses having steep rise and fall times. The purpose of the trigger circuit 469 is to reshape the input pulses which may have become distorted in passing through the dynamic storage unit 461.

The output terminal of the trigger circuit 469 is connected to one of the input terminals of an "and" gate 473. The output terminal of the trigger circuit 471 is connected to the false input terminal of a flip-flop 475. The true output terminal of the flip-flop 476 is connected to a further input terminal of the "and" gate 473, and the false output terminal of the flip-flop 475 is connected to one of the input terminals of an "and" gate 477. The output terminal of the "and" gate 477 is connected to one of the input terminals of an "or" gate 479, and the output terminal of the "and" gate 473 is connected to another of the input terminals of the "or" gate 479.

The system illustrated in FIG. 12 includes an input terminal 481 which receives normal input pulses. These normal input pulses are provided with a particular polarity, such as a negative polarity, for reasons which will be described in detail subsequently. The input terminal 481 is connected to another input terminal of the "and" gate 477. The system also includes an input termianl 483 which is connected to receive clock pulses. As mentioned above, the clock pulses occur at regularly timed intervals, and they define the particular times of the binary data utilized in the system.

The terminal 483 is connected to another input terminal of the "and" gate 473, and to a further input terminal of the "and" gate 477. The terminal 483 is also connected to an input terminal of an "and" gate 485. The system also includes an input terminal 487 which receives "insert" pulses. The input terminal 487 is connected to the true input terminal of a flip-flop 489 and to the true input terminal of the flip-flop 475. The true output terminal of the flip-flop 489 is connected to a second input terminal of the "and" gate 485. The "and" gate 485 is connected to the input terminal of a monostable multivibrator 491.

Monostable multivibrators are constructed to have a stable state and an unstable state. Each triggering pulse triggers off a multivibrator from its stable state to its unstable state; and the multivibrator returns to its stable state after a time interval determination by the parameters of the multivibrator circuit and before the occurrence of the next triggering pulse.

The "or" gate 479 has its output terminal connected to the input terminal of a monostable multivibrator 495. The latter multivibrator, like the multivibrator 491, returns to its original stable state and the return of this multivibrator after each triggering occurs before the occurrence of the next triggering pulse. The output terminal of the multivibrator 495 is connected to a non-inverting amplifier 497, for example, of the cathode follower type. The output terminal of the multivibrator 491 is connected to an inverter amplifier 499. The amplifier 497 provides an output terminal which is true when its input terminal is true, and the inverter amplifier 499 provides an output terminal which is true when its input terminal is false (and vice versa). The amplifier 497 is connected to one input terminal of a resistive mixing network 500, and the inverter 499 is connected to the second input terminal of that network. The output terminal of the network 500 is connected to the input terminal 463 of the dynamic storage unit 461.

In normal operation, both the flip-flops 475 and 489 are set in their false states. In this condition, the "and" gate 473 is disabled and the "and" gate 485 is disabled. The "and" gate 477 on the other hand, is enabled because the term 475 applied to one of its input terminals is true. Therefore, input pulses introduced to the input terminal 481 in coincident time relationship with the clock pulses introduced to the input terminal 483, pass through the "and" gate 477 and through the "or" gate 479 to trigger the monostable multivibrator 495 recurrently. The output signal from the multivibrator 495 has a negative going polarity each time the multivibrator is triggered, and this output is amplified by the non-inverting amplifier 497 and introduced to the dynamic storage unit 461.

The resulting negative pulses from the amplifier 497 are applied to the delay line in the dynamic storage unit 461. These pulses are not passed by the static register 467 as they travel down the delay line. This results from the fact that the diodes a'', b'', c'' . . . n'' are connected with such a polarity that they do not pass the negative pulses. Therefore, there is no output from the static register 467 in the presence of the normal pulses circulated through the dynamic storage unit 461. Both the trigger circuit 469 and the trigger circuit 471 are constructed to respond to input pulses of positive polarity only. Therefore, the normal negative pulses introduced to the input terminal 481 and applied to the dynamic storage unit 461 have no effect on the trigger circuits 469 and 471. These negative pulses travel through the dynamic storage unit and appear with predetermined time delays at the different output terminals a, b, c . . . n.

Appropriate logic circuitry may be incorporated with the input terminal 481 and with any one of the output terminals to provide a circulating system for the normal pulses. In this mode of operation, therefore, the dynamic storage unit 461 performs its normal function in which pulses introduced to the input terminal 481 may be passed to the unit 461 to appear at appropriate time delays at the output terminals a, b, c . . . n. The resulting pulses at these output terminals, as indicated above, may be recirculated through the dynamic storage unit 461. The resulting signal circulating through the unit forms the basis of the pseudo-random code signals described above. This signal, for example, may take the form of a rectangular wave signal; transitions from one state to another are controlled by the spacing of the pulses.

At certain times, it may be desired to introduce information from the static register 467 into the dynamic storage unit 461. At such times, the switches a, b, c . . . n, or their equivalents in the static register, are provided with desired settings corresponding to the "code-of-the-day". Then an initial insert pulse is applied to the input terminal 487 to trigger the flip-flop 489 and the flip-flop 475 to their respective true states. This triggering of the flip-flops 475 and 489 conditions the "and" gates 473 and 485 for the passage of pulses. Also, the "and" gate 477 is now disabled because its input terminal $\overline{475}$ is now false. Therefore, the normal input pulses are prevented from entering the system.

Because the "and" gate 485 is conditioned for conduction by its input terminal 489, the next clock pulse from the input terminal 483 passes through this "and" gate to trigger the monostable multivibrator 491. The resulting negative output pulse from the multivibrator 491 is amplified and inverted by the inverter amplifier 499. The resulting positive pulse from the inverter amplifier is passed through the resistive mixing network 500 to the dynamic storage unit 461. The same negative output pulse from the monostable multivibrator 491 sets the flip-flop 489 false so that the "and" gate 485 passes only one clock pulse.

Therefore, one positive input pulse only is applied to the dynamic storage unit 461 at the first bit time following the introduction of the insert pulse at the terminal 487. As this positive pulse progresses through the storage unit 461, it is introduced to the anodes of the diodes a, b″, c″ . . . n in succession. The polarity of these diodes is such that a positive pulse is applied to the trigger circuit 469 each time that a positive pulse passing through the storage unit 461 encounters a diode in the static register 467 whose cathode is connected to a closed switch contact. The purpose of this is to provide a high speed commutation of the static register 467 by the dynamic storage unit 461. The time spacing of the output terminals a′, b′, c′ . . . n′ may be chosen so that each terminal is operated at an interval corresponding to the interval between successive clock pulses. This causes the pulses introduced to the trigger circuit 469 to trigger that circuit at the clock rate.

The positive input pulse train introduced to the trigger circuit 469 is in serial form and this pulse train is reshaped and inverted by the trigger circuit. The resulting negative output pulses from the trigger circuit 469 pass through the "and" gate 473 and through the "or" gate 479 to trigger the multivibrator 495. The output from the multivibrator 495 is amplified by the amplifier 497 and passed through the resistive mixing network 500 to the input terminal 463 of the dynamic storage unit.

Therefore, for each closed switch of the static register 467, a negative polarity pulse is inserted at the appropriate clock time into the dynamic storage unit 461. As in normal operation, these negative pulses do not affect the elements of the static register because of the polarity of the diodes of the static register.

When the positive insert pulse reaches the end of the dynamic storage unit 461, it appears at the output terminal 465 and is introduced to the trigger circuit 471. The resulting output pulse from the trigger circuit 471 resets the flip-flop 475 to the false state. This again conditions the "and" gate 477 for normal input and disables the "and" gate 473 against the passage of pulses. The system is thereby returned to its operational mode for normal operation. Therefore, the static register 467 may have its switches (or equivalents) set in any desired configuration corresponding to the "code-of-the-day". Then, an insert pulse is introduced to the input terminal 487 to set up a code corresponding to the "code-of-the-day". As that code is obtained from the static register, it is introduced to the dynamic storage unit 461 and may be circulated and recirculated through the system to produce a series of coding pulses at any one of the output terminals a, b, c . . . n. The recirculated train of pulses is used repeatedly throughout a particular interval of communication, and until a new code is to be used. When a new code is to be used, the switches in the static register 467 are again set to settings corresponding to the new code, and the new code is inserted in the system by the introduction of an insert pulse to the input terminal 487.

The coder 26 of the transceiver may be similar in concept to the coder of the co-pending application Ser. No. 790,519 and which has just been described. The various elements which make up the coder 26 are shown in FIG. 13. Unlike the coder of the copending application, however, coder 26 includes two delay lines, designated "delay Line No. 1" and "delay line No. 2", and these delay lines are the equivalents of the dynamic storage unit 461 of FIG. 12. The use of two delay lines corresponding to two of the dynamic storage units, serves to increase the complexity of the pseudo-random code, and to decrease the recurrent characteristics of the code.

The logic block diagram of FIG. 13 includes an "and" gate 510. The terms K2 and A are introduced to different input terminals of the "and" gate 510. The "and" gate 510 is connected to a monostable multivibrator G, and the multivibrator is connected to a grounded emitter amplifier 512 and to a grounded emitter amplifier 514. The monostable multivibrator G is also connected to an output terminal 516 at which the term $O_g$ is produced.

The grounded emitter amplifier 512 of FIG. 13 corresponds to the inverter amplifier 499 of FIG. 12, and it is connected to the input terminal of the delay line No. 1. Likewise, the grounded emitter amplifier 514 of FIG. B also corresponds to the inverter amplifier 499 of FIG. 12, and it is connected to the input terminal of the delay line No. 2. The delay line No. 1 has a pair of intermediate output terminals which are connected to an exclusive "or" gate 518.

Exclusive "or" gates are well-known to the electronic digital computer art. Such gates are enabled when either of two inputs are true, but not when both inputs are false. The logical equation for an exclusive "or" gate is:

$$X=\bar{A}\cdot B+A\cdot\bar{B}$$

where X is the output term, A is one of the input terms and B is the other of the input terms.

The exclusive "or" gate 518 is connected to an "and" gate 520. The terms K2, C and $\overline{B}$ are all introduced to respective input terminals of that "and" gate. The "and" gate 520 is connected to an "or" gate 522 which in turn is connected to a monostable multivibrator H. The monostable multivibrator H is connected to an emitter follower 524. The emitter follower 524 in FIG. 13 corresponds to the non-inverting amplifier 497 in FIG. 12 and its output signal is also introduced to the input terminal of the delay line No. 1.

The delay line No. 1 has a plurality of output terminals which are connected to a code selector 526. The code selector 526 in FIG. 13 corresponds to the static register 467 in FIG. 12, and the delay line No. 1 supplies, for example, 22 inputs to that code selector. The code selector 526 in turn supplies 22 inputs to an "or" gate 528 which is connected to a Schmidt trigger. The Schmidt trigger 530 of FIG. 13 corresponds to the trigger circuit 469 in FIG. 12. The Schmidt trigger 530 is connected to an "and" gate 532 and the terms K2 and B are also introduced to that gate. The output of the "and" gate 532 is connected to the "or" gate 522. The delay line No. 1 has a further pair of output terminals which are connected to an exclusive "or" network 534 and one of the pair of output terminals is also connected to a Schmidt trigger 536. The Schmidt trigger 536 produces the output terminal $Lf_2$. The exclusive "or" network 534 is connected to an "and" gate 538 which in turn is connected to an "or" gate 522. The "and" gate 538 also receives the input terms K2, $\overline{B}$ and $\overline{C}$.

The circuitry and components associated with the delay line No. 2 are generally similar to those described above in conjunction with the delay line No. 1. The delay line No. 2 has a pair of output terminals which are connected to an exclusive "or" gate 540, and the exclusive "or" gate is connected to an "and" gate 542. The "and" gate 542 also receives the terms K2, C and $\overline{B}$.

The delay line No. 2 supplies 22 inputs, for example, to the code selector 544, and the code selector supplies coded inputs through an "or" gate 546 to a Schmidt trigger 548. The Schmidt trigger 548 is connected to an "and" gate 550. The "and" gate 550 also receives the input terms K2 and B. The delay line No. 2 has a further pair of output terminals connected to an exclusive "or" gate 552. The exclusive "or" gate 552 is connected to an "and" gate 554. The "and" gate 554 also receives the input terminals K2, $\overline{B}$ and $\overline{C}$. The "and" gates 542, 550 and 554 are all connected to an "or" gate 556. The "or" gate 556 introduces its output signal to a monostable multivibrator I, and the multivibrator is connected to an emitter follower 558. The emitter follower 558 of FIG. 13 corresponds to the cathode follower 497 of FIG. 12, and it introduces its output signal to the input terminal of the delay line No. 2. The code pulses are obtained from further output terminals of the delay line No. 1 and the delay line No. 2. These pulses are introduced to a pair of Schmidt triggers 560 and 562, respectively. The Schmidt triggers are connected to an exclusive "or" gate 564, and that "or" gate is connected to a delay line 556 and to a second exclusive "or" gate 568. The delay line 566 delays the output signal from the exclusive "or" gate 564 by a time interval of, for example, 0.4 microseconds.

The output terminal of the delay line 566 is connected to a Schmidt trigger 570. The transmit-receive relay K202 controls three armatures in FIG. 13 designated 1, 2 and 3. The armature 1 is connected to an astable multivibrator 572, the output of which is connected to the exclusive "or" gate 568. The armature 2 of the relay K202 is grounded, and the armature 3 is connected to the positive terminal of a 28 volt direct voltage source. The negative terminal of the direct voltage source is grounded.

A normally-closed contact associated with the armature 1 of the relay K202 receives the 140 kilocycle AFC signal from the receiver of FIG. 8. A normally-open contact associated with the armature 1 receives the 110 kilocycle audio modulated subcarrier from the modulator 28. A normally-closed contact associated with the armature 2 is connected to a resistor 574, and a normally-open contact associated with that armature is connected to a resistor 576. A normally-closed contact associated with the armature 3 of the relay K202 is connected to a resistor 576, and a normally-open contact associated with the armature 3 is connected to the resistor 574. The term $C_k$ is introduced to the energizing coil of the relay K202 is energize that relay when the system is conditioned to the transmit mode.

The exclusive "or" gate 568 is connected to a Schmidt trigger 578. The resistor 574 is connected to a grounded capacitor 580 and to an "and" gate 582. The resistor 576 is connected to a grounded capacitor 584 and to an "and" gate 586. The Schmidt trigger 570 has a true output terminal connected to an "and" gate 588, and it has a false output terminal connected to an "and" gate 590. The Schmidt trigger 578 has a true output terminal connected to an "and" gate 592. An input terminal 596 receives the double frequency clock pulses K1 from the clock generator 24 of FIG. 10, and the input terminal introduces those pulses to the "and" gates 592 and 594. The input terminal 596 also introduces the double frequency clock pulses K1 to a delay line 598. The delay line 598 delays the pulses K1 by a predetermined amount, and it then introduces the delayed double frequency clock pulses to the "and" gates 588 and 590. The delay line 598 introduces a delay of, for example, 0.04 microseconds to the clock pulses K1.

The "and" gate 588 is connected to the true input terminal of a flip-flop F, and the "and" gate 590 is connected to the false input terminal of that flip-flop. The false output terminal of the flip-flop F is connected to the "and" gate 582, and the true output terminal of that flip-flop is connected to a code mixer 600. The "and" gates 592 and 594 are respectively connected to the true and false input terminals of a flip-flop G. The true output terminal of the flip-flop G is connected to the "and" gate 586. The "and" gates 582 and 586 are connected to an "or" gate 602, and the "or" gate is connected to the code mixer 600. The "and" gates 592 and 594 are connected, respectively, to the true and false input terminals of a flip-flop G. The true output terminal of the flip-flop G is connected to the "and" gate 586. The "and" gates 582 and 586 are connected to an "or" gate 602, and the "or" gate is connected to the code mixer 600. The "and" gates 592 and 594 are connected, respectively, to the true and false input terminals of a flip-flop G. The true output terminal of the flip-flop G is connected to the "and" gate 586. The "and" gates 582 and 586 are connected to an "or" gate 602, and the "or" gate is connected to the code mixer 600.

The false output terminal of the flip-flop G is connected to the modulator 28 to supply the term $\overline{G}$ to the modulator. The code mixer 600 produces a term $F.\overline{G}$ (decoding signal F) at one output terminal, and it produces a term $\overline{F}.G$ (decoding signal G) at a second output terminal. These decoding signals, as mentioned above, are supplied to the receiver 30 of FIG. 6, and they are designated, respectively, in that Figure as the decoding signal "F" and decoding signal "G".

The coder shown in FIG. 13 is made up of two separate channels, as mentioned above. One of these channels is associated with the delay line No. 1 and the other is associated with the delay line No. 2. These channels produce two different rectangular coded pulse trains, each train having a frequency, of for example, 2.425 megacycles. The output logical circuitry shown on the right hand side of FIG. 13, and including the code mixer 600, combines the two 2.425 megacycle coded pulse trains into a single 4.85 megacycle coded pulse train, the latter pulse train being suitably modulated with information for use by the rest of the system in its different communication modes. That is, for the receiving mode, the code mixer produces a delayed, unmodulated decoding signal (F) pulse train and it also produces an undelayed decoding signal (G) pulse train modulated by the 140 kilocycle signal; and for the transmitting mode, the flip-flop G produces a coding signal pulse train modulaed by the audio-intelligence which is supplied to the modulator 28 for transmission.

The use of two independent code channels in the coder 26, as mentioned above, is advantageous in that it increases the complexity of the pseudo-random code, and in that it extends materially the time interval which elapses before the pseudo-random sequence of the 4.85 megacycle pulse train repeats itself.

A code-starting pulse from the controller 22 rejects the terms A, B and C into the coder 26. The term A permits a clock pulse K2 to pass through the "and" gate 510 to trigger the monostable multivibrator G. The multivibrator G produces a positive pulse $O_g$ having a duration of, for example, 0.021 microseconds. The pulse $O_g$ is returned to the controller to set the flip-flop A pulse in the controller so that the "and" gate 510 is disabled, and only one clock pulse K2 is passed through that gate to trigger the monostable multivibrator G. The pulse produced by the monostable multivibrator G is also amplified in the grounded emitter amplifier 512 and injected into the delay line No. 1 with positive polarity. After the positive pulse $O_g$ passes down the delay line No. 1, it is fed through closed switch contacts in the code selector 526 into the "or" gate 528. Therefore, each of the switches in the code selector 526 receives a pulse after some incremental delay, with respect to the preceding switch. The resulting pulses from the "or" gate 528 are introduced to the Schmidt trigger 530, and that trigger serves to reshape the pulses. The output of the trigger 530 is a series of pulses, each of which is independently controlled by a corresponding one of the switches in the code selector 526.

The resulting pulse train from the Schmidt trigger 530 is fed to the "and" gate 532. The pulse train passed through the "and" gate 532 is timed by the clock pulse K2 because the term B remains true during the code injection operation. The clocked pulses from the "and" gate 532 are passed through the "or" gate 522 to the monostable multivibrator H. The resulting pulses from the multivibrator H are passed through the emitter follower 524 and rejected as negative pulses into the delay line No. 1.

In the described manner, therefore, the delay line No. 1 receives a positive initial pulse, and this pulse is subsequently followed by a series of negative pulses whose composition is controlled by the setting of the switches in the code selector 526. When the positive pulse reaches the end of the delay line No. 1 it triggers the Schmidt trigger to form the term $Lf_2$. The term $Lf_2$ is returned to the controller, and as described above, the term is introduced to the flip-flop B in the controller to set that flip-flop false at the end of the code injection process.

When the flip-flop B has been set false, the initial condition injection has been completed, and the delay line No. 1 is filled with a controlled sequence of pulses. The injection circuits are now disabled because of the absence of the B term at the "and" gate 532. At the same time, the $\overline{B}$ term is present at the "and" gates 520 and 538, which permits the circuitry associated with one or the other of those gates to operate under the control of the C term. It will be appreciated that when the "and" gate 538 is enabled by the $\overline{C}$ term, long code operation takes place. Conversely, the circuit of the "and" gate 520 operates when the term C is true for short code operation.

The monostable multivibrator G also injects the initial condition into the delay line No. 2, the latter injection occurring through the grounded emitter amplifier 514. The circuits associated with the delay line No. 2, as noted above, may be similar to the circuitry associated with the delay line No. 1. However, the code selector 544 may be controlled to introduce an entirely different code into the pulses circulating through the latter circuitry. This, as mentioned previously, serves to increase materially the apparent random nature of the code generated by the code mixer 600.

When the terms A, B and C are received from the controller the coder 26 is ready to begin its short code mode of operation. After the initial injection term B goes false, as described above, so that the "and" gate 532 is disabled, the "and" gate 538 remains disabled because the term $\overline{C}$ is false. However, the "and" gate 520 becomes conductive.

Pulses from the delay line No. 1, which are delayed by different incremental clock periods, are now received by the exclusive "or" gate 518. This gate produces an output term which is the logic sum $(X\cdot\overline{Y}+\overline{X}\cdot Y)$ of two input terms X and Y. This sum passes into the "and" gate 520 where the individual pulses, clocked by the clock pulses K2, are allowed to pass. The pulses are then introduced to the multivibrator H, and the resulting output pulses from the multivibrator H are passed through the emitter follower 524 to the input terminal of the delay line No. 1 in the form of negative going pulses. In the manner described above, a closed loop is formed in which the individual pulses are clocked before being injected back into the delay line No. 1. The code selector 526 and the "or" gate 528 present practically no load to the delay line during this circulating operation, because the negative pulses see only the back impedance of the diodes of the switches in the code selector. Likewise, neither the Schmidt trigger 530 nor the exclusive "or" network 534 affects the input to the multivibrator H because any signal in these circuits is gated out by the disabled "and" gates 532 and 538.

The coder 26 of FIG. 13 operates in a long code mode in a manner similar to the manner in which it generates the short code. That is, the initial condition is first injected and the term B is then made false. The only difference in operation between the two modes is that the term $\overline{C}$ is true for long code operation to enable the "and" gate 538, and the term C is false for long code operation to disable the "and" gate 520.

As a result of the initial condition injection, negative pulses circulate down the delay line No. 1, as described above. The exclusive "or" gate 534 receives these pulses which are delayed at different incremental clock periods, and that gate produces an output which is applied to the "and" gate 538. The individual pulses, clocked by the pulses K2, are passed by the "and" gate 538 and through the "or" gate 522 to the monostable multivibrator H. As before, the multivibrator H generates pulses, which are passed by the emitter follower 524 and injected as negative going pulses into the delay line No. 1.

During the short code operation, the exclusive "or" gate 518 is fed by pulses near the beginning of the delay line No. 1; and during the long code operation, the exclusive "or" gate 534 is fed by pulses near the end of the delay line. It is this arrangement which produces the difference in the two codes, and causes one code to be designated as "long" and the other as "short". Therefore, the coder 26 produces a short pseudo-random code train which repeats after a relatively short time interval, and it produces a relatively long pseudo-random code train which repeats only after an extremely long time interval.

The short code is used, as described above, to facilitate the correlation between a transmitting station and a receiving station. This is because the repetitive characteristics of the short code enables a receiving station to lock on in a relatively short time interval, and in the manner described above. Then, when the changeover is initiated at the transmitting station from the short code to the long code, the receiving station is already in operation and is in step with the transmitting station. The search sequence described above is then initiated to bring the stations back into step after the changeover has been made.

As noted above, the code selector 526 in the generator of the coder, including the delay line No. 1, may be controlled so that a code is set up in that channel, and that particular code may be completely different from the code set up in the generator including the delay line No. 2 by the code selector 544. The two code trains in the two channels may, therefore, be independent in content for both the short code and the long code. However, the two channels are not independent as to whether they will produce the short code or the long code. Instead, the control is set so that both channels produce the short code or both channels produce the long code.

Outputs are taken from the channel including the delay line No. 1, and from the channel including the delay line No. 2, from taps on the respective delay lines. These taps, as described above, are connected to the Schmidt triggers 560 and 562, respectively. The output from the delay line No. 1, for example, may be taken from a tap position delayed by an incremental number (N) of clock periods. The output from the delay line No. 2, on the other hand, may be taken from a tap position delayed by a number of clock periods equal to $(N+\frac{1}{2})$. These two output pulse trains are reshaped by the Schmidt triggers 560 and 562, and they are then applied to the exclusive "or" gate 564.

The output signal of the exclusive "or" gate 564 is a pulse train having characteristics similar to those of the original codes. However, this output signal has a bandwidth extending over twice as wide a frequency spectrum as either of the original codes, because of the fact that one of the codes is displaced with respect to the other by one half of a clock period.

The code produced by the exclusive "or" gate 564 is processed in one manner for the "transmit" position of the transmit-receive relay K202 and in another manner for the "receive" position of that relay. In the transmit condition, the output of the exclusive "or" network 564 is added to the audio modulated 110 kilocycle square wave output signal of the astable multivibrator 572 and this addition takes place in the exclusive "or" network 568. In this transmit condition, the output of the astable multivibrator 572 is a 110 kilocycle square wave signal which is frequency-modulated with the audio information. The resulting modulated code signal from the exclusive "or" network 568 is shaped and phase-split by the Schmidt trigger 578. The outputs from the Schmidt trigger 578 are applied to the "and" gates 592 and 594 as described above. The output from the exclusive "or" gate 564 delayed by the delay line 566 is reshaped and phase-split in the Schmidt trigger 570. The outputs from the Schmidt trigger 570 which are intermodulated, are applied to the "and" gates 580 and 590.

The second input to the "and" gates 588, 590, 592 and 594 is the double frequency clock pulses K1 from the clock generator of FIG. 10. These clock pulses are delayed by the delay line 598 before they are applied to the "and" gates 580 and 590, and the pulses are applied to the "and" gates 592 and 594 without delay. The output of the "and" gate 580, therefore, is an accurately timed series of clock pulses which are present each time the unmodulated, delayed code signal is in a true state; and the output of the "and" gate 590 is a series of clock pulses which are present when the unmodulated, delayed code signal is in a false state. Likewise, the output of the "and" gate 592 is a series of clock pulses which are present when the modulated, undelayed code signal is in a true state; and the output of the "and" gate 594 is a series of clock pulses which are present when the modulated, undelayed code signal is in a false state.

The outputs of the "and" gates 588 and 590 are used to control the state of the flip-flop F. This flip-flop produces a rectangular, delayed unmodulated code wave form which changes state at the delayed clock time. In like manner, the outputs from the "and" gates 592 and 594 control the flip-flop G to produce an undelayed, modulated rectangular wave form which changes state at the modulated clock time. The output $\overline{G}$ of the flip-flop G is a rectangular accurately timed code signal, and this signal is modulated with the 110 kilocycle audio modulated subcarrier in the exclusive "or" gate 568. This signal is the output of the coder during the transmitting mode of operation, and it is used to balance modulate a radio frequency signal in the transmitting section of the station during that mode.

The "and" gates 582 and 586 are controlled by the transmit-receive relay K202. In the transmit condition of the system, the "and" gate 582 is enabled by a bias signal from the 28 volt source, and the "and" gate 586 is disabled. The input term F to the code mixer 600 during the transmit mode of operation is received directly from the flip-flop F, and the input term $\overline{F}$ is received from the slip-flop F through the enabled "and" gate 582 and through the "or" gate 602. This provides a monitoring side tone signal for the receiver during the transmit mode of the system, as described above.

The code mixer 600 is shown in FIG. 14. The circuit of the code mixer may be similar to an exclusive "or" network. The circuit includes a transistor Q1 and a transistor Q2. The term F is introduced to the base of the transistor Q1, and the term G is introduced to the base of the transistor Q2. It will be remembered that the term F is derived from the flip-flop F in FIG. 13, and the term G is received from the "or" gate 602 in FIG. 13 when the system is conditioned to the receive mode of operation.

The transistors Q1 and Q2 may be of the PNP type. The emitter of the transistor Q1 is connected to a resistor Re', and the emitter of transistor Q2 is connected to a resistor $R_e''$. Both of these resistors are connected to the positive terminal of the 18 volt direct voltage source. The collector of the transistor Q1 is connected to an output terminal at which the term $\overline{F}.G$ (decoding signal G) appears, and the collector of the transistor Q2 is connected to an output terminal at which the term $F.\overline{G}$ (decoding signal F) appears. The collector of the transistor Q1 is also connected to the anode of a diode 610 and to a resistor $R_c'$. The collector of the transistor Q2, on the other hand, is connected to the anode of a diode 614 and to a resistor $R_c''$. The cathodes of the diodes 610 and 614 are connected to a grounded resistor 616.

The resistor $R_c'$ is connected to an inductance coil $L_c'$ and the resistor $R_c''$ is connected to an inductance coil $L_c''$. The inductance coils L' and L'' are connected to the negative terminal of the 18 volt direct voltage source. The resistor $R_e'$ and $R_e''$ are connected to the positive terminal of that source.

The Boolean products $\overline{F}\cdot G$ (decoding signal G) and $F\cdot\overline{G}$ (Decoding signal F) are formed at the collector of the transistors Q1 and Q2 respectively. These terms are not used to form the term $F\cdot G+F\cdot G$, as is usual in exclusive "or" networks, but they are used to provide two distinct outputs which make up the decoding signal F and the decoding signal G. It is evident that in the transmit condition, when the input term G is replaced by the input term $\overline{F}$, that the output signals from the code mixer 600 are F and $\overline{F}$. This latter split-phase signal is sent to the receiver section of the station during the transmitting mode, as noted above. The signal is used at the receiver station to decode the transmitted radio frequency signal so as to provide a side tone monitoring signal.

In the receive condition, the transmit-receive relay K202 of FIG. 13 applies the 140 kilocycle automatic frequency control signal to the astable multivibrator 572 to change the frequency of the multivibrator to 140 kilocycles, and this relay removes the frequency modulated audio subcarrier from that multivibrator. Similarly, the bias is removed from the "and" gate 582 and applied to the "and" gate 586 by the relay K202 in the receive condition, so that the "and" gate 582 is disabled and the "and" gate 586 is enabled.

In the receive condition of the system, as in the transmit condition, the flip-flops F and G produce rectangular wave forms. In the receive condition, the flip-flop F produces an unmodulated delayed decoding signal term, while the flip-flop G produces an undelayed decoding signal term modulated by a 140 kilocycle signal. During this receive condition, and as mentioned above, the coder mixer 600 receives the signal F directly from the flip-flop and it receives the signal G through the "and" gate 586 and through the "or" gate 602. One output from the code mixer to the decoder in the receiving section is therefore, $F\cdot\overline{G}$ (decoding signal F) and the other is $\overline{F}\cdot G$ (decoding signal G).

To more clearly illustrate the purpose of the code mixer 600 as used in the receive mode, reference is made to the diagram of FIG. 15 which shows a receiver decoding stage. In the circuit of FIG. 15, the received coded intelligence signal is introduced as a radio frequency input to the primary winding of a transformer 620. The secondary winding of the transformer has a grounded center tap. One terminal of the secondary winding is connected to an amplifier 622 and to a gated amplifier 624. The other terminal of the secondary is connected to a gated amplifier 626 and to a gated amplifier 628. The gated amplifiers have their output terminals connected to one terminal of a resonant circuit 630, the other terminal of which is grounded. An output terminal 632 is also connected to the ungrounded terminal of the resonant circuit 630.

The term F is introduced to the gated amplifier 624 to gate that amplifier on when that term is true. Likewise, the term $\overline{G}$ is introduced to the gated amplifier 622 to turn that amplifier on when the term G is true. The term $\overline{G}$ in like manner gates the amplifier 626 on; and the term $\overline{F}$ in like manner gates the amplifier 628 on.

The circuit of FIG. 15 consists of two balanced modulators in parallel. The gated amplifiers 622 and 626 produce an output signal which may be designated as an "in phase" signal when the term G is true, and these amplifiers produce an output signal which may be termed an "out of phase" signal when the term $\overline{G}$ is true. In like manner, but in the opposite sense, the gated amplifiers 624 and 628 produce an output signal which may be designated "in phase" when the term $\overline{F}$ is true, and they produce an output signal which may be designated "out of phase" when the term F is true.

If "1" is used to designate "true" and "0" is used to designate false, and if (+) is used to designate in phase and (−) is used to designate out of phase, the output of the receiver decoding station of FIG. 15, as a function of the terms F and G may be summarized as follows:

| F | G | Output |
|---|---|---|
| 1 | 1 (+) and (−) | No signal |
| 1 | 0 (−) and (−) | − |
| 0 | 1 (+) and (+) | + |
| 0 | 0 (−) and (+) | No signal |

It will be recalled that two signals are to be produced at the receiving station, one derived by balance modulating the received coded intelligence signal with a delayed decoding signal and one derived by balance modulating the received signal with an undelayed decoding signal. In order to distinguish the resultant outputs, the undelayed decoding signal is modulated with the 140 kilocycle signal, as described, thus displacing the frequency bands of the balanced modulators by ∓140 kilocycles.

The receiver decoding station of FIG. 15 produces a composite output of this type, if the signal F is considered the delayed decoding signal and the signal G is considered the undelayed decoding signal. The output table set forth illustrates that the circuit of the receiver decoding station can be considerably simplified since no signal occurs for the continuation of F and G. This suggests the use of two gated amplifiers, one driven by the term $\overline{F}\cdot G$ and the other by the term $F\cdot\overline{G}$. Such a system is shown in the hybrid balanced modulated circuit of FIG. 16.

The hybrid balanced modulator 202 of FIG. 16 is a simplified schematic representation of the balanced modulator 202 described in conjunction with FIG. 16. As described in FIG. 6, the output from the first intermediate frequency amplifier 200 is introduced through the coupling capacitor C106 and across the inductance coil L105. One terminal of the inductance coil L105 is connected to a gated amplifier in FIG. 16, this amplifier being formed by the discharge tube V102 in FIG. 6. The other terminal of the inductance coil L-105 is connected to a gated amplifier 652 in FIG. 16. The latter gated amplifier is formed by the discharge tube V103 in FIG. 6. The term $\overline{F}\cdot G$ (decoding signal G) from the mixer 600 is introduced to the gated amplifier 650, and the term $F\cdot\overline{G}$ (decoding signal F) from the mixer 600 of FIG. 13 is introduced to the gated amplifier 652. The output signals from the gated amplifiers 650 and 652 are introduced to get to the tuned circuit C114, L103. These output signals are introduced to the amplifier 204 of FIG. 6.

In the circuit of FIG. 16, the decoding signals F and G will be recognized as the delayed unmodulated decoding signal and the undelayed modulated decoding signal respectively. The code mixer of FIG. 14 produces the products $F\cdot\overline{G}$ and $\overline{F}\cdot G$ for the hybrid balanced modulator to decode the received coded intelligence signal.

The components which make up the modulator 28 of the transceiver 10 of FIG. 3 are shown in block form in FIG. 17, and the circuit details of the modulator are shown in FIG. 18.

The modulator 28 includes a 60 megacycle crystal oscillator 700 which is connected to a 60 megacycle buffer amplifier 702. The buffer amplifier 702 is connected to a balanced modulator 704, which in turn is connected to a 60 megacycle wide band amplifier 706. The wide band amplifier 706 provides the 60 megacycle modulated output, and the amplifier introduces that output to the radio frequency transmitter power amplifier 32 in FIG. 3. The output of the wide band amplifier 706 is also introduced to an amplitude modulation detector 708. This detector provides an automatic gain control signal which is applied to the wide band amplifier 706 and to the buffer amplifier 702. This signal controls the gain in each of these amplifiers in known manner.

The coded intelligence signal from the coder 26 is introduced for wide band modulation to a code waveform shaper and inverter 710 by way of an input terminal 709. The network 710 introduces the coded signal to the balanced modulator 704. The audio signal from the control box 16 for narrow band uncoded modulation is introduced to an input terminal 712. This latter input terminal is connected to a coupling capacitor 713 which, in turn, is connected to a resistor 714. The resistor 714 is connected to a potentiometer 716. A resistor 718 is connected to the potentiometer 716 and to the amplitude modulation detector 708. The potentiometer 716 serves as a modulation control. The armature of the potentiometer 716 is connected to an audio amplifier 720, and the audio amplifier is connected to the balanced modulator 704 for narrow band modulation.

As illustrated in the block diagram of FIG. 17, the modulator 28 supplies a low level 60 megacycle modulated signal to the transmitter power amplifier 32. This 60 megacycle signal is amplitude modulated for narrow band uncoded transmission, or it may be balanced modulated for wide band coded transmission. Distortion in the narrow band mode is minimized by modulation with an amplitude difference signal which results from a comparison of the modulated output signal with the audio input signal, as will be described in conjunction with the circuit diagram of FIG. 18.

The crystal oscillator 700, as shown in FIG. 18, includes a triode V400 and a triode V401. The control grid of the triode V400 is connected to a grounded resistor R401 and to a coupling capacitor C400, the coupling capacitor being connected to the anode of the triode V401. The anode of the triode V400 is connected to a resistor R405 and to a grounded capacitor C403. The resistor R405 is also connected to the positive terminal B+ of a source of direct voltage. The cathode of the triode V400 is connected to an inductance coil L401 and to a crystal Y401. The inductance coil L401 is connected to a grounded resistor R402.

The crystal Y401 is connected to the cathode of the triode V401 and to an inductance coil L402. The crystal Y401 is shunted by a variable inductance coil L403, and the inductance coil L402 is connected to a grounded resistor R403. The anode of the triode V401 is connected to a variable inductance coil L404, the inductance coil being shunted by a capacitor C402 to form a tuned circuit. The tuned circuit is connected to the anode of the triode V400. The control grid of the triode V401 is connected to a grounded resistor R404.

The anode of the triode V401 is also connected to a coupling capacitor C401, and the coupling capacitor is connected to the control grid of a pentode V402 in the 60 megacycle buffer amplifier 702. The control grid of the pentode is connected to a resistor R406 which, in turn, is connected to the junction of a resistor R419 and a grounded capacitor C444. The resistor R419 is connected to the AGC lead of the receiver.

The cathode of the tube 402 is connected to a grounded resistor R407 which is shunted by a capacitor C405. The screen grid of the tube V402 is connected to a grounded capacitor C406 and to a resistor R408. The control grid of the tube V402 is grounded, and the anode of that tube is connected to the junction of a capacitor C407 and an inductance coil L405. The capacitor C407 is grounded and the inductance coil L405 is connected to the junctions of a resistor R409 and a pair of capacitors C408 and C409. The resistors R408 and R409 are connected to the positive terminal B+ and the capacitor C409 is grounded. The capacitor C408 is connected to a variable inductance coil L406 in the balanced modulator 704.

The capacitor C408 is also connected to a resistor R410, which is in turn connected to a grounded resistor R411. The resistor R411 is shunted by a capacitor C410. The other terminal of the inductance coil L406 is connected to a resistor R412, and that resistor is connected to the junction of the resistors R410 and R411.

The inductance coil L406 is connected to the control grid of a pentode V403, and to the control grid of a pentode V404. This inductance coil is shunted by a split-stator variable capacitor C411. The rotor of the capacitor C411 is connected to the armature of a potentiometer R414. A resistor R413 is connected to that potentiometer and to the cathode of a pentode V403. A resistor R415 is also connected to the potentiometer R414, and the latter resistor is further connected to the cathode of the pentode V404. These cathodes are connected to a pair of grounded capacitors C411 and C412, respectively.

The pentodes V403 and V404 are both connected to a grounded capacitor C414 and to a resistor R416. The anodes of these pentodes are connected together and to a variable inductance coil L407. The inductance coil L407 is connected to the junction of a resistor R417 and to a grounded capacitor C417. The anodes are also connected to a grounded capacitor C416 and to a coupling capacitor C418. The resistors R416 and R417 are connected to the positive terminal B+ of the source of direct voltage. The suppressor grid of the pentode V403 is connected to a grounded capacitor C413, and the suppressor grid of the pentode V404 is connected to a grounded capacitor C415. The coupling capacitor C418 is connected to the control grid of a pentode V415. This latter pentode is connected to form the 60 megacycle wide band amplifier 706. The control grid of that pentode is also connected to a resistor R418 to an inductance coil L418 and to a capacitor C419. These elements are connected together and to the automatic gain control lead. The automatic gain control lead is connected to a terminal R of the receive-transmit relay K202. The corresponding armature of the relay is connected to the negative terminal of an 18 volt direct voltage source. The armature closes with the contact R when the relay is in the receive condition. This introduces a blocking voltage to the amplifier stages of the modulator when the system is in that condition.

The cathode of the tube V405 is connected to a grounded resistor R420, which is shunted by a capacitor C420. The screen grid of the tube V405 is connected to a grounded capacitor C421 and to a resistor R421, the resistor being connected to the positive terminal B+ of the direct voltage source. The suppressor grid of the tube V405 is grounded, and the anode of the tube is connected to the primary of an output transformer T401. The primary of this transformer is shunted by a capacitor C422, and the other terminal of the primary is connected to the junctions of a resistor R422 and a grounded capacitor C424. The resistor R422 is connected to the positive terminal B+ of the direct voltage source. The secondary of the output transformer T401 is connected to the output terminal T707. This output terminal is connected to the transmitter power amplifier 32 in FIG. 3, as mentioned in conjunction with FIG. 17. The secondary winding of the transformer T401 is shunted by a grounded capacitor C425.

The anode of the pentode V405 is also connected to a coupling capacitor C246. This coupling capacitor is connected to the junction of a diode CR405 and an inductance coil L412 in the amplitude modulation detector 708. The inductance coil L412 is connected to the junction of a resistor R435 and a grounded capacitor C435. The resistor R435 is connected to the junction of a resistor R436 and a grounded capacitor C434. The resistor R436 is connected to the junction of a grounded resistor R434 and a grounded capacitor C433, this junction being connected to the automatic gain control lead of the modulator. The resistor 718 in FIG. 17 is connected to the junction of the resistor R435 and R436, and the armature of the potentiometer 716 is connected to a coupling capacitor C440.

The coupling capacitor C440 is connected to the base of a transistor Q404 in the audio amplifier 720. The emitter of the transistor Q404 is connected to a grounded resistor R441 which is shunted by a capacitor C439. The base of the transistor is connected to the junction of a resistor R442 and a grounded resistor R443. The collector of the transistor is connected to the junction of a resistor R440 and a capacitor C438. The resistors R440 and R442 are both connected to the negative terminal of the 18 volt direct voltage source.

The audio amplifier 720 includes a second transistor Q405. The collector of the transistor Q404 is coupled to the base of the transistor Q405 by a coupling capacitor C438. The base of the transistor Q405 is connected to a resistor R438, and the collector of the transistor Q405 is connected to a resistor R436. Both the resistors R436 and R438 are connected to the negative terminal of the 18 volt direct voltage source.

The emitter of the transistor Q405 is connected to a grounded resistor R437, this resistor being shunted by a capacitor C437. The collector of the transistor Q405 is connected to a coupling capacitor C436. This coupling capacitor C436 is connected to the junction of the resistors R411 and R412 at the input of the balanced modulator 704, and the capacitor C436 is also connected to a normally open contact 1 of the wide band/narrow band relay K102. Both the transistors Q404 and Q405 may be of the PNP type. The relay K102 has a grounded armature 2 associated with the normally open contact 1. A normally closed contact 3 is also associated with the armature 2, the latter contact being connected to the suppressor grid of the pentode V404. The normally closed contact 3 is also connected to the coupling capacitor C432 and the anode of a diode CR402.

The diode CR402 is shunted by a grounded resistor R431. The relay K102 includes a further normally closed contact 4 which is connected to the negative terminal of the 18 volt direct voltage source. The relay includes an armature 5 which is associated with the normally closed contact 4 and which is connected to the suppressor grid of the balanced modulator tube V403, to the anode of a diode CR404 and to a capacitor C433. The diode CR404 is shunted by a grounded resistor R432.

The wide band/narrow band control signal from the control box 16 in FIG. 3 is introduced to an input terminal 722. The input terminal 722 is connected to the energizing coil of the relay K102, the other terminal of that coil being connected to the positive terminal of a 27 volt direct voltage source. The code input from the coder 26 is applied to an input terminal 724. This input terminal is connected to a coupling capacitor C431 which, in turn, is connected to the base of a transistor Q401 and to the anode of a diode 726. The cathode of the diode 726 is connected to the armature of a potentiometer R424. This potentiometer is connected to the positive terminal of the 18 volt direct voltage source and to a resistor R425. The resistor R425 is connected to a resistor R426 which, in turn, is connected to a grounded resistor R427. A Zener diode CR403 has its anode connected to the junction of the resistors R426 and R427, and the cathode of the Zener diode CR403 is grounded. This junction of the resistors R426 and R427 is also connected to the base of a transistor Q403. The emitter of the transistor Q403 is connected to a resistor R428 which, in turn, is connected to the positive terminal of the 18 volt direct voltage source. The collector of the transistor Q403 is connected to the emitter of a transistor Q402 and to the emitter of the transistor Q401. All of the transistors may be of the PNP type.

The transistors Q401 and Q402 are connected as a differential amplifier. The transistor Q403 and the Zener diode CR403 are connected as a constant current source. The base of the transistor Q402 is grounded. The collector of that transistor is connected to the junction of an inductance coil L411 and a capacitor C433. The capacitor C433 is connected to a grounded resistor R432 and to the anode of the diode CR404. The inductance coil L411 is connected to a resistor R429, and the resistor is connected to the negative terminal of the 18 volt direct voltage source. The collector of the transistor Q401 is connected to the junction of a resistor R430 and the capacitor C432. The resistor R430 is connected to an inductance coil L401 which, in turn, is connected to the negative terminal of the 18 volt direct voltage source.

Reference will now be made to the circuit diagram of FIG. 18 for a more complete description of the modulator system. The 60 megacycle carrier frequency is generated by the crystal oscillator 700. The oscillator includes the triodes V400 and V401, and the oscillator frequency is stabilized by the crystal Y401. The crystal Y401 oscillates in series resistance at a third harmonic. The oscillator is a type of oscillator circuit normally referred to as a Butler oscillator. The crystal may be temperature stabilized in an oven held, for example, at 79° Centigrade. The pentode V402 is connected to form the 60 megacycle buffer amplifier 702 between the oscillator 700 and the balanced modulator 704.

For the wide band mode of modulation, the input signal to the control grid of each of the pentodes V403 and V404 of the balanced modulator 704 can be equalized by varying the differential variable capacitor C411. The gain of the balanced modulator can be equalized by adjusting the differential cathode bias potentiometer R414. The coupling capacitor C408 is used to couple the output tuned circuit L404, C407 and C409 of the amplifier pentode V402 to the tuned input circuit L406, C411 of the balanced modulator. Wide band modulation is realized by applying the code signal in push-pull to the suppressor grids of the pentodes V403 and V404 of the balanced modulators 704. Phase inversion and square wave shape is obtained in the differential transistor amplifier circuits of the transistors Q401 and Q402. The emitter of both these transistors are returned to the collector of the transistors Q403 which, as mentioned above, is connected to constitute a constant current source. The base of the constant current source transistor Q403 is held at a constant forward bias of 5.2 volts by the Zener diode CR403. Any variation in the current through the resistor R428 changes the base-emitter bias of the transistor Q403 in a direction in counteract any such change in current through the resistor R428.

The diode CR401, together with the potentiometer R424, act as a symmetry control for the wave form of the code signal. The diodes CR402 and CR404 are clamping diodes which cause the code pulses to drive the suppressor grids of the pentodes V403 and V404 in the balanced modulator 704 in a negative direction with respect to ground.

The pentode V405 forms the 60 megacycle wide band amplifier 706 for the output signal from the balanced modulator 704. Both the input and output circuits of the wide band amplifier 706 exhibit band-pass characteristics of the order, for example, of 10 megacycles. The input coupling circuit comprising the inductance coils L407, L408 and the capacitors C416, C419 is an overcoupled, double-tuned circuit. This circuit includes a small coupling capacitor C418 and a suitable damping resistor R418. The output circuit of the transformer T401, on the other hand, consists of two overcoupled circuits in which the impedance of the secondary winding is matched to a 90 ohm terminated transmission line.

Wide band modulation, as described above, is accomplished by applying the modulated code signal to the suppressor grids of the balanced modulator pentodes V403 and V404 in the balanced modulator 704. This is effectuated when the wide band/narrow band relay K102 is in its energized state. When the relay K102 is de-energized, however, the audio voltage is applied to the control grids of the modulator pentodes V403 and V404 for narrow band uncoded transmission.

For the narrow band uncoded transmission, the pentode V403 is made inoperative by the relay K102, which now places a negative voltage on its suppressor grid. The suppressor grid of the tube V404 is grounded at this time by the relay K102 to prevent any code modulation from being introduced into the electron stream of the tube.

To minimize distortion during the narrow band mode of transmission, the modulated output signal from the pentode V405 of the wide band amplifier 706 is demodulated in the detector circuit 708 of the diode CR406. The resulting modulated signal is compared with the incoming audio signal across the resistors R449, R446 and across the potentiometer R445. The resulting difference signal is amplified in a high gain amplifier consisting of the transistors Q404 and Q405, and the amplified signal is then applied to the control grid of the active modulator pentode V404.

The output signal from the balanced modulator 704 is amplified by the detector circuit 708 described above. This detector provides an automatic gain control (AGC) voltage, as well as the audio signal mentioned in the preceding paragraph. The automatic gain control voltage is derived across the resistance-capacitance network of the resistance R434 and the capacitor C432. The automatic gain control voltage is then applied to the control grids of the pentodes V402 and V405 in the amplifiers 702 and 706.

The audio voltage from the detector circuit 708, and the audio input signal from the controller box 16, are combined in the difference networks 714, 716 and 718, as mentioned above. The resulting difference signal is amplified in the circuits of the transistors Q404 and Q405. The percent modulation can be controlled by adjusting the armature of the potentiometer 716. As the armature is moved down, more input audio signal and less demodulated output signal is applied to the pentode V404 and the percent modulation is increased. Since the audio amplifier of the transistors Q404 and Q405 has high gain, any slight deviation of the demodulated output signal from the input signals will be amplified, and this will result in a large reduction in distortion.

When the system is switched to the receive condition, the relay contacts K202 cause the automatic gain control lead to be connected to the negative terminal of the 28 volt direct voltage source. This causes both the amplifier tubes V402 and V405 to be rendered nonconductive. When the system is in the receive mode of operation, the radio frequency unit 12 of FIG. 3 introduces the received coded intelligence signal to the receiver 30 in the transducer unit 10. The received signal is heterodyned from an ultra-high frequency to an intermediate frequency of 60 megacycles in the radio frequency unit 12. During the transmission mode, the radio frequency unit causes the 60 megacycle coded intelligence signal to be heterodyned to an ultra-high frequency signal having sufficient power for transmission.

As described previously, the radio frequency unit 12 of FIG. 3 includes the transmitter power amplifier 32, the radio frequency receiver-amplifier 34 and the frequency generator 36. The transmitter power amplifier 32 converts the 60 megacycle signal, which is modulated either with the wide band coded intelligence or with the narrow band uncoded intelligence, to a radio frequency signal at a power level which is selected by the operator at the control box 160 of FIG. 3. The radio frequency receiver-amplifier 34, on the other hand, converts the received coded intelligence signal to a frequency centered at 60 megacycles for the receiver 30 in the transceiver 10 of FIG. 3. As noted above, the frequency generator 36 serves as a local oscillator for both the transmitter power amplifier 32 and the radio amplifier 34. The transmitter power amplifier 32 includes (as shown in the block diagram of FIG. 19) a balanced modulator 1000, an intermediate power amplifier 1002, a final amplifier 1004, and an attenuator 1006.

The balanced modulator 1000 acts as a mixer to produce a radio frequency signal, this latter signal ranging from 225–440 megacycles. The intermediate power amplifier 1002 and the final power amplifier 1004 are pretuned for a selected 15 megacycle bandwidth within the range extending from 225 megacycles to 400 megacycles. The frequency generator 36 produces any one of the 10 frequencies, and this generator is controlled by a channel selector control in the control box 16. Any ten channels of, for example, fifty available channels may be pre-selected by inserting the proper crystals into the frequency generator 36. The output of the balanced modulator 1000 is of the order of 0.5 watts, for example, and this output is amplified to 3 watts, for example, by the intermediate power amplifier 1002. The final amplifier 1004 is capable, for example, of developing a 20 watt output signal, and it is coupled to the attenuator 1006. The attenuator is coupled through the contacts of the transmit-receive relay K202 to the antenna 38 of the system, and the radiated output signal may be attenuated, by reducing the output of the final amplifier 1004 or by reducing the output of the attenuator 1006.

A bandwidth of 15 megacycles may be obtained, for example, by the use of 3 tuned circuits. The balanced modulator 1000 has a single tuned circuit with a quality factor (Q) of, for example, 15. The intermediate power amplifier 1002 is a special over-coupled synchronously tuned circuit having a double peak frequency response curve. The final amplifier 1004 is a loaded single-tuned circuit with an effective quality factor (Q) of, for example, 15.

The radio frequency receiver-amplifier 34 of the radio frequency unit 12 is illustrated in the simplified diagram of FIG. 20. As illustrated in that diagram, the antenna 38 of the system is coupled through the contacts of the transmit-receive relay K202 and through a wave guide section 1010 to appropriate circuitry, the circuitry being coupled to the cathode of a high frequency triode 1012. The triode 1012 is connected in normal manner in a wave guide section to constitute a radio frequency amplifier stage, and the anode of the triode 1012 is coupled to the cathode of a triode 1014. The latter triode is also included in a wave guide section, and the latter section also serves as a mixer circuit for the local oscillator signal from the frequency generator 36.

The resulting intermediate frequency output signal is introduced to the cathode of a grounded grid amplifier stage which includes a triode 1016. The anode of the triode 1016 is coupled to a resonant output circuit 1017, and that output circuit may be coupled in any appropriate manner to the input circuitry of the receiver 30 of FIG. 3. The radio frequency receiver-amplifier 34 of FIG. 20 is a triple tuned circuit with two stages of radio frequency amplification and a mixer stage, as described above. The resonant wave guide circuits are tuned in a normal manner by sliding plungers. These plungers are insulated by dielectric material from the walls of the corresponding wave guide sections. This provides a comparatively simple circuit, and it eliminates the problems incurred by the sliding contacts in the presence of low level ultra-high frequency signals. The mixer of the triode 1014 produces a 60 megacycle signal which is fed through the grounded grid amplifier of the triode 1016 to the transceiver 10 of FIG. 3.

A block diagram of the frequency generator 36 in the radio frequency unit 12 is shown in FIG. 21. The frequency generator includes a channel oscillator 1020 which is coupled to a channel mixer 1022 and to a clipper circuit 1024, the clipper circuit also being coupled to the channel mixer. The channel mixer 1022 is connected to a 10-crystal selector unit 1026, the armature of that unit being connected to a band mixer 1028. The band mixer 1028 is interposed between a band oscillator 1030 and an amplifier 1032. The amplifier 1032 is coupled to a "times eight" multiplier 1034 and the multiplier is coupled to an amplifier 1036. The output of the amplifier 1036 is coupled to the radio frequency receiver-amplifier 34 or to the transmitter power amplifier 32, as described above. The channel frequencies are obtained in the channel oscillator 1020 by a stable crystal controlled oscillator at, for example, 5 megacycles, which phase locks with a 12.5 kilocycle oscillator. The output of the channel mixer 1022 contains modulation products of the 5 megacycle signal and harmonics of the phase-interlocked signal. There are 50 available frequencies from 5 megacycles to 5.6125 megacycles, and these are available in steps of 0.125 megacycles. The desired frequency is selected by a crystal filter in the selector 1026, ten of these filters being plugged into the selector so as to provide a ten-channel selection.

The band oscillator 1030 provides a pre-established signal frequency, and this signal is mixed in the band mixer 1028 with the selected channel frequency. The sum of the two signal frequencies is selected in the band mixer 1028. After mixing in the band mixer, the resultant frequency is 20.625 megacycles and this frequency is then amplified in the amplifier 1032 and frequency multiplied in the multiplier 1034. This results, for example, in a final frequency of 165 megacycles. The latter output signal is amplified in the amplifier 1036, and it is then fed to the radio frequency receiver-amplifier 34 or to the transmitter power amplifier 32 in the radio frequency unit 12 of FIG. 3.

The circuitry for the multiplier 1034 is illustrated in FIG. 2. This circuitry includes a "times four" multiplier which, in turn, includes a pair of triodes 1050 and 1052. The circuitry also includes a "times two" multiplier which, in turn, includes a pair of pentodes 1054 and 1056. The output signal from the amplifier 1032 is introduced to a pair of input terminals 1058, these input terminals being connected to the primary of a transformer 1060. The secondary of the transformer is connected to the control grids of the triodes 1050 and 1052, respectively. A pair of capacitors 1062 and 1064 are connected across the secondary of the transformer; and the common junction of these capacitors is grounded, as are the cathodes of the triodes 1050 and 1052.

The anodes of the triodes 1050 and 1052 are connected together and to the primary of a transformer 1066. The other triode of the primary is connected to the positive terminal B+. The secondary of the transformer 1066 is connected to the control grids of the tubes 1054 and 1056. The center tap of the secondary of the transformer is connected to grounded resistors 1068. A pair of capacitors 1070 and 1072 are connected across the secondary. The common junction of these capacitors is grounded and the cathodes of the tubes 1054 and 1056 are also grounded. The output signal from the tubes 1054 and 1056 is introduced through a capacitor 1074 to the primary winding of an output transformer 1076. The primary winding is grounded, and a capacitor 1078 is shunted across the winding. The secondary of the transformer 1076 is connected to the amplifier 1036 of FIG. 21.

The "times four" multiplier circuit of the triodes 1050 and 1052 responds to the input signal introduced to the terminal 1054 to generate harmonics of that signal. The circuit associated with the transformer 1066 selects the fourth harmonic of the signal from the "times four" multiplier, and it introduces that harmonic to the circuitry of the pentodes 1054 and 1056. The capacitor 1074 is tuned so that the second harmonic of the output signal from the latter circuit is selected by the output circuit and that harmonic is introduced to the amplifier 1036. The signal applied to the amplifier 1036, therefore, has a frequency which is eight times the frequency of the signal from the amplifier 1032.

The circuit details of the range counter 14 are set out in FIGS. 23A and 23B. The range counter includes control circuitry which is shown in FIG. 23A. This control circuitry responds to the input signals $I\phi$ and $\overline{Oe}$. The term I is introduced to an input terminal 1100, the term $\overline{\phi}$ is introduced to an input terminal 1102 and the term $\overline{Oe}$ is introduced to an input terminal 1104.

The input terminal 1100 is connected to a resistor R605 which may have a resistance of 1 kilo ohm. The resistor R605 is connected to the base of a transistor Q601 and to a resistor R603. The transistor Q601 may be of the type presently designated Ph2N495. The resistor R603 may have a resistance of 15 kilo ohms, and it is connected to the positive terminal of the 18 volt direct voltage source.

The transistor Q601 has a grounded emitter, and the collector of that transistor is connected to a lead designated E. This lead is connected to a resistor R604 which may have a resistance of 1 kilo ohm and which is connected to the negative terminal of the 18 volt direct voltage source. The lead E is also connected to a resistor R602, and that resistor is connected to a resistor R601. Each of the resistors R601 and R602 may have a resistance of 3.3 kilo ohms, and the resistor R601 is connected to the positive terminal of the 18 volt direct voltage source. The junction of the resistor R601 and R602 is connected to the cathode of a diode CR601. The anode of that diode is connected to the anode of a diode CR602 and to the anode of a diode CR603.

The input terminal 1102 is connected to the cathode of the diode CR602, and the anodes of the diodes CR601, CR602 and CR603 are connected to a resistor R607. The resistor may have a resistance of 1 kilo ohm, and it is connected to the positive terminal of the 18 volt direct voltage source. The cathode of the diode CR603 is connected to a resistor R610 and to the base of a transistor Q602. The resistor R610 may have a resistance of 1 kilo ohm and it is connected to a resistor R609. The latter resistor may have a resistance of 2.4 kilo ohms, and it is connected to the negative terminal of the 18 volt direct voltage source.

The transistor Q602 may also be of the type designated Ph2N495. That transistor is connected to a resistor R613, and its emitter is connected to a resistor R614. The resistor R613 may have a resistance of 2.4 kilo ohms, and the resistor R614 may have a resistance of 1 kilo ohm. Both of these resistors are connected to the positive terminal of the 18 volt direct voltage source. The collector of the transistor Q602 is connected to a resistor R611 and to a resistor R608. The resistor R611 may have a resistance of 1 kilo ohm, and it is connected to the base of a transistor Q603. The resistor R608 may have a resistance of 2.4 kilo ohms, and it is connected to the negative terminal of the 18 volt direct voltage source.

The transistor Q603 may also be of the type designated Ph2N495. The base of that transistor is connected to a resistor R615, and that resistor may have a resistance of 2.4 kilo ohms and be connected to the positive terminal of the 18 volt direct voltage source. The collector of the transistor Q603 is also connected to a capacitor C602, and the capacitor may have a capacity of 0.01 microfarads. The capacitor C602 is connected to a lead designated "D". This lead is connected to a resistor R612 and to the cathode of a diode 615. The resistor R612 may have a resistance of 10 kilo ohms and, together with the anode of the diode CR605, is connected to the negative terminal of a 2.5 volt direct voltage source.

The lead E is also connected to a coupling capacitor C606. This coupling capacitor is connected to a lead A which extends to an input terminal 1105 of a magnetic core counter 1106. The details of the magnetic core counter are illustrated in FIG. 23B. The capacitor C606 is also connected to a resistor R606. The resistor R606 may have a resistance of 220 ohms, and it is connected to the negative terminal of the 2 volt direct voltage source. The lead E is also connected to a coupling capacitor C604, and that capacitor may have a capacity of 0.001 microfarads. The capacitor C604 is connected to the base electrode of a transistor Q604. The transistor Q604 may also be of the type designated Ph2N495. The base of the transistor Q604 is connected to a resistor R620. The resistor R620 may have a resistance of 10 kilo ohms, and it is connected to the junction of a resistor R624 and a resistor R625. The resistor R624 has a resistance, for example, of 680 ohms, and it is connected to the positive terminal of the 18 volt direct voltage source. The resistor R625 may have a resistance of 330 ohms, and it is grounded.

The emitter of the transistor Q604 is connected to the emitter of a similar transistor Q605 and to a resistor R623. The resistor R623 may have a resistance of 430 ohms, and it is connected to the positive terminal of the 18 volt direct voltage source. The collector of the transistor Q604 is connected to a grounded resistor R619 which may have a resistance of 2.4 kilo ohms, and the collector is also connected to a similar resistor R619 and to a lead designated B. The resistor R616 is connected to the negative terminal of the 18 volt direct voltage source. The base of the transistor Q605 is connected to the cathode of a diode CR606. The anode of the diode is connected to the junction of the resistors R624 and R625. A capacitor C607 is connected to the base of the transistor Q605 and to the collector of the transistor Q604. The base of the transistor Q605 is also connected to a resistor R608 having a resistance, for example, of 560 kilo ohms. The base of the transistor Q605 is further connected to a resistor R617 having a resistance of, for example, 1.3 kilo ohms. Both the resistors R617 and R618 are connected to the negative terminal of the 18 volt direct voltage source.

The collector of the transistor Q605 is connected to a resistor R626. The resistor R626 has a resistance of 100 kilo ohms, and it is connected to the base of a transistor Q606. The transistor Q606 and the transistor Q607 may each be of the type designated Ph2N495. The base of the transistor Q606 is connected to the cathode of a diode CR607. The anode of the diode is grounded. The emitter of the transistor Q606 is connected to a resistor R627 which, in turn, is connected to the positive terminal of the 18 volt direct voltage source. The emitter of the transistor Q607 is also connected to the resistor R627. The collector of the transistor Q606 is connected to a resistor R628, and the collector of the transistor Q607 is connected to a resistor R629. Each of the resistors R628 and R627 may have resistances of 820 ohms and these resistors are connected to the negative terminal of the 18 volt direct voltage source.

A capacitor C607, having a capacity of 0.06 microfarads, is connected to the base of a transistor Q606 and to the collector of the transistor Q607. The collector of the transistor Q606 is connected to a resistor R622, and that resistor is connected to a resistor R621. The resistor R626 may have a resistance of 1 kilo ohm, and the resistor R621 may have a resistance of 2.2 kilo ohms. The latter resistor is connected to the positive terminal of the 18 volt direct voltage source. The common junction of the resistors R621 and R622 is connected to a lead designated F. The collector of the transistor Q606 is also connected to a capacitor C605 and to a capacitor C609. The capacitor C605 is connected to a grounded resistor R627 and to a lead designated C. The resistor R627 may have a resistance, for example, of 10 kilo ohms. The lead C is connected to an input terminal 1160 of the magnetic core counter 1106.

The capacitor C609 is connected to the base of the transistor Q607, and the base is also connected to the cathode of a clamping diode CR608 and to a resistor R630. The resistor may have a resistance of 100 kilo ohms, for example, and it is connected to the negative terminal of the 18 volt direct voltage source. The lead B is connected to the anode of a diode CR647. An output terminal 1163 of the magnetic core counter 1106 is connected by way of a lead H to the anode of a diode CR648. The cathodes of the diodes CR647 and CR648 are connected to the base of a transistor Q618 and to a resistor R668. The resistor R668 is connected to the negative terminal of the 18 volt direct voltage source. This resistor may have a resistance, for example, of 100 kilo ohms.

The emitter of the transistor Q618 is connected to the emitter of a transistor Q619 and to a resistor R672. The resistor R672 has a resistance of 1.8 kilo ohms, and it is connected to the positive terminal of the 18 volt direct voltage source. The collector of the transistor Q618 is connected to a resistor R669 and to a capacitor C625. The resistor R669 may have a resistance of 1.8 kilo ohms, and it is connected to the negative terminal of the 18 volt direct voltage source. The capacitor C625 has a resistance of 0.068 microfarads. The collector of the transistor Q619 is connected to a resistor R670, the resistor having a value of 1.8 kilo ohms and being connected to the negative terminal of the 18 volt direct voltage source. The base of the transistor Q619 is connected to the cathode of a diode CR649 and to a 100 kilo ohm resistor R671. The resistor is connected to the negative terminal of the 18 volt direct voltage source and the anode of the diode is grounded.

The collector of the transistor Q618 is also connected to a coupling capacitor C626. The coupling capacitor may have a capacitance of 2.2 microfarads, and it is connected to the base of a transistor Q620. The transistor Q620 is of the NPN type. Its base is connected to a grounded resistor R673 and to the cathode of a diode CR650. The anode of the diode CR650 is grounded. The resistor R673 has a resistance of 100 kilo ohms. The emitter of the transistor Q620 is connected to a grounded resistor R674 which may have a value of 100 kilo ohms. The collector of the transistor Q620 is connected to one terminal of an actuating coil K601. The actuating coil K601 is mechanically coupled to a calibrated dial 1110. Each time the transistor Q620 is pulsed, a pulse of current flows through the coil K601 to move the dial 1110 angularly from one calibrated position to the next. The dial 1110 may be calibrated in digits extending from 0 to 9, and the calibration may correspond to ten miles per digit for range measurement purposes.

Each time the dial 1110 is moved through one complete revolution, a switch actuator 1112 mounted on its periphery closes a pair of contacts 1114. One of the contacts 1114 is connected to the positive terminal of the 18 volt direct voltage source and the other is connected to one terminal of an actuating coil K602. The actuating coil K602 is mechanically coupled to a calibrated dial scale 1118, and the coil causes that scale to rotate from one digit position to the next each time the contacts 1114 are closed. This closure corresponds to each complete revolution of the dial scale 1110. The dial scale 1118 may be calibrated for range measuring purposes to represent, for example, 100 miles per digit.

The core counter 1106 has an output terminal J connected to a coupling capacitor C627. That coupling capacitor may have a value, for example, of 0.0047 microfarads, and it is connected to the base of a PNP transistor Q622. The transistor Q622, and a second similar transistor Q624, are connected to form a flip-flop 1120. The base of the transistor Q622 is connected to the junction of a pair of resistors R675 and R679. The resistor R675 may have a resistance of 1 kilo ohm, and it is connected to the collector of the transistor Q624 and to the cathode of a diode CR651. The resistor R679 may have a resistance of 2.9 kilo ohms, and it is connected to the positive terminal of the 18 volt direct voltage source.

The emitters of the transistors Q622 and Q624 are connected together and to a resistor R681. The resistor R681 may have a resistance of 1 kilo ohm, and it is connected to the positive terminal of the 18 volt direct voltage source. The base of the transistor Q624 is connected to a resistor R680 and to a resistor R683. The resistor R680 may have a resistance of 2.4 kilo ohms, and it is connected to the positive terminal of the 18 volt direct voltage source. The resistor R683 may have a resistance of 1 kilo ohm and it is connected to the collector of the transistor Q622. The collector of the transistor Q622 is further connected to a resistor R676, and the collector of the transistor Q624 is connected to a resistor R677. Each of these resistors may have a resistance of 2.4 kilo ohms, and both are connected to the negative terminal of the 18 volt direct voltage source.

The lead F is connected to the cathode of a diode CR652. The anode of that diode and the anode of the diode CR651 are connected to a resistor R696. This resistor is connected to the base of an NPN transistor Q625 and to the cathode of a diode CR653. The anode of the diode CR653 is grounded. The resistor R696 may have a resistance of 6.8 kilo ohms, and it is connected to the positive terminal of tne 18 volt direct voltage source.

The emitter of the transistor Q625 is connected to a resistor R697. This resistor may have a resistance of 68 ohms, and it is connected to ground. The collector of the transistor Q625 is connected to an actuating coil K603, the other terminal of this coil being connected to the positive terminal of the 18 volt direct voltage source. The actuating coil K603 serves to rotate a calibrated dial 1122 from one angular position to the next. This dial is calibrated in digits extending from 0 to 9, and it may be used to designate one mile per digit for range measurement purposes. The dial is stepped from one digit position to the next for each pulse received by the transistor Q627.

The magnetic core counter 1106 has an output terminal L which is connected to the input terminal of a flip-flop 1128. The circuitry of the flip-flop 1128 also may be similar to the circuitry described above of the flip-flop 1120. The flip-flop 1128 has an output terminal which is connected to the circuitry of a transistor Q628. The circuitry of the transistor Q628 may be similar to the circuitry of the transistor Q625 described above. The lead E is connected to a coupling capacitor C628 which, in turn, is connected to a second input terminal of the flip-flop 1120. This lead is also connected to a coupling capacitor C629 and C630, which are respectively connected to the input terminals of the flip-flops 1124 and 1128. Each of these capacitors may have a capacity of, for example, 0.0047 microfarads.

The collector of the transistor Q628 is connected to one terminal of an actuating coil K605, the other terminal of this coil being connected to the positive terminal of the 18 volt direct voltage source. The coil K605 is mechanically coupled to a calibrated dial scale 1130. The scale 1130 is calibrated in the digits 0, 2, 3, 5, 7 and 8; these digits being used to measure ranges of 0.01 mile per digit.

The input terminal 1104 receives the term $\overline{Oe}$, and this terminal is connected to a capacitor C608. The capacitor C608 may have a capacity of 2.2 microfarads, for example, and it is connected to the base of an NPN transistor Q608. The transistor Q608 and the NPN transistors Q620, Q625, Q627 and Q628 may be of the type designated 2N343. The base of the transistor Q608 is connected to a grounded resistor R632 which may have a value, for example, of 100 kilo ohms. The resistor R632 is shunted by a diode CR609. The collector of the transistor Q608 is connected to the energizing coil of a reset solenoid K629. The reset solenoid is mechanically coupled to the dials 1110, 1118, 1122, 1126 and 1130, and it serves to reset all the dials back to zero in response to the $\overline{Oe}$ term.

The details of the magnetic core counter 1106 are shown in FIG. 23*b*. This counter includes a plurality of magnetic memory cores which are individually capable of being set to one magnetic polarity or the other. When any particular magnetic core is set to a first magnetic polarity, it is considered to be in a state representing binary "1", and when it is set to the opposite magnetic polarity, it is assumed to be in a state corresponding to binary "0". Each of the cores remains in the state of which it was set for an indefinite period so as to perform its memory function.

The output terminal H of the magnetic core counter 1106 is connected to the junction of a resistor R638, a capacitor C613 and of a grounded resistor R639. The resistor R638 may have a resistance of 6.8 kilo ohms, and it is connected to the positive terminal of the 18 volt direct voltage source. The resistor R639 may have a resistance of 3.3 kilo ohms. The capacitor C613 has a capacity of 0.01 microfarads, for example, and it is connected to the collector of an NPN transistor Q617. This latter transistor may also be of the type designated 2N343. The emitter of the transistor Q617 is grounded, and the collector of the transistor is connected to a lead 1150 which extends to the output terminal designated J.

The collector of the transistor Q617 is also connected to a resistor R640. This resistor may have a resistance of 680 ohms, for example, and it is connected to one terminal of a coil Ax of a first magnetic memory core T604. This coil is connected in series with a plurality of similar coils A mounted on a group of three additional memory cores T605, T606 and T607, respectively. The other terminal of the coil A on the memory core T607 is connected to the positive terminal of the 18 volt direct voltage source. Each of the coils on the different memory cores is wound with a polarity indicated by the dots adjacent the respective coils.

The memory core T607 has a further coil B mounted on it. One terminal of the coil B on the memory core T607 is connected to the anode of a diode CR635. The cathod of the diode CR635 is connected to the junction of a resistor R660 and a capacitor C617. The resistor R660 may have a value of 8.20 ohms, and the capacitor C617 may have a value, for example, of 0.012 microfarads. The capacitor C617 is connected to the negative terminal of a 2.5 volt direct voltage source. The resistor R660 is connected back to the cathode of a diode CR631. The anode of the diode CR631 is connected to one terminal of a coil D supported on the memory core T604, the other terminal of this coil being connected to the negative terminal of the 2.5 volt direct voltage source.

The memory core T607 also supports a coil C. One terminal of the coil C is connected to the negative terminal of the 18 volt direct voltage source. The coil C is connected in series with similar coils C mounted on respective ones of the magnetic memory cores T604, T605 and T606. The other terminal of the coil C mounted on the memory core T604 is connected to the collector of a PNP transistor Q616.

The magnetic memory core T606 also supports a coil B. One terminal of the coil B on the memory core T606 is connected to the anode of a diode CR634, and the other terminal of that coil is connected to the negative terminal of the 2.5 volt direct voltage source. The cathode of the diode CR634 is connected to a resistor R659 and to a capacitor C616. The resistor R659 may have a resistance of 8.20 ohms, and it is connected to one terminal of a coil D on the magnetic memory core T607. The other terminal of the coil D on the memory core T607 is connected to the anode of the diode CR630. The cathode of the diode CR630 is connected to the cathode of the diode CR631. The capacitor C616 may have a capacity of 0.012 microfarads, for example, and it is connected to the negative terminal of the 2.5 volt direct voltage source. The cathode of the diode CR634 is also connected to the cathode of a diode CR613. The anode of the diode CR613 is connected to a resistor R641, which may have a resistance of 10 kilo ohms, and which is connected to the positive terminal of the 18 volt direct voltage source.

The magnetic memory core T605 includes a coil B which has one terminal connected to the anode of a diode CR633 and which has a second terminal connected to the negative terminal of the 2.5 volt direct voltage source. The memory core T606 has a coil D which is connected to a resistor R658 and to the negative terminal of the 2.5 volt direct voltage source. The resistor R658 may have a resistance of 8.20 ohms, for example, and it is connected to the cathode of the diode CR633, to the cathode of a diode CR612 and to a capacitor C615. The anode of the diode CR612 is connected to the resistances R641. The capacitor C615 may, for example, have a capacity of 0.012 microfarads.

The magnetic memory core T604 supports a coil B, which is connected to the anode of a diode CR632 and to the negative terminal of the 2.5 volt direct voltage source. The cathode of the diode CR632 is connected to the cathode of a diode CR614, and the anode of the diode CR614 is connected to the resistor R641. The cathode of the diode CR632 is also connected to a capacitor C614, which may have a capacity of 0.012 microfarads, and to resistors R657 which may have a resistance of 820 ohms. The capacitor C614 is connected to the negative terminal of the 2.5 volt direct voltage source, and the resistor R657 is connected to a coil D supported on the magnetic memory core T605. The coil D is also connected to the negative terminal of the 2.5 volt direct voltage source.

The lead C of FIG. 23A is connected to an input terminal 1160 of the magnetic core counter 1106 of FIG. 23B. This input terminal is connected in FIG. 23B to the anode of a diode CR615 and to the anode of a diode CR623. The cathode of the diode CR615 is connected to a resistor R642 of 4.7 kilo ohms. This cathode is also connected to the cathode of a diode CR617 and to the cathode of a diode 616. The resistor R642 is connected to the collector of an NPN transistor Q615, the collector of the transistor Q615 being connected to the coil A of a magnetic memory core T601. The other terminal of the coil A is connected to the positive terminal of the 18 volt direct voltage source. The emitter of the transistor Q615 is connected to a grounded resistor R643, which may have a resistance of 68 ohms.

The memory core T601 has a coil B, which is connected to ground and to the coil B of a magnetic memory core T602. The core 601 also has a coil C, which is connected to the positive terminal of the 12 volt direct voltage source and to the emitter of the transistor Q616. The base of the transistor Q616 is connected to the positive terminal of the 12 volt direct voltage source. The anode of the diode CR616 is connected to the negative terminal of the 2.5 volt direct voltage source. The anode of the diode CR617 is connected to a capacitor C612 and to a resistor R644. The capacitor may have a capacity of 0.0068 microfarads, and it is connected to the emitter of an NPN transistor Q614. The resistor R644 may have a resistance of 10 kilo ohms, and it is connected to the negative terminal of the 2.5 volt direct voltage source. The emitter of the transistor Q614 is connected to a grounded resistor R646 which may have a resistance of 220 ohms. The collector of the transistor Q614 is connected to the output terminal K of the core counter.

The cathode of the diode CR623 is connected to a resistor R648, which may have a resistance of 4.7 kilo ohms and which is connected to the base of a PNP transistor Q612. The collector of the transistor Q612 is connected to a coil A of the memory core T602, the other terminal of that coil being connected to the positive terminal of the 18 volt direct voltage source. The emitter of the transistor Q612 is connected to a grounded resistor R649 which may have a resistance of 68 ohms.

The cathode of the diode CR623 is also connected to the cathode of a diode CR625 and to the cathode of a diode CR624. The anode of the diode CR625 is connected to the negative terminal of the 2.50 volt direct voltage source. The anode of the diode CR624 is connected to a 10 kilo ohm resistor R650 and to a capacitor C613*a*. The resistor R650 is connected to the negative terminal of the 2.50 volt direct voltage source. The capacitor C613*a* may have a capacity of 0.0068 microfarads, and it is connected to the emitter of an NPN transistor Q611. The collector of the transistor Q611 is connected to the output terminal L of the core counter. The emitter of that transistor is also connected to a grounded resistor R653 having a resistance of 220 ohms.

The magnetic memory core T602 also has a coil C connected to the positive terminal of the 12 volt direct voltage source and to the emitter of a transistor Q613. The base of the transistor Q613 is connected to the positive terminal of the 12 volt direct voltage source. The lead D of FIG. 23A is connected to an input terminal 1162 of the magnetic core counter 1106 of FIG. 23B. The input terminal 1162 in FIG. 23B is connected to a resistor R654. This resistor R654 has a resistance of 4.7 kilo ohms, and it is connected to the base of an NPN transistor Q609. The emitter of the transistor Q609 is connected to a grounded resistor R655, and the resistor R655 may have a resistance of 68 ohms. The collector of the transistor Q609 is connected to the coil A of a memory core Q603. The other terminal of the coil A of that memory core is connected to the positive terminal of the 18 volt direct voltage source.

The memory core T603 has a coil B, which is connected to the coil B of the memory core T602 and to a resistor R656. The resistor R656 may have a resistance of 3 kilo ohms, and it is connected to the positive terminal of the 18 volt direct voltage source. The memory core T603 also has a coil C, which is connected to the positive terminal of the 12 volt direct voltage source and to the emitter of a PNP transistor Q610. The base of the transistor Q610 is connected to the positive terminal of the 12 volt direct voltage source.

A further group of memory cores T608, T609, T610 and T611 are connected together in the same manner as the cores T604, T605, T606 and T607. The cores of the group T608–T611 are connected back to the respective cathodes of a group of diodes CR620, CR621 and CR622, which correspond respectively to the diodes CR612, CR613 and CR614 described above. The input terminal A is connected to the anode of a diode CR618 and the anodes of the diodes CR620, CR621 and CR622 are connected to the anode of a diode CR618. The cathodes of the diodes CR618 and CR619 are connected together and to the base of the transistor Q614. The anode of the diode CR618 is also connected to a resistor R647. This resistor may have a resistance of 10 kilo ohms, and it is connected to the positive terminal of the 18 volt direct voltage source.

The core counter 1106 includes a further group of 3 magnetic memory cores T612, T613 and T614. The core T612 has a coil A mounted on it, and this coil is connected in series with a further pair of coils A mounted on the memory cores T613 and T614, respectively. The coil A of the memory core T612 is also connected to a resistor R654, which may have a resistance of 650 ohms, and which is connected back to the collector of the transistor Q611. The coil A on the core T614 has its other terminal connected to the positive terminal of the 18 volt direct voltage source.

The memory core T612 includes a coil B which is connected to the anode of a diode CR632*a* and to the negative terminal of the 2.5 volt direct voltage source. The cathode of the diode CR632*a* is also connected to the cathode of a diode CR629, and the resistor R675*a* is connected to a coil D of the memory core T613. The other terminal of the latter coil is also connected to the negative terminal of the 2.5 volt direct voltage source. The core T613 includes a coil B which is connected to the anode of a diode CR633*a* and to the negative terminal of the 2.5 volt direct voltage source. The cathode of the diode CR633*a* is connected to a resistor R658*a* and to a capacitor C615*a*. The cathode of the diode CR633*a* is also connected to the cathode of a diode CR628. The resistor R658*a* may have a resistance of 820 ohms, for example, and it is connected to one terminal of a coil D of the memory core T614. The capacitor C615*a* may have a capacity of 0.012 microfarads and it is connected to the negative terminal of the 2.5 volt direct voltage source.

The coil D of the memory core T614 is connected back to the anode of a diode CR630*a*. The cathode of the diode CR630*a* is connected to a coil D of the memory core T612. The other terminal of the coil D is connected to the negative terminal of the 2.5 volt direct voltage source. The memory core T614 includes a coil B which is connected to the anode of a diode CR646 and to the negative terminal of the 2.5 volt direct voltage source. The cathode of the diode CR646 is connected to the junction of a resistor R667 and of a grounded capacitor C624. The capacitor C624 may have a capacitor of 0.012 microfarads. The resistor R667 may have a resistance of 820 ohms, and it is connected to the anode of a diode CR631*a*; the cathode of the diode CR631*a* being connected to the winding D of the memory core T612. The memory cores T612, T613 and T614 each have a coil D, and these latter coils are connected in series between the collector of the transistor Q610 and the negative terminal of the 18 volt direct voltage source.

The purpose of the range counter 14 of FIGS. 23A and 23B is, as mentioned above, to determine the distance of an interrogating station from a responding station, and this is accomplished to the nearest 1/100th of a mile in the illustrated embodiment. The range counter includes the electronic memory core counting circuitry of FIG. 23B as described above, and it also includes the calibrated display dials 1110, 1118, 1122, 1126 and 1130, which have also been described. The ranges are indicated by the counter on the mechanical display dials of FIG. 23A to a maximum range of 999.99 miles.

The input to the counting circuits is the output of the phase detector, and the clock frequency in the illustrated embodiment is chosen so that, when the interrogator coder is in its searching mode, one cycle from the phase detector is exactly equal to 1/60th of a mile in range. When interrogating, the output of the phase detector is a 5 kilocycle sine wave. The counting circuits receive the incoming pulses at the 5 kilocycle rate, and then process them out to the mechanical display dials 1110, 1118, 1122, 1126 and 1130 at about a 10 cycle rate.

Basically, the magnetic core counter of FIG. 23B is divided into decades, with the exception that the first countdown is by six, this first countdown being carried out by the magnetic memory cores T612, T613 and T614. A 60th of a mile is counted as the basic unit on the first calibrated display dial 1130. However, the dial 1130 for this first count will have a decimal indication reading to the nearest 1/100th of a mile. The output from the first six-unit decade counter circuit section (T606–T611) is at an 0.833 cycle rate, this rate being 1/6th of the 5 kilocycle frequency of the output signal from the phase detector. The second decade section (T604–T607) counts by ten and gives an output at an 8.33 cycle rate. Since an 8.33 cycle rate can be followed by a mechanical counting unit, no further electronic decades are used after the section T604–T607. Instead, the calibrated dials 1110 and 1118 which indicate the ten mile and hundred mile per digit ranges, respectively, are actuated directly from the output signal of the third decade T604–T607.

When the interrogator has locked onto the responder, the count is complete. Now, the ten mile per digit indicator dial 1100 and the hundred mile per digit indicator dial 1118 are properly set. However, no display has yet been made on the 0.01 mile per digit indicator dial 1130 or on the 0.1 mile per digit indicator dial 1126, or on the one mile per digit indicator dial 1112. At this time, a sequence of pulses at a 10 cycle rate is fed to each of the three counter signals simultaneously causing each section to count to its final position.

Each pulse that a counter section counts causes the corresponding indicator dial to move back one digit from zero. When it has been determined that the count in a particular counter section has reached the final count for that section, no more pulses are introduced to its corresponding indicator dial. This means that if the count in a particular counter section is, for example, "6" at the completion of the interrogation, the first of the succeeding pulses makes that counter section count from 6 to 7, and at the same time ratchets its indicator dial from zero back to 9. The second pulse causes the particular counter section to go from 7 to 8, and the corresponding indicator dial is actuated from 9 to 8. The third pulse causes the particular counter section to go from 8 to 9, and it causes the corresponding indicator dial to go from 8 to 7; and the fourth pulse causes the particular counter section to go from 9 to 0 (actually 10) and this pulse actuates the corresponding indicator dial from 7 back to 6. At this time, no more pulses will be delivered to the corresponding indicator dial; and the correct count will be indicated, that is, the count of 6.

Instead of being marked "0–9", the 0.01 mile digit indicator dial 1130 is marked 0, 2, 3, 5, 7 and 8 (as noted), these digits being needed to correspond to the nearest 60th of a mile increment.

The counter made up by the group of cores T604, T605, T606 and T607 in FIG. 23B has a reset condition, as established by the coils A, in which the coils T604, T605, and T606 are set to the binary "0" condition and the core T607 is set to the binary "1" condition. This is established by the polarities of the windings A, and these polarities set the cores T604, T605 and T606 in the negative portion of their respective B-H loops, and set the core T607 in the positive portion of its B-H loop. The counting register formed by the cores T604, T605, T606 and T607 has the property that a "1" will shift from core to core. The states of the 10 digit counter formed by these cores pass through the following configurations: 0001, 1000, 0100, 0010, 1001, 1100, 0110, 1011, 1101 and 1110. The state 1110 is the last of the counter and that state causes the coincident gate comprising the diodes CR612, CR613 and CR614 to feed a signal to the transistor Q617 which resets the four magnetic cores T604–T607 to the 0001 state again.

The counter formed by the cores T608–T611 may be identical to the counter formed by the cores T604–T607. The counter of the cores T608–T611 also may be triggered from an initial 0001 state through nine successive states. When the counter formed by the cores T608–T611 reaches its final state, the diodes CR620, CR621 and CR622 become conductive to cause the transistor Q614 to reset that counter.

The initial countdown by six in the counter of the cores T612, T613 and T614 is carried out by these cores passing through the states 001, 100, 010, 101 and 110. The rules for the countdown by six are identical to the rules for the countdown by 10, with the exception that only the three magnetic cores T612–T614 are required. The final countdown is identified by the coincident gate formed by the diodes CR628 and CR629. These diodes introduce a signal to the transistor Q611 to reset the counter, and they also provide an output signal to the terminal 11. In like manner, the final countdown of the counter T604–T607 provide an output signal at the terminal J, and the final countdown of the counter T608–T611 provides a signal at the output terminal K.

The construction of the magnetic core shifting units of the type illustrated in FIG. 23B is known to the art. A suitable material for the magnetic memory cores is MO-Permalloy 4–79. These cores may be provided with seventeen wraps of ⅛th mil material, wound on a ceramic bobbin protected by a Mylar protective wrap.

The shape of the shifting pulse is determined by the magnetic core T603. This core is driven by the transistor Q609 which responds to the signals from the lead D extending from FIG. 23A. The switching time from the core T603 determines the pulse width which is to be applied as a first pulse. When the transistor Q609 is driven into conduction by a pulse, the memory core T603 switches from one flux state to the other, and a fluctuation is produced across the output winding at a high current level of, for example, 100 milliamperes. This current drives the transistor Q610 in the grounded base configuration, and it produces a shift pulse of 80 milliamperes in the windings C of the memory cores T612, T613 and T614.

The output of the resetting transistor Q611 of the counter formed by the memory cores T612, T613 and T614 is applied from the emitter of that transistor to the base of the transistor Q612. The transistor Q612 forms the shift pulse for the second counter, the second counter being formed by the memory cores T608–T611. This shift pulse is developed across the coil C of the memory core T602, and is introduced thereby to the emitter of the transistor Q613. The transistor Q613 in turn produces the shift pulse in the windings C of the memory cores T608–T611, these latter windings being included in the collector circuit of the transistor Q613.

The output of the reset transistor Q614 of the counter formed by the memory cores T608–T611 is applied to the base of the transistor Q615 and through the collector circuit of that transistor to the coil A of the memory core T601. This causes a voltage to be produced across the coil C of that core to cause the transistor Q616 to introduce a shift pulse to the windings C of the memory cores T604–T607.

In the manner described above, therefore, each time the counter T612–T614 achieves a full count, a shift pulse is introduced to the counter T608–T611 to cause the latter counter to shift from one step to the next. Likewise, whenever the counter T608–T611 achieves a full count, a shift pulse is introduced to the counter T604–T607 to cause the latter counter to shift from one configuration to the next.

The output of the transistor Q617 of the counter T604–T607 is applied to a one-shot multivibrator formed by the transistors Q618 and Q619 in FIG. 23A. The output of the one-shot multivibrator is introduced to the base of the transistor Q620. This latter transistor is a 1-watt power transistor, for example, and it is capable of driving the actuating coil K601 of a ratcheting solenoid which drives the ten mile per digit calibrated dial 1110. As mentioned above, each revolution of the dial 1110 closes the contacts 1114. This energizes the coil K602 of the ratcheting solenoid which moves the hundred mile per digit dial 1118 from one digit position to the next.

The energizing coil K605 of the ratcheting solenoid which drives the calibrated dial 1130 is the energizing coil K604 of the ratcheting solenoid, which drives the calibrated dial 1126 and the energizing coil K603 of the ratcheting solenoid which, in turn, drives the calibrated dial 1122 are actuated by the transistors Q628, Q627 and Q625 respectively, as mentioned above. These latter transistors also may be one-watt power transistors, and they are each driven by respective coincidence gates. In the case of the transistor Q625, for example, the coincidence gates include the diodes CR651 and CR652. The diode CR651 is the enabling diode, and it is controlled by the flip-flop 1120. In like manner, the flip-flops 1124 and 1128 respectively control the enabling diodes of the respective coincidence gates associated with the transistors Q627 and Q628.

At the start of the interrogation mode, a positive signal is fed to the flip-flops 1120, 1124 and 1128 from the interrogation signal I by way of the lead E, and this positive pulse sets these flip-flops in such a condition that the coincidence gates referred to above are all disabled. Then, following the interrogation period, these flip-flops are set true to enable the coincidence gates so long as the corresponding counter signals described above are displaced from zero. During such an interval, a sequence of positive going pulses are fed to the diode CR652 and to the corresponding diodes in the other coincidence gates. These pulses step the counter circuits, and they are also passed by the coincidence gates to pulse the ratcheting solenoid coils K603, K604 and K605. This latter action causes the calibrated dials 1122, 1126 and 1130 to step backwards from one digit position to the next in the direction of the arrows in FIG. 23A. This stepping continues so long as the corresponding signals are displaced from zero.

The invention provides, therefore, an improved coded communication system. As mentioned above, the improved communication system of the invention enables correlation to be achieved between the decoding signals developed at the receiving station and the received coded intelligence signal. This correlation is effectuated by undergoing a short-code searching sequence and a long-code searching sequence at the beginning of each communication and whenever correlation is lost.

The invention also provides an improved manner of controlling the locally generated decoding signals at the receiving stations so that these decoding signals may be held in a locked relationship with the received coded communication signal. The improved coded communication system of the invention is also capable of attempting to re-establish correlation between the receiving stations and the transmitting station after periods of fade, as mentioned above, or whenever communication is lost for any reason.

The improved system of the invention is also advantageous in that it incorporates a range counting assembly, and it includes improved control means for enabling the system to be utilized to measure and indicate the ranges between an interrogating station and a selected responding station.

We claim:

1. In combination: a signal source for producing a signal having characteristic variations representative of intelligence, a first code source for producing a first code signal having apparently random characteristic variations but actually having characteristic variations conforming to a first particular code sequence which repeats after a relatively short time interval, a second code source for producing a second code signal likewise having apparently random characteristic variations but actually having characteristic variations conforming to a second particular code sequence which may repeat after a relatively long time interval, modifying circuit means responsive to the intelligence signal from the signal source and to a coded signal for modifying the characteristics of the coded signal in accordance with the characteristics of the intelligence signal, and means responsive to the signals from the first code source and to the signals from the second code source for initially introducing the first code signal to the modifying means for modification of such signal in accordance with the characteristics of the intelligence signal and of the first code signal and for subsequently introducing the second code signal to the modifying means for modification of the second code signal in accordance with the characteristics of the intelligence signal.

2. In combination: a signal source for producing a signal representative of intelligence to be transmitted from one point to another point, a source for generating a carrier signal, means coupled to said signal source and to said generating source for modulating the carrier signal in accordance with the intelligence signal to produce a modulated intelligence signal, a first code source for producing a first code signal having pseudo-random characteristic variations which are repetitive after a particular relatively short time interval, a second code source for producing a second code signal having pseudo-random characteristic variations which are repetitive after a particular relatively long time interval, modifying circuit means responsive to the modulated intelligence signal and to a coded signal for modulating the coded signal in accordance with the characteristics of the modulated intelligence signal, and selecting means responsive to the signals from the first code source and the second code source for initially introducing the first code signal to the modifying means for modification of the first code signal in accordance with the characteristics of the modulated intelligence signal to produce a short-code coded intelligence signal and for subsequently introducing the second code signal to the modifying means for modification of the second code signal in accordance with the characteristics of the modulated intelligence signal to produce a long-code coded intelligence signal.

3. The combination defined in claim 2, including, an indicating signal source for producing an indicating signal, and means responsive to the short-code coded intelligence signal for causing the indicating signal to be transmitted from said one point to the other during the production of the short-code coded intelligence signal.

4. The combination defined in claim 2, including, an indicating signal source for producing an indicating signal, and means responsive to the short-code coded intelligence signal for causing such indicating signal to replace the intelligence signal and be transmitted from said one point to the other just prior to the production of the long-code coded intelligence signal.

5. In combination, a signal source for producing a signal representative of intelligence to be transmitted from one point to another, a source for producing a binary carrier signal having a first voltage state and a second voltage state, modulating means coupled to said sources and responsive to the intelligence signal and to the binary carrier signal for frequency modulating the carrier signal in accordance with the intelligence signal to produce a modulated intelligence signal having first and second voltage states and exhibiting transitions between such voltage states, a first code source for producing a first binary code signal having first and second voltage states and exhibiting transitions between such voltage states in conformance with an apparently random particular code sequence which is repetitive after a relatively short time interval, a second code source for producing a second binary code signal having first and second voltage states and exhibiting transitions between such voltage states in conformance with an apparently random particular code sequence but which may be repetitive after a relatively long time interval, inverting circuit means responsive to the modulated intelligence signal and to the first and second code signals for passing the code signals without any change in amplitude during the occurrence of the first voltage state in the modulated intelligence signal and for changing the amplitude of the code signals from the first voltage state to the second voltage state and from the second voltage state to the first voltage state during the occurrence of the second voltage state in the modulated intelligence signal, and means responsive to the first code signal and the second code signal for initially introducing the first code signal to the inverting circuit means for modification of the first code signal in accordance with the voltage characteristics of the modulated intelligence signal and for subsequently introducing the second code signal to the inverting circuit means for modification of the second code signal in accordance with the voltage characteristics of the modulated intelligence signal.

6. The combination defined in claim 5 and in which said intelligence signal has a particular identifying frequency during the introduction of the first code signal to the inverting circuit means.

7. The combination defined in clam 5 and in which said intelligence signal has a particular identifying frequency just prior to the introduction of the second code signal to the inverting circuit means.

8. In a coded communication system for operating upon a coded intelligence signal which is initially coded in accordance with a first code signal having apparently random characteristic variations but actually having characteristic variations conforming to a first particular code sequence having a repetitive pattern after a particular relatively short time interval and which is subsequently coded in accordance with a second code signal also having apparently random characteristic variations but actually having characteristic variations conforming to a second particular code sequence having a repetitive pattern after a particular relatively long time interval, a receiving station including: means for receiving the coded intelligence signal, a code signal producing means for selectively producing signals corresponding to the first code signal and to the second code signal, decoding circuit means responsive to the signals from the receiving means and from the code signal producing means for detecting the coded intelligence signal to obtain the intelligence signal, and means coupled to the code signal producing means for initially obtaining the introduction of the first code signal from the code signal producing means to the decoding circuit means during the coding of the intelligence signal with the first code signal to obtain the detection of the intelligence signal by the decoding circuit means and for subsequently obtaining the introduction of the second code signal from the code signal producing means to the decoding circuit means during the coding of the intelligence signal with the second code signal to obtain the detection of the intelligence signal by the decoding circuit means.

9. The combination defined in claim 8, including, clock signal generating means coupled to the code signal producing means for controlling the clock frequency of the code signals produced by the code signal producing means.

10. In a coded communication system for operating upon a coded intelligence signal coded in accordance with a code signal having apparently random characteristic variations but actually having characteristic variations conforming to a particular code sequence having a particular clock frequency, a receiving station including: means for receiving the coded intelligence signal, a decoding signal producing means for producing at least one decoding signal corresponding to the above mentioned code signal, decoding circuit means coupled to the receiving means for detecting the coded intelligence signal to obtain the intelligence signal, means coupled to the decoding signal producing means for obtaining the introduction of the decoding signal from the decoding signal producing means to the decoding circuit means to obtain the detection of the intelligence signal, clock signal generating means coupled to the decoding signal producing means for producing clock signals at an adjustable frequency and for introducing the clock signals to the decoding signal producing means to control the frequency at which the decoding signal is produced, control means coupled to the clock signal generating means for obtaining a particular change in the clock frequency from the particular value during a search interval to achieve correlation between the decoding signal produced by the decoding signal producing means and the coding of the received coded intelligence signal, and means coupled to the clock signal generating means and responsive to the decoding signals and to the coded intelligence signal for locking the clock signal generating means for the production of a particular frequency upon the achievement of correlation between the decoding signal produced by the decoding signal producing means and the coding of the received coded intelligence signal.

11. The combination defined in claim 10, including, signal correlation circuit means coupled to said receiving circuit means and to said decoding signal producing means for producing a control signal indicative of variations at the receiving means between the received coded intelligence signal and the decoding signal produced by said decoding signal producing means, and means coupled to the correlation circuit means and to the clock signal generating means for introducing said control signal to the clock signal generating means to control the frequency of the clock signals and to maintain correlation between the decoding signal produced by the decoding signal producing means and the coding of the received coded intelligence signal.

12. In a coded communication system for operating upon a coded intelligence signal which is initially coded in accordance with a first code signal having apparently random characteristic variations but actually having characteristic variations conforming to a first particular code sequence having a repetitive pattern after a particular relatively short time interval and which is subsequently coded in accordance with a second code signal also having apparently random characteristic variations but actually having characteristic variations conforming to a second particular coded sequence having a repetitive pattern after a particular relatively long time interval, a receiving station including: means for receiving the coded intelligence signal, a decoding signal producing means for selectively producing first and second decoding signals respectively corresponding to the first code signal and to the second code signal, decoding circuit means responsive to the signals from the receiving means and from the coding signal producing means for detecting the coded intelligence signal to obtain the intelligence signal, control means coupled to the decoding signal producing means for initially obtaining the introduction of the first decoding signal from the decoding signal producing means to the decoding circuit means during the coding of the coded intelligence signal by the first coding signal to obtain the detection of the intelligence signal and for subsequently obtaining the introduction of the second decoding signal from the decoding signal producing means to the decoding circuit means during the coding of the intelligence signal by the second coding signal to obtain the detection of the intelligence signal, clock signal generating means coupled to the coding signal producing means for producing clock signals at an adjustable frequency and for introducing the clock signals to the decoding signal producing means to control the frequency of the decoding signals produced by the decoding signal producing means, and means coupled to the clock signal generating means for causing the clock frequency to shift from one value to another for a particular time interval until correlation is achieved with the received coded intelligence signal when such coded intelligence signal is coded in accordance with the first code signal and for causing the clock frequency to shift periodically between two values for a subsequent time interval until correlation is achieved with the received coded intelligence signal when said coded intelligence signal is coded in accordance with the second code signal.

13. In a coded communication system for operating upon a coded intelligence signal which is initially coded in accordance with a first code signal having apparently random characteristic variations but actually having characteristic variations conforming to a first particular code sequence having a repetitive pattern after a particular relatively short time interval and which is subsequently coded in accordance with a second code signal also having apparently random characteristic variations but actually having characteristic variations conforming to a second particular code sequence having a repetitive pattern after a relatively long time interval and which includes an indicating signal for indicating when the changeover from the initial coding to the subsequent coding is to occur, a receiving station including: means for receiving the coded intelligence signal, a decoding signal producing means for selectively producing first and second decoding signals respectively corresponding to the first code signal and to the second code signal, decoding circuit means coupled to the receiving means and to the decoding signal producing means for detecting the coded intelligence signal to obtain the intelligence signal, control means coupled to the decoding signal producing means for initially obtaining the introduction of the first decoding signal from the decoding signal producing means to the decoding circuit means during the coding of the coded intelligence signal by the first code signal to obtain the intelligence signal and for subsequently obtaining the introduction of the decoding signal from the decoding signal producing means to the decoding circuit means during the coding of the coded intelligence signal by the second coding signal to obtain the intelligence signal, and means responsive to the indicating signal included in the coded intelligence signal for causing the control means to terminate the introduction of the first decoding signal to the decoding circuit means and to initiate the introduction of the second decoding signal to the decoding circuit means.

14. The combination defined in claim 13, including, clock signal generating means coupled to the decoding signal producing means for producing clock signals at an adjustable frequency and for introducing the clock signals to the decoding signal producing means to control the frequency of the first and second decoding signals produced by the decoding signal producing means, and means responsive to the indicating signal for causing the clock frequency to shift periodically between two values for a particular time interval after the introduction of the second code signal to the coded intelligence signal and until correlation is achieved between the second decoding signal and the coded intelligence signal.

15. In a coded communication system for operating upon a coded intelligence signal which is coded in accordance with a code signal having apparently random characteristic variations but actually having characteristic variations conforming to a particular code sequence having a particular clock frequency, a receiving station including: means for receiving the coded intelligence signal, a decoding signal producing means for producing at least one decoding signal corresponding to the above mentioned code signal, decoding circuit means responsive to the signals from the receiving means and from the decoding signal producing means for detecting the coded intelligence signal to obtain the intelligence signal, means coupled to the decoding signal producing means for obtaining the introduction of the decoding signal from the decoding signal producing means to the decoding circuit means to obtain the intelligence signal, clock signal generating means coupled to the decoding signal producing means for producing clock signals at a frequency adjustable from a particular frequency and for introducing the clock signals to the decoding signal producing means to control the frequency of the decoding signal produced by the decoding signal producing means, first control means coupled to the clock signal generating means for obtaining particular variations in the clock frequency from the particular value during a search interval to achieve correlation between the decoding signal produced by the decoding signal producing means and the coding of the received coded intelligence signal, means operatively coupled to the clock signal generating means for locking the clock signal generating means at a particular frequency to maintain the correlation between the decoding signal and the coding of the received coded intelligence signal, and second control means coupled to the first control means to activate the first control means during periods of reception of the coded intelligence signal below an established threshold value.

16. The combination defined in claim 15, in which the second control means includes memory means for delaying the activation of the first control means by the second control means for a particular interval and for establishing the frequency of the clock signal generating means at a fixed value during each such particular interval.

17. In combination for use in each of a first station and a second station displaced from one another by a distance to be measured, a transmitting section including: a first source for producing a signal to be transmitted, a second source for producing a code signal having a controllable clock frequency, transmitter control means coupled to the second source for controlling the clock frequency of the code signal produced thereby, and coding circuit means coupled to the first source and to the second source for producing a signal coded in accordance with a particular code sequence and which code sequence has a particular clock frequency established by the transmitter control means; a receiving section for receiving the coded signal from the transmitting section of the other station and including means for receiving the coded signal, a decoding signal producing means for producing a signal corresponding to the code signal produced by the transmitting section of the other station, decoding circuit means coupled to the receiving means and to the decoding signal producing means and responsive to the decoding signal for decoding the received signal, receiver correlation means coupled to the receiving means and to the decoding signal producing means for producing a control signal indicative of the displacement of the received signal and the decoding signal, and receiver control means coupled to the correlation means and to the decoding signal producing means for controlling the clock frequency of the decoding signal in response to the correlation control signal from the correlation means to obtain a correlation between the received signal and the decoding signal; first switching means coupled to said transmitting and receiving signals for causing the transmitting section of the first station to transmit the coded signal to the receiving section of the second station, second switching means coupled to said transmitting and receiving sections for subsequently causing the transmitted section of the second station to transmit the coded signal to the receiving section of the first station and to set the receiver control means at the first station to a condition such that said clock frequency is established at a particular displaced value; and range indicating counter means coupled to the receiver correlation means of the first station and to the receiver control means of the first station to indicate the time required for correlation to be established between the signal received from the second station and the signal produced by the code signal producing means of the first station.

18. A system for measuring the range between a first station and a second station including: means at the first station for transmitting a signal and for producing a particular code signal to code the transmitted signal, first means at the second station for receiving the coded signal from the first station and for producing a decoding signal corresponding to the particular code signal and displaced in phase with respect thereto by an amount corresponding to the range between the first and second station so as to decode the received coded signal, second means at the second station and coupled to the first means at the second station for transmitting a signal coded in accordance with the decoding signal produced at the second station, second means at the first station for receiving the coded signal from the second station and for producing the particular decoding signal to decode the received coded signal, control means at the first station and coupled to the second means at the first station for varying the particular decoding signal produced by the second means at the first station until correlation with the coded signal received from the second station is achieved, and range indicating means coupled to the last named control means for providing an indication as to the range between the first and second stations in accordance with the time required to achieve correlation between the decoding signal and the coded signal received from the second station.

19. A receiving station for use in a coded communication system for receiving a coded intelligence signal coded in accordance with a code signal, said receiving station including: means for receiving the coded intelligence signal, decoding signal producing means for producing a first decoding signal having characteristics corresponding to the code signal and for producing a second decoding signal similar to the first decoding signal and time delayed with respect thereto, decoding circuit means responsive to the decoding signals produced by the decoding signal producing means for decoding the coded intelligence signal, detector means coupled to the decoding circuit means for respectively producing first and second control signals in response to the first and second decoding signals, and control means responsive to the first and second control signals produced by the detector means to control the producing means and maintain a synchronized condition between the decoding signals and the received coded intelligence signal.

20. In a coded communication system for operating upon a coded intelligence signal coded in accordance with a code signal having apparently random characteristic variations but actually having characteristic variations conforming to a particular code sequence having a particular clock frequency, a receiving station including: means for receiving the coded intelligence signal, a decoding signal producing means for producing a first decoding signal and a signal decoding signal individually corresponding to the above mentioned code signal and displaced in time with respect to one another, decoding circuit means responsive to the first and second decoding signals produced by the decoding signal producing means for decoding the coded intelligence signal and for producing a first signal having a first particular frequency in response to the first decoding signal and a second signal having a second particular frequency in response to the second decoding signal, clock signal generating means coupled to the decoding signal producing means for controlling the clock frequency of the first and second decoding signals produced thereby, control means coupled to the decoding circuit means for selecting and comparing the first and second signals produced thereby to produce a control signal, and means coupled to the control means and to the clock signal producing means and responsive to the control signal from the control means for controlling the frequency of the clock signal generating means so as to maintain the first and second decoding signals synchronized with the received coded intelligence signal.

21. A system for producing a code signal having apparently random characteristic variations but actually having characteristic variations conforming to a particular code sequence which repeats after a relatively long time interval, said system including: first code signal generating means for producing a first code signal having characteristic variations conforming to a first code sequence which repeats after a first particular time interval, second code generating means for producing a second code signal having characteristic variations conforming to a second code sequence which repeats after a second particular time interval different from the first particular time interval, and means coupled to the first code generating means and to the second code generating means for producing a third code signal having characteristic variations conforming to a code sequence which is repetitive only after a long interval as compared with the repetition intervals of the first and second code sequences and which is patterned in accordance with the repetition intervals of the first and second code sequences.

22. A system for producing a code signal having apparently random characteristic variations but actually having characteristic variations conforming to a particular code sequence which repeats after a relatively long time interval, said system including: first shift register means for producing a first plurality of successive pulses individually occurring at apparently random times but conforming to a first code sequence which repeats after a first particular time interval, second circulating register means for producing a second plurality of successive pulses individually occurring at apparently random times but conforming to a second code sequence which repeats after a second particular time interval different from the first particular time interval, and mixing means coupled to the first circulating register means and to the second circulating register means for producing a code signal conforming to a code sequence which is repetitive only after a long interval as compared with the repetition intervals of the first and second code sequences and which is patterned in accordance with the repetition intervals of the first and second code sequences.

23. A system for producing a code signal having apparently random characteristic variations but actually having characteristic variations conforming to a particular code sequence which repeats after a relatively long time interval, said system including: a first code selector for establishing a first particular code sequence, a first circulating register, means coupled to the first circulating register for introducing a pulse to the circulating register, means coupled to the first circulating register for sampling at successive intervals the introducing pulse during the circulation of the pulse through the first circulating register to produce a plurality of successive pulses in response thereto and for introducing the successive pulses to the first code selector to obtain a sereis of output pulses corresponding to said first particular code sequence, means coupled to the first code selector for introducing the serial output pulses therefrom to the first circulating register to be circulated therein and thereby forming a first code signal, a second code selector for establishing a second particular code sequence, a second circulating register, means coupled to the second circulating register for introducing a second pulse to the second circulating register, means coupled to the second circulating register for sampling the second pulse at successive intervals during the circulation of the second pulse through the second register and for introducing the successive pulses to the second code selector to obtain a series of output pulses corresponding to said second particular code sequence, and means responsive to the first and second code signals for producing a third code signal patterned in accordance with the sequences of the first and second code signals and having a code sequence which repeats only after a long interval as compared with the repetition intervals of the code sequences of the first and second code signals.

24. In combination at a first station for operating upon signals coded on a continuous basis in a particular asynchronous pseudo-random relationship with respect to time and continuously modulated by intelligence signals to obtain modulated intelligence signals and transmitted in a continuously modulated form from a second station, means at the first station for receiving the modulated intelligence signals from the second station, means at the first station for producing decoding signals continuously coded in the same particular asynchronous pseudo-random relationship with respect to time as the coded signals, synchronizing means at the first station and responsive to the decoding signals and to the modulated intelligence signals received at the first station for varying the times of occurrence of the decoding signals relative to the coding of the modulated intelligence signals during an asynchronous relationship between the decoding signals and the coding of the modulated intelligence signals and until the production of such a synchronous relationship, means at the first station and operatively coupled to the synchronizing means and to the decoding-signal-producing means for locking the operation of the decoding-signal-producing means to maintain the times of occurrence of the decoding signals upon the production of a synchronous relationship between the decoding signals and the modulated intelligence signals, means at the first station and responsive to the decoding signals and to the modulated intelligence signals for combining the signals to obtain the intelligence signals, and means operatively coupled to the synchronizing means and responsive to the decoding signals and to the modulated intelligence signals for obtaining an operation of the synchronizing means only upon each subsequent deviation of the decoding signals and the coding of the modulated intelligence signals from a sychronous relationship.

25. In combination at a first station for operating upon signals coded in a particular asychronous pseudo-random relationship with respect to time and modulated by intelligence signals to obtain modulated intelligence signals and transmitted in modulated form from a second station as the modulated intelligence signals, means at the first station for receiving the modulated intelligence signals from the second station, signal means at the first station for producing decoding signals in the particular asynchronous pseudo-random relationship with respect to time, means responsive to the decoding signals and to the modulated intelligence signals for varying the rate of occurrence of the decoding signals until the production of a particular relationship between the decoding signals and the occurrence of the coding in the modulated intelligence signal received at the first station, means operatively coupled to the synchronous means and the signal means for locking the signal means for the production of the decoding signals at a particular rate upon the occurrence of synchronization between the rate of occurrence of the decoding signals and the occurrence of the coding in the modulated intelligence signals, and means operatively coupled to the last mentioned means and responsive to the decoding signals and to the modulated intelligence signal received at the first station for combining these signals, only upon the occurrence of the particular relationship between the decoding signals and the coding of the modulated intelligence signals, to produce the intelligence signals.

26. In combination for use to provide for a transmission of intelligence from a first station to a second station removed from the first station, a signal source at the first station for producing a sequence of coding signals occurring in a particular asynchronous pseudo-random pattern, modulating means responsive to the sequence of coding signals from the signal source for modulating the coding signals in the sequence in accordance with the intelligence to produce modulated intelligence signals, means responsive to the modulated intelligence signals for obtaining a transmission of such signals to the second station, means at the second station for receiving the modulated intelligence signals transmitted from the first station, signal means at the second station for producing a sequence of decoding signals in a pattern corresponding to the pattern of the coding signals, synchronizing means at the second station and responsive to the received signals and to the decoding signals for varying the rate of occurrence of the decoding signals during a lack of a particular relationship between the decoding signals and the coding of the received signals until the production of the particular relationship between the decoding signals and the coding of the received signals, means operatively coupled to the synchronizing means and to the signal means for locking the signal means at a particular rate of occurrence corresponding to the production of the particular relationship between the decoding signals and the coding of the received signals, and means responsive to the received signals and to the decoding signals for detecting the received signals only upon the occurrence of the particular relationship between the decoding signals and the received signals, to produce the intelligence.

27. In combination for use at a first station to provide for a transmission of intelligence to a second station removed from the first station, a signal source at the first station for producing a sequence of coding signals occurring in a particular asynchronous pseudo-random pattern, modulating means responsive to the sequence of coding signals from the signal source for modulating the coding signals in the sequence in accordance with the intelligence to produce modulated intelligence signals, means responsive to the modulated intelligence signals for obtaining a transmission of such signals to the second station, means at the second station for receiving the modulated intelligence signals transmitted from the first station, signal means at the second station for producing a sequence of decoding signals in a pattern corresponding to the pattern of the coding signals, synchronizing means at the second station and responsive to the decoding signals and the received signals for initially obtaining a particular relationship between the occurrence of the decoding signals and the occurrence of the corresponding coding signals in the modulated intelligence signals received at the second station, means at the second station and responsive to the decoding signals and the received signals and operatively coupled to the synchronizing means for detecting the received signals in accordance with the decoding signals to obtain the intelligence only upon the occurrence of the particular relationship between the occurrence of the decoding signals and the occurrence of the corresponding coding signals in the modulated intelligence signals, means at the second station and operatively coupled to the decoding means and to the synchronizing means for locking the operation of the decoding means at a particular rate of occurrence of the decoding signals upon the occurrence of the particular relationship between the occurrence of the decoding signals and the occurrence of the corresponding coding signals in the modulated intelligence signals received at the second station, and means at the second station and responsive to the decoding signals and the received signals and operatively coupled to the synchronizing means for initiating an operation of the synchronizing means only upon each subsequent lack of the particular relationship between the occurrence of the decoding signals and the occurrence of the corresponding coding signals in the modulated intelligence signals to obtain such a synchronization.

28. In combination for use at a first station to provide for a transmission of intelligence to a second station removed from the first station, a first signal source at the first station for producing in a pseudo-random pattern a first sequence of signals having characteristics to promote a synchronization between the operation of the first and second stations, a second signal source at the first station for producing in a pseudo-random pattern a second sequence of signals different from the first sequence of signals and having characteristics for modulation by the intelligence means at the first station and responsive to the second sequence of signals and the intelligence for modulating the second sequence of signals by the intelligence to obtain the production of modulated intelligence signals, means at the first station and responsive to the signals in the first and second sequences for initially obtaining a transmission of the signals in the first sequence and then a transmission of the modulated intelligence signals in the second sequence, means at the second station for receiving the signals transmitted from the first station, means at the second station for producing decoding signals in the first and second sequences, means at the second station and responsive to the signals received at the second station in the second sequence and to the decoding signals in the second sequence to obtain a decoding of the intelligence transmitted from the first station in the modulated intelligence signals in accordance with a modulation of the modulated intelligence signals and the decoding signals and upon the production of a particular relationship between the received signals in the second sequence and the decoding signals in the second sequence; and means at the second station and responsive to the signals received at the second station and operative during the reception of the signals in the first sequence to obtain a particular relationship between the signals produced by the decoding means in the first sequence and the reception of the signals in the first sequence from the first station and means at the second station and responsive to the production of the particular relationship between the signals received at the second station in the first sequence and the decoding signals in the first sequence for obtaining the production of the particular relationship between the signals received in the second sequence and the decoding signals in the second sequence.

29. In combination at a first station for operating upon signals coded in a particular asynchronous relationship with respect to time and modulated by intelligence signals to produce modulated intelligence signals and transmitted in a modulated form from a second station as the modulated intelligence signals, means at the first station for receiving the modulated intelligence signals from the second station, signal means at the first station for producing decoding signals having the same asynchronous pattern with respect to time as the coding signals, means at the first station and responsive to the modulated intelligence signals and to the decoding signals for varying in a particular time relationship the pattern of occurrence of the decoding signals with respect to the pattern of the coding of the modulated intelligence signals until a synchronous relationship between the occurrence of the coding signals and the pattern of the coding of the modulated intelligence signals, means operatively coupled to the synchronizing means and to the signal means for locking the signal means for the production of a particular asynchronous pattern upon the occurrence of the synchronous relationship between the occurrence of the coding signals and the pattern of the coding of the modulated intelligence signals received at the first station, means operatively coupled to the locking means and responsive to the decoding signals and to the modulated intelligence signals received at the first station for combining these signals to detect the intelligence signals upon the occurrence of the synchronous relationship between the occurrence of the coding signals and the pattern of the coding of the modulated intelligence signals received at the first station, and means responsive to a failure of reception of the modulated intelligence signals for maintaining the production of the decoding signals in the particular asynchronous pattern with respect to time and in a substantially constant timed relationship.

30. In combination at a first station for operating upon signals coded in a particular asynchronous relationship with respect to time and modulated by intelligence signals to provide modulated intelligence signals and transmitted in a modulated form from a second station as the modulated intelligence signals, means at the first station for receiving the modulated intelligence signals from the second station, signal means at the first station for producing decoding signals in the same particular asynchronous relationship with respect to time as the coded signals, synchronizing means at the first station and responsive to the decoding signals and the modulated intelligence signals received at the first station for varying the pattern of occurrence of the decoding signals with respect to the pattern of the coding of the modulated intelligence signals to obtain a particular relationship between the decoding signals and the coding of the modulated intelligence signals, means operatively coupled to the signal means and the synchronizing means for locking the operation of the signal means in a particular pattern upon the occurrence of the particular relationship between the decoding signals and the coding of the modulated intelligence signals, means operatively coupled to the locking means and responsive to the decoding signals and the modulated intelligence signals received at the first station for combining these signals to produce the intelligence signals upon the occurrrence of the particular relationship between the decoding signals and the coding of the modulated intelligence signals, and means responsive to the decoding signals and to the modulated intelligence signals and operatively coupled to the synchronizing means for placing the first station on a stand-by basis upon a failure to achieve the particular relationship between the occurrence of the decoding signals and the coding of the modulated intelligence signals within a particular period of time.

31. In combination at a first station for operating upon signals coded in a particular asynchronous relationship with respect to time and modulated by intelligence signals to provide modulated intelligence signals and transmitted in a modulated form from a second station as the modulated intelligence signals, means at the first station for receiving the modulated intelligence signals from the second station, signal means at the first station for producing decoding signals in the same particular asynchronous relationship with respect to time as the coded signals, synchronizing means at the first station and responsive to the decoding signals and to the modulated intelligence signals for varying the frequency of occurrence of the decoding signals until the production of a particular relationship between the decoding signals and the coding of the modulated intelligence signals received at the first station, means operatively coupled to the signal means and the synchronizing means for locking the operation of the signal means in a particular pattern upon the occurrence of the particular relationship between the decoding signals and the coding of the modulated intelligence signals, means operatively coupled to the locking means and responsive to the decoding signals and to the modulated intelligence signals for combining these signals to produce the intelligence signals upon the occurrence of the particular relationship between the decoding signals and the coding of the modulated intelligence signals received at the first station, means responsive to the modulated intelligence signals and operatively coupled to the locking means for maintaining the frequency of occurrence of the decoding signals for a particular period of time in the absence of reception of the modulated intelligence signals, and means operatively coupled to the locking means and responsive to the modulated intelligence signals for activating the synchronizing means upon a failure to receive the modulated intelligence signals for the particular period of time.

32. The combination set forth in claim 31 in which means are included for imposing a stand-by operation upon the receiving means upon a failure of the control means to obtain the particular relationship between the decoding signals and the coding of the modulated intelligence signals within a particular period of time after the activation of the synchronizing means.

33. In combination at a first station for operating upon signals coded in a particular asynchronous relationship with respect to time and received from a second station wherein the second station produces the coded signals in a relationship displaced from corresponding coding signals at the first station by a period of time corresponding to the distance between the stations, means at the first station for receiving the coded signals from the second station, means responsive to the coded signals received at the first station and responsive to the coded signals produced at the first station for varying in a particular pattern the frequency at which the coded signals are produced at the first station until the occurrence of a particular relationship between the coded signals received at the first station and the coded signals produced at the first station, and means responsive to the coded signals received at the first station and the coded signals produced at the first station to provide an indication as to the range between the first and second stations in accordance with the period of time required to produce the particular relationship between such signals.

34. In combination for operating upon signals coded in a first particular asynchronous relationship with respect to time and modulated by intelligence signals to provide modulated intelligence signals and transmitted in a modulated form from a first station to a second station as the modulated intelligence signals, means at the first station for providing signals coded in a second particular asynchronous relationship different from the first particular asynchronous relationship and coded to facilitate a synchronous relationship with the operation of the second station, means at the first station for providing a modifying signal, means at the first station and responsive to the signals coded in the second asynchronous relationship for obtaining a transmission only of such signals to the second station and for subsequently obtaining a transmission of the modifying signal to indicate that the modulated intelligence signals will follow and for thereafter obtaining a transmission of the coded signals in the first particular asynchronous relationship, means at the second station for receiving the coded signals, means at the second station for producing decoding signals initially coded in a pattern corresponding to the coded signals in the first and second particular asynchronous relationships, synchronizing means at the second station and responsive to the decoding signals and to the signals received at the second station for varying the frequency of occurrence of the decoding signals to obtain a particular relationship between the decoding signals and the coded signals received at the second station in the second particular asynchronous relationship and subsequently in the second particular relationship, means at the second station and operatively coupled to the synchronizing means and responsive to the modulated intelligence signals for detecting such signal upon the occurrence of the particular relationship between the decoding signals and the coded signals received at the second station in the second particular asynchronous relationship and subsequently in the first particular asynchronous relationship, and means at the second station and responsive to the modifying signal received from the first station for activating the last mentioned detecting means to obtain a detection of the modulated intelligence signals upon the occurrence of the particular relationship between the decoding signals and the coded signals received at the particular station in the first particular asynchronous relationship.

35. In combination at a first station for operating upon signals coded in a particular asynchronous relationship with respect to time and modulated by intelligence signals and transmitted in a modulated form from a second station, means at the first station for receiving the modulated intelligence signals from the second station, and means at the first station and operatively coupled to the synchronizing means and responsive to the production of the particular relationship between the decoding signals and the coding of the modulated intelligence signals for locking the operation of the clock means to maintain the production of the clock signals at a frequency to maintain the production of such particular relationship, means at the first station for producing decoding signals in the same particular asynchronous relationship as the coded signals, clock means at the first station for producing clock signals on a periodically recurrent basis, means at the first station and responsive to the clock signals for synchronizing the occurrence of the decoding signals with the frequency of the clock signals, means at the first station and responsive to the decoding signals and to the modulated intelligence signals received at the first station for detecting the modulated intelligence signals to produce the intelligence signals, synchronizing means at the first station and responsive to the decoding signals and the modulated intelligence signals for varying the frequency of the clock signals to maintain a particular relationship between the decoding signals and the coding of the modulated intelligence signals.

36. In combination at a first station for operating upon signals coded in a particular asynchronous relationship with respect to time and modulated by intelligence signals to provide modulated intelligence signals and transmitted in a modulated form from a second station as the modulated intelligence signals, means at the first station for receiving the modulated intelligence signals from the second station, means at the first station for producing decoding signals in the same particular asynchronous relationship as the coded signals, clock means for producing clock signals on a recurrent basis, means at the first station and responsive to the clock signals for synchronizing the production of the decoding signals with the frequency of occurrence of the clock signals, synchronizing means at the first station and responsive to the decoding signals and the modulated intelligence signals and operatively coupled to the clock means for varying the frequency of the clock signals in a particular pattern until the production of a particular relationship between the decoding signals and the coding of the modulated intelligence signals, means at the first station and operatively coupled to the clock means for locking the operation of the clock means at a particular frequency for maintaining the particular relationship between the decoding signals and the coding of the modulated intelligence signals upon the production of such particular relationship and means at the first station and responsive to the decoding signals and the modulated intelligence signals and operatively coupled to the last mentioned means for detecting the modulated intelligence signals only upon the occurrence of the particular relationship between the decoding signals to obtain the intelligence, and the coding of the modulated intelligence signals.

37. In combination at a first station for operating upon signals coded in a particular asynchronous relationship with respect to time and modulated by intelligence signals to provide modulated intelligence signals and transmitted in modulated form from a second station as the modulated intelligence signals, means at the first station for receiving the modulated intelligence signals from the second station, means at the first station for producing first decoding signals in the same particular asynchronous relationship as the coded signals, means at the first station and responsive to the first decoding signals for producing second decoding signals in the same particular asynchronous relationship as the coded signals and on a delayed basis with respect to the first decoding signals, means at the first station and responsive to the first and second decoding signals and to the modulated intelligence signals for producing control signals representing phase displacements from a particular phase relationship between the modulated intelligence signals and the first and second decoding signals, means at the first station and responsive to the control signals produced by the last mentioned means to vary the times of occurrence of the first and second decoding signals in accordance with the characteristics of the control signal for the production of a particular relationship between the first decoding signals and the coding of the modulated intelligence signals, and means at the first station and responsive to the modulated intelligence signals and the first decoding signals and operatively coupled to the last mentioned means for detecting the modulated intelligence signals, upon the production of the particular relationship between the first decoding signals and the coding of the modulated intelligence signals, to produce the intelligence signals.

38. In combination at a first station for operating upon signals coded in a particular asynchronous relationship with respect to time and modulated by intelligence signals to provide modulated intelligence signals and transmitted in modulated form from a second station as the modulated intelligence signals, means at the first station for receiving the modulated intelligence signals from the second station, means at the first station for producing first decoding signals in the same particular asynchronous relationship as the coded signals, means at the first station and responsive to the first decoding signals for producing second decoding signals having the same particular asynchronous relationship as the coded signals and having a particular phase displacement from the first decoding signals, means at the first station for producing clock signals on a recurrent basis, means at the first station and responsive to the clock signals for obtaining the production of the first and second decoding signals in accordance with the frequency of the clock signals, means at the first station and responsive to the first and second decoding signals and to the modulated intelligence signals for producing control signals in accordance with the relative phase between the first decoding signals and the coding of the modulated intelligence signals and between the second decoding signals and the coding of the modulated intelligence signals, means at the first station and responsive to the control signals produced by the last mentioned means for varying the frequency of the clock signals to obtain a particular relationship between the first decoding signals and the coding of the modulated intelligence signals, and means at the first station and responsive to the first decoding signals and the modulated intelligence signals for combining these signals to obtain the intelligence signals.

39. In combination for use to provide for a transmission of intelligence from a first station to a second station removed from the first station, a signal source at the first station for producing a sequence of coding signals occurring in a particular asynchronous pseudo-random pattern, modulating means at the first station and responsive to the sequence of coding signals from the signal source for modulating the signals in the sequence in accordance with the intelligence to produce modulated intelligence signals, means at the first station and responsive to the modulated intelligence signals for obtaining a transmission of such signals to the second station, means at the second station for receiving the modulated intelligence signals transmitted from the first station, signal means at the second station for producing decoding signals in the same asynchronous pattern as the coding of the modulated intelligence signals at the first station, synchronizing means at the second station and responsive to the decoding signals and to the modulated intelligence signals received at the second station for varying the times of occurrence of the decoding signals to provide a particular relationship between the decoding signals and the coding of the modulated intelligence signals, locking means operatively coupled to the signal means and responsive to the production of the particular relationship between the decoding signals and the coding of the modulated intelligence signals for locking the operation of the signal means to maintain such particular relationship, and means at the second station and responsive to the decoding signals and to the modulated intelligence signals for combining these signals, upon the production of the particular relationship between the decoding signals and the modulated intelligence signals, to produce the intelligence signals.

40. In combination for use to provide for a transmission of intelligence from a first station to a second station removed from the first station, a signal source at the first station for producing a sequence of coding signals occurring in a particular asynchronous pseudo-random pattern, means at the first station and responsive to the coding signals and to the intelligence for modulating the coding signals in accordance with the intelligence to produce modulated intelligence signals, means at the first station and responsive to the modulated intelligence signals for transmitting the signals to the second station, means at the second station for receiving the modulated intelligence signals, clock means at the second station for producing clock signals on a recurrent basis, means at the second station and responsive to the clock signals for producing decoding signals at a rate related to the frequency of the clock signals and in a pattern corresponding to the asynchronous pattern of the coding signals, synchronizing means at the second station and responsive to the decoding signals and to the coding of the modulated intelligence signals for varying the frequency of the clock signals to maintain a particular relationship between the decoding signals and the coding of the modulated intelligence signals, means at the second station and responsive to the production of the particular relationship between the decoding signals and the coding of the modulated intelligence signals for locking the operation of the clock means to maintain the production of the clock signals as a rate for maintaining such particular relationship, and means at the second station and responsive to the decoding signals and to the modulated intelligence signals and operative upon the production of the particular relationship between the decoding signals and the coding of the modulated intelligence signals for detecting the intelligence.

41. In combination to provide for a transmission of intelligence from a first station to a second station removed from the first station, a signal source at the first station for producing a sequence of coding signals occurring in a particular asynchronous pattern, means at the first station and responsive to the coding signals and to the intelligence for modulating the coding signals in accordance with the intelligence to produce modulated intelligence signals, means at the first station and responsive to the modulated intelligence signals for transmitting the signals to the second station, means at the second station for receiving the modulated intelligence signals transmitted from the first station, means at the second station for producing first decoding signals in the particular asynchronous pattern, means at the second station and responsive to the first decoding signals for producing second decoding signals having a particular phase relationship to the first decoding signals, means responsive to the first and second decoding signals and to the modulated intelligence signals for varying the times of occurrence of the first and second decoding signals to maintain particular phase relationships between the first decoding signals and the coding of the modulated intelligence signals and between the second decoding signals and the coding of the modulated intelligence signals, and means responsive to the first decoding signals and the modulated intelligence signals for detecting the modulated intelligence signals to produce the intelligence.

42. In combination for use at a first station to provide for a transmission of intelligence from the first station to a second station removed from the first station;

first means for providing a relatively short sequence of first signals in a pseudo-random code for a particular period of time to obtain a synchronization in the operation of the first and second stations, second means operatively coupled to the first means for providing for the transmission of a second signal during the transmission of the first signal to provide an indication to the second station that the first signals do not represent intelligence, third means operatively coupled to the first means for providing a relatively long sequence of third signals in a pseudo-random code after the production of the first signals, fourth means operatively coupled to the third means for modulating the third signals in accordance with the intelligence to provide modulated intelligence signals, and fifth means operatively coupled to the fourth means for obtaining a transmission of the modulated intelligence signals to the second station.

43. In combination for use at a first station to provide for a transmission of intelligence from the first station to a second station removed from the first station;

a signal source for providing a sequence of coding signals, first control means operatively coupled to the signal source for obtaining the production of first signals by the source in a first asynchronous sequence for a first particular period of time to provide for a synchronization in the operation of the first and second stations;

second control means operatively coupled to the first control means for obtaining a transmission of a second signal during the transmission of the first signals to indicate that the first signals do not represent intelligence, third control means operatively coupled to the first control means and the signal source for obtaining the production of third signals by the source in a second asynchronous sequence different from the first asynchronous sequence and for obtaining the production of the third signals after the production of the first signals, and means operatively coupled to the third control means for modulating the third signals with the intelligence to obtain modulated intelligence signals.

44. In combination for use at a first station to provide for a transmission of intelligence from the first station to a second station removed from the first station;

first means for providing clock signals at a particular frequency, second means operatively coupled to the first means for providing a relatively short sequence of first encoding signals in a pseudo-random code for a particular period of time in synchronism with the clock signals to obtain a synchronization in the operation of the first and second stations, third means operatively coupled to the second means for providing for the transmission of a second signal with particular characteristics during the transmission of the first signal to provide an indication to the second station that the first signals do not represent intelligence, fourth means operatively coupled to the first and second means for providing a relatively long sequence of second encoding pulses in a pseudo-random code in synchronism with the clock signals and after the production of the first encoding signals, and fifth means operatively coupled to the first and fourth means for modulating the second encoding signals in synchronism with the clock signals to provide modulated intelligence signals.

45. The combination set forth in claim 44, including, sixth means operatively coupled to the fifth means for obtaining a transmission of the modulated intelligence signals.

* * * * *